US009315289B2

(12) United States Patent
Nakamura et al.

(10) Patent No.: US 9,315,289 B2
(45) Date of Patent: Apr. 19, 2016

(54) PACKAGING MEMBER AND PACKAGING METHOD

(75) Inventors: Shogo Nakamura, Shizuoka (JP); Tomokazu Saito, Shizuoka (JP); Atsushi Inoue, Shizuoka (JP); Seiji Terazawa, Shizuoka (JP); Mizuho Imaruoka, Shizuoka (JP); Chiharu Matsui, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 817 days.

(21) Appl. No.: 13/313,155

(22) Filed: Dec. 7, 2011

(65) Prior Publication Data

US 2012/0144783 A1 Jun. 14, 2012

(30) Foreign Application Priority Data

Dec. 9, 2010 (JP) ..... 2010-274396

(51) Int. Cl.
*B65D 5/50* (2006.01)

(52) U.S. Cl.
CPC ..... *B65D 5/5004* (2013.01); *B65D 5/505* (2013.01); *B65D 5/5054* (2013.01); *B65D 2585/689* (2013.01); *G03G 2215/0875* (2013.01); *G03G 2215/0886* (2013.01)

(58) Field of Classification Search
CPC ..... B65D 2571/0066; B65D 5/48036; B65D 5/5016; B65D 5/48034; B65D 81/058; B65D 5/5004; B65D 5/505; B65D 5/5054; B65D 2585/698; B65D 81/02; B65D 81/05; B65D 81/053; B65D 51/057; B65B 81/02; B65B 81/05; B65B 81/057; G03G 2215/0886; G03G 2215/0875
USPC ..... 53/461, 474, 462, 473; 229/120.02, 229/103.2, 103.3, 122.24, 122.26, 122.29, 229/183, 184, 185.1, 186, 191, 192; 206/521, 583, 586, 593, 521.2–521.9
See application file for complete search history.

(56) References Cited

U.S. PATENT DOCUMENTS

| | | | | |
|---|---|---|---|---|
| 1,824,359 | A * | 9/1931 | Miller | 62/372 |
| 2,653,708 | A * | 9/1953 | Spalding | 206/446 |
| 2,790,588 | A * | 4/1957 | Deeren | 206/521 |
| 2,828,902 | A * | 4/1958 | Ringler | 206/583 |
| 3,308,980 | A * | 3/1967 | Taylor | 215/13.1 |
| 3,653,496 | A * | 4/1972 | Roberts et al. | 206/326 |
| 4,811,858 | A * | 3/1989 | Augur | 215/13.1 |

(Continued)

FOREIGN PATENT DOCUMENTS

| | | |
|---|---|---|
| DE | 4130883 | 4/1992 |
| FR | 2758530 | 7/1998 |

(Continued)

OTHER PUBLICATIONS

Japanese official action dated Jul. 11, 2014 in corresponding Japanese patent application No. 2010-274396.

*Primary Examiner* — Stephen F Gerrity
(74) *Attorney, Agent, or Firm* — Cooper & Dunham LLP

(57) ABSTRACT

A packaging member includes a cushioning member that holds a holding part of a to-be-packaged member different from a predetermined part of the to-be-packaged member without coming into contact with the predetermined part of the to-be-packaged member. The cushioning member cushions a shock transmitting to the to-be-packaged member, and the packaging member packages the to-be-packaged member via the cushioning member.

6 Claims, 56 Drawing Sheets

(56) References Cited

U.S. PATENT DOCUMENTS

| | | | | |
|---|---|---|---|---|
| 5,941,453 | A * | 8/1999 | Oliff | 229/158 |
| 6,926,196 | B2 * | 8/2005 | Testerman et al. | 229/198.2 |
| 6,983,840 | B2 | 1/2006 | Yamazaki et al. | |
| 7,162,189 | B2 | 1/2007 | Tsuda et al. | |
| 7,334,383 | B2 | 2/2008 | Yamazaki et al. | |
| 2005/0011800 | A1 * | 1/2005 | Messinger | 206/521 |
| 2005/0242164 | A1 * | 11/2005 | Teixidor Casanovas | 229/174 |
| 2010/0050573 | A1 | 3/2010 | Hamilton et al. | |

FOREIGN PATENT DOCUMENTS

| | | |
|---|---|---|
| JP | 3-200566 | 9/1991 |
| JP | 6-286746 | 10/1994 |
| JP | 3060605 | 6/1999 |
| JP | 2004-287404 | 10/2004 |
| JP | 2007-261646 | 10/2007 |
| JP | 2010-70190 | 4/2010 |

* cited by examiner

PACKAGING MEMBER AND PACKAGING METHOD

BACKGROUND OF THE INVENTION

1. Field of the Invention

The present invention relates to a packaging member to be used for packaging a to-be-packaged member and a packaging method for packaging a to-be-packaged member.

2. Description of the Related Art

In the related art, an image forming apparatus is known in which a cylindrical toner container containing toner is detachably provided to an image forming apparatus body, and the toner is supplied to a development unit of the image forming apparatus body from the toner container (see Japanese Laid-Open Patent Application No. 2004-287404).

The toner container includes a container body and a bottle cap. On the face of one end of the container body, an opening having a diameter smaller than the container body is provided. In a state where the edge of the opening is in contact with a sealing member installed at a sealing member installation part provided on a bottle cap, the container body and the bottle cap engage together at an engagement part. Further, as a result of the sealing member being used to seal between the container body and the bottle cap so as to prevent any gap from occurring therebetween, it is possible to prevent the toner from leaking from the inside of the toner container to the outside.

The toner container is transported in a state where it is stored in a packaging box when it is shipped from a factory or so. However, when a shock is given to the packaging box from the outside, for example, as a result of the container box being dropped during the transportation, the shock may transmit to the toner container in the inside of the packaging box, and the toner container may be damaged. Therefore, for example, a pair of cushioning members are installed onto the bottle cap and the container body in such a manner to sandwich the toner container from axial directions of the toner container, the toner container is contained in the packaging box together with the cushioning members in this state, and thus, the cushioning members ease the shock transmitting to the toner container.

However, even when the shock is eased by the cushioning members, the shock given to the container body from the outside may reach the container body or the bottle cap, and a force may be applied to the bottle cap in the axial directions of the toner container such that the bottle cap may be inclined with respect to the container body. When such a force is applied to the bottle cap, the sealing member between the bottle cap and the toner container may be shifted, a gap may be created between the bottle cap and the toner container, and the toner may leak through the gap.

Further, also in a case where a to-be-packaged member to be contained in the packaging box via the cushioning members is other than the toner container, various problems may occur as a result of a shock being given to the packaging box from the outside. For example, even when the packaging box receives a shock from the outside and the shock is eased by the cushioning members, the shock may be transmitted to a predetermined part of the to-be-packaged member such as a place where high accuracy of form is required or a place where a precision member such as an electronic part is installed. If so, the place where high accuracy of form is required may be deformed and the high accuracy of form may not be obtained any more, the precision member may be damaged and may not operate properly, or so.

SUMMARY OF THE INVENTION

According to an embodiment of the present invention, a packaging member includes a cushioning member that holds a holding part of a to-be-packaged member different from a predetermined part of the to-be-packaged member without coming into contact with the predetermined part of the to-be-packaged member. The cushioning member cushions a shock transmitted to the to-be-packaged member, and the packaging member packages the to-be-packaged member via the cushioning member.

Other objects, features and advantages of the present invention will become more apparent from the following detailed description when read in conjunction with the accompanying drawings.

DETAILED DESCRIPTION OF THE EMBODIMENTS

Figure 1A:
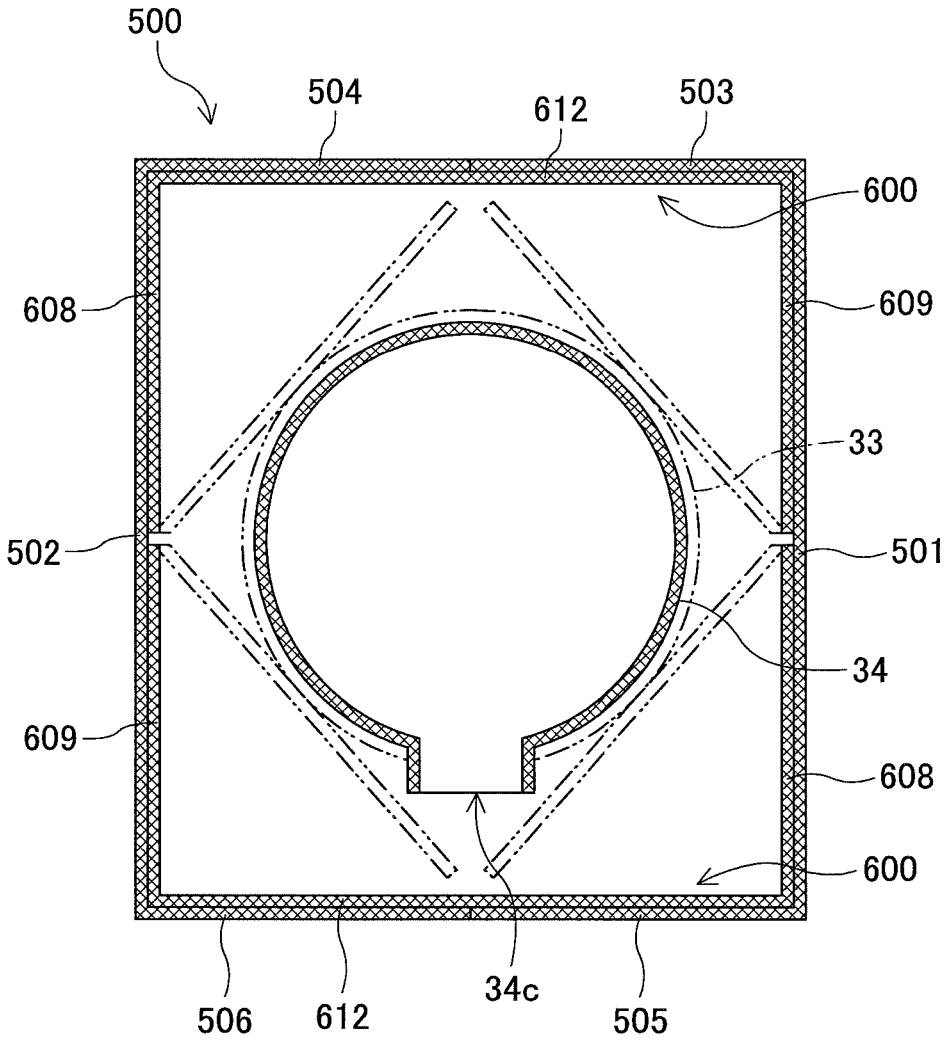
FIG. 1A shows a sectional view taken from cutting, by a cutting line E1-E2 of FIG. 26(*a*), a packaging box according to a configuration example 2 (according to an embodiment of the present invention) in which a toner container is packaged via cushioning members.

In consideration of the above-mentioned problems, an object of embodiments of the present invention is to provide a packaging member and a packaging method by which it is possible to prevent or reduce a shock from directly transmitting to a predetermined part of a to-be-packaged member contained in the packaging member.

According to an embodiment of the present invention, a packaging member includes a cushioning member that holds a holding part of a to-be-packaged member different from a predetermined part of the to-be-packaged member without coming into contact with the predetermined part of the to-be-packaged member. The cushioning member cushions a shock transmitted to the to-be-packaged member, and the packaging member packages the to-be-packaged member via the cushioning member.

In the packaging member a space may be provided, for preventing a most projecting part of the predetermined part of the to-be-packaged member from coming into contact with a wall surface of the packaging member, between the most projecting part of the to-be-packaged member and the wall surface of the packaging member.

The cushioning member may be a hollow member, and the holding part of the to-be-packaged member may be held by the cushioning member in such a manner that a space may be provided between the holding part of the to-be-packaging part and a wall of the packaging member.

The cushioning member may have a rectangular shape to contain the holding part of the to-be-packaged member by four plate-shaped members, and ridge lines on which adjacent segments of the four plate-shaped members intersect. The cushioning member may be in contact with four wall surfaces, i.e., top, bottom and both side faces of the packaging member, respectively.

The ridge lines on which the adjacent segments of the four plate-shaped members intersect, may be approximately at the centers of the four wall surfaces of the top, bottom and both side faces of the packaging member, respectively.

The to-be-packaged member may be a receiving container comprising a container body as the holding part having a containing part that contains the contents and a content outlet; a cap member as the predetermined part to be fitted to the container body to cover the content outlet; and a sealing member to be inserted between the container body and the cap member. The cushioning member may be used to hold the container body in such a manner that the cap member and the cushioning member does not come into contact with one another.

A packaging method according to an embodiment of the present invention is a method of containing and packaging a to-be-packaged member in the inside of a packaging member via a cushioning member. In the packaging method, the cushioning member holds a holding part of the to-be-packaged member; and the to-be-packaged member is contained in the inside of the packaging member in a state where a predetermined part different from the holding part of the to-be-packaged member is suspended in the space inside of the packaging member.

In a case where the to-be-packaged member is a long member, the predetermined part of the to-be-packaged member corresponds to, for example, an end part of a long face, and the holding part corresponds to another part of the long face. In this case, the most projecting part of the predetermined part corresponds to, for example, an end face or a short face of the long member.

According to the embodiment of the present invention, only the holding part of the to-be-packaged member is held by the cushioning member, and the predetermined part of the to-be-packaged member is suspended in the space without coming into contact with the cushioning member. Thereby, even when a shock is given to the packaging member from the outside, it is possible to prevent the shock from directly transmitting from the cushioning member or the packaging member to the predetermined part of the to-be-packaged member.

Therefore, since the shock does not directly transmit to, for example, as in the case the predetermined part, a place where high accuracy of form is required or a place where a precision member such as an electronic part is installed in the to-be-packaged member, it is possible to avoid a problematic situation in which the shape is changed and high accuracy of form can no longer be obtained or in which the precision member is damaged and no longer operates properly.

Further, in another case where the to-be-packaged member is a powder receiving container including a container body as the holding part having a powder containing part containing powder such as toner and a powder outlet; a cap member as the predetermined part to be fitted to the container body to cover the powder outlet; and a sealing member to be inserted between the container body and the cap member, the cushioning member may be used to hold only the container body so that a state is created where the cap member is suspended in the space inside the packaging member without coming into contact with the cushioning member. Thereby, even when a shock is given to the packaging member from the outside, it is possible to prevent the shock from directly transmitting from the cushioning member or the packaging member to the predetermined part of the to-be-packaged member. Therefore, it is possible to prevent such a force that an axial line of the cap member is inclined from the axial line of the container body, from being applied to the cap member. Therefore, it is possible to avoid a situation in which the sealing member inserted between the container body and the cap member is shifted, a gap is created between the container body and the cap member, and the powder leaks through the gap to the outside.

Thus, according to the embodiments of the present invention, it is possible to prevent a shock from directly transmitting to the predetermined part of the to-be-packaged member contained in the inside of the packaging member.

Below, the embodiments of the present invention will be described using figures. It is noted that the same reference numerals are given to the same or corresponding parts, and description thereof are simplified or omitted as it is appropriate.

First, using FIGS. 2 through 5, a configuration and operations of the entirety of an image forming apparatus according to the embodiments will be described.

Figure 2:
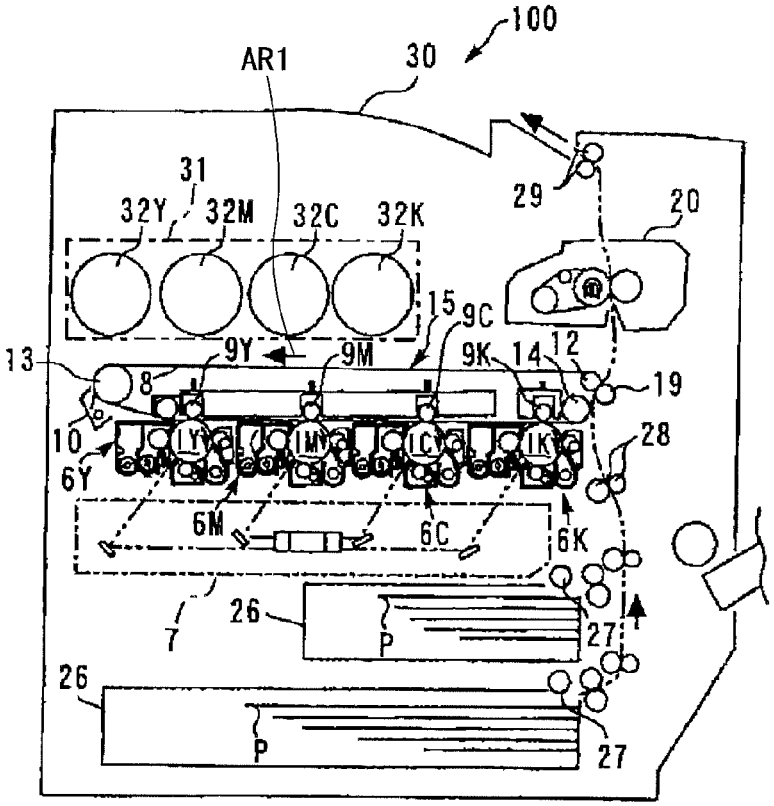
FIG. 2 shows a general configuration of an image forming apparatus according to embodiments of the present invention.
Figure 3:
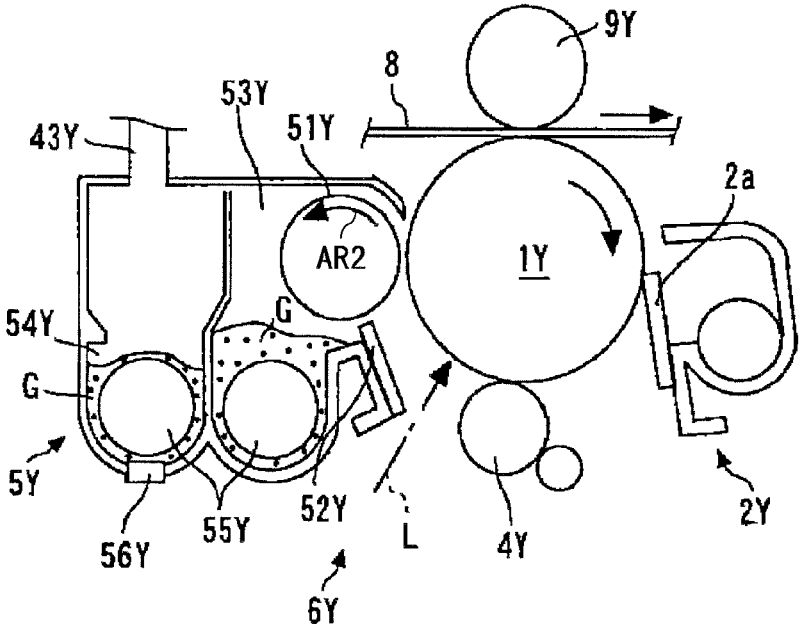
FIG. 3 is a sectional view showing an image forming part of the image forming apparatus shown in FIG. 2.
Figure 4:
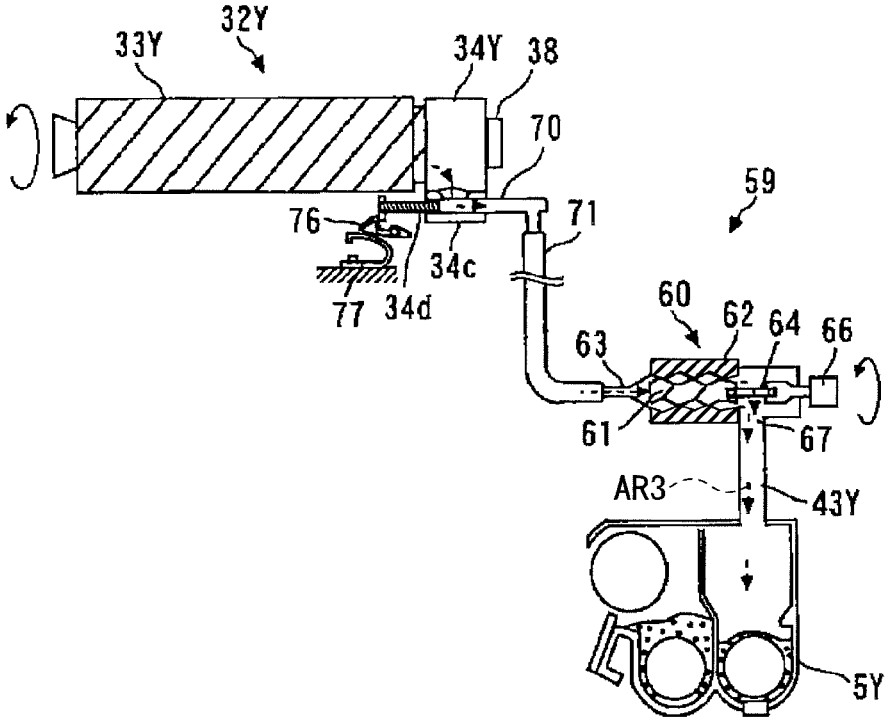
FIG. 4 is a general view showing a toner supply path in the image forming apparatus shown in FIG. 2.
Figure 5:
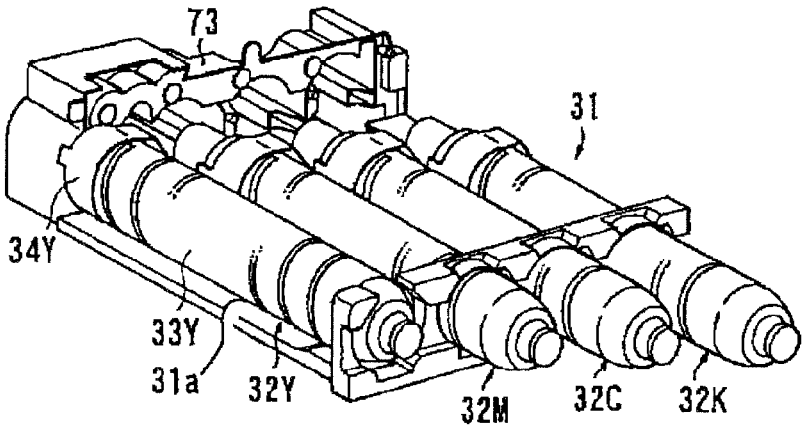
FIG. 5 is a perspective view showing a toner container receiving part in a state where a toner container is installed.

FIG. 2 shows an entire configuration of a printer as the image forming apparatus, FIG. 3 shows an enlarged view of an image forming part of the printer, FIG. 4 is a general view showing a toner supply path in the image forming part, and FIG. 5 is a perspective view showing a part of the toner supply path.

As shown in FIG. 2, in a toner container receiving part 31 at a top part of the image forming apparatus body 100, four toner containers 32Y, 32M, 32C and 30K corresponding to respective colors of yellow (Y), magenta (M), cyan (C) and black (K) are detachably (in a replaceable manner) installed.

Below the toner container receiving part 31, an intermediate transfer unit 15 is disposed. Image forming parts 6Y, 6M, 6C and 6K corresponding to the respective colors of yellow (Y), magenta (M), cyan (C) and black (K) are disposed in parallel to face an intermediate transfer belt 8 of the intermediate transfer unit 15.

As shown in FIG. 3, the image forming part 6Y corresponding to yellow includes a photosensitive drum 1Y, and an electrification part 4Y, a development unit 5Y (development part), a cleaning part 2Y and an electricity removal part (not shown) disposed around the photosensitive drum 1Y. On the photosensitive drum 1Y, an image forming process (including an electrification process; an exposure process; a development process; a transfer process; and a cleaning process) is carried out, and a yellow image is formed on the photosensitive drum 1Y.

It is noted that the other three image forming parts 6M, 6C and 6K have approximately the same configuration as that of the image forming part 6Y corresponding to yellow except that the color of toner is different, and images corresponding to the respective toner colors are formed.

Below, description of the other three image forming parts 6M, 6C and 6K is omitted as it is appropriate, and description of only the image forming part 6Y corresponding to yellow will be described.

As shown in FIG. 3, the photosensitive drum 1Y is rotated clockwise by a driving motor (not shown). At the position of the electrification part 4Y, a part of the surface of the photosensitive drum 1Y is uniformly electrified (the electrification process).

After that, the part of the surface of the photosensitive drum 1Y reaches an illumination position where laser light L emitted by an exposure unit 7 (see FIG. 2) is illuminated, and an electrostatic latent image corresponding to yellow is formed there through an exposure scanning operation (the exposure process).

After that, the part of the surface of the photosensitive drum 1Y reaches a position of facing the development unit 5Y, the electrostatic latent image is developed there, and a toner image of yellow is formed (the development process).

After that, the part of the surface of the photosensitive drum 1Y reaches a position of facing the intermediate transfer belt 8 and a primary transfer bias roller 9Y, and the toner image on the photosensitive drum 1Y is transferred to the intermediate transfer belt 8 (a primary transfer process). At this time, on the photosensitive drum 1Y, not-yet-transferred toner slightly remains.

After that, the position of the surface of the photosensitive drum 1Y reaches a position facing the cleaning part 2Y, and there, the not-yet-transferred toner slightly remaining on the photosensitive drum 1Y, is mechanically collected by a cleaning blade 2*a* (the cleaning process).

Finally, the part of the surface of the photosensitive drum 1Y reaches a position facing the electricity removal part (not shown), and there, the residual electric potential on the photosensitive drum 1Y is removed.

Thus, a series of image forming process carried out on the photosensitive drum 1Y is finished.

It is noted that the above-described image forming process is carried out also in the other image forming parts 6M, 6C and 6K in the same way.

After that, toner images of the respective colors formed on the respective photosensitive drums through the development processes are transferred onto the intermediate transfer belt 8 in a manner that they are superposed on each other. Thus, on the intermediate transfer belt 8, a color image is formed.

As shown in FIG. 2, the intermediate transfer unit 15 includes the intermediate transfer belt 8, the four primary bias rollers 9Y, 9M, 9C and 9K, a secondary transfer backup roller 12, a cleaning backup roller 13, a tension roller 14 and an intermediate transfer cleaning part 10. The intermediate transfer belt 8 is wound on and is supported by, the secondary backup roller 12, the cleaning backup roller 13 and the tension roller 14, and is moved in an endless manner in a direction of an arrow AR1 in FIG. 2 as being driven and rotated by the secondary transfer backup roller 12.

The four primary transfer rollers 9Y, 9M, 9C and 9K form primary transfer nips, respectively, as a result of sandwiching the intermediate transfer belt 8 between the four primary transfer rollers 9Y, 9M, 9C and 9K and the photosensitive drums 1Y, 1M, 1C and 1K, respectively. Then, transfer biases that are reverse the polarities of the toners are applied to the primary transfer rollers 9Y, 9M, 9C and 9K, respectively.

Then, the intermediate transfer belt 8 runs in the direction of the arrow AR1, and a part of the intermediate transfer belt 8 passes through the primary transfer nips of the respective primary transfer rollers 9Y, 9M, 9C and 9K, one by one, in sequence. Thus, the toner images of the respective colors on the photosensitive drums 1Y, 1M, 1C and 1K are primarily transferred to the intermediate transfer belt 8 in a manner that they are superposed with each other.

After that, the part of the intermediate transfer belt 8 on which the toner images of the respective colors have already been transferred and superposed reaches the position facing a secondary transfer roller 19. At this position, a secondary transfer nip is formed as a result of the secondary transfer backup roller 12 and the secondary transfer roller 19 sandwiching the intermediate transfer belt 8. Then, the toner image of the four colors formed on the intermediate transfer belt 8 is transferred to a to-be-transferred-to member P such as a transfer sheet of paper conveyed to the position of the secondary transfer nip. At this time, on the intermediate transfer belt 8, not-yet-transferred toner not having been transferred to the to-be-transferred-to member P remains.

After that, the part of the intermediate transfer belt 8 reaches the position of the intermediate transfer cleaning part 10. Then, at this position, the not-yet-transferred toner on the intermediate transfer belt 8 is collected.

Thus, a series or transfer processes carried out on the intermediate transfer belt 8 is finished.

It is noted that the to-be-transferred-to member P conveyed to the position of the secondary transfer nip is one conveyed from a paper supply part 26 disposed at a bottom part of the image forming apparatus body 100, via a paper supply roller 27 and a registration roller pair 28.

After that, the to-be-transferred-to member P to which the color image has been transferred at the position of the secondary transfer nip is conveyed to the position of a fixing part 20. Then, at this position, by means of heat and pressure given by a fixing roller and a pressing roller, the color image transferred to the surface of the to-be-transferred-to member P is fixed to the to-be-transferred-to member P.

After that, the to-be-transferred-to member P passes through between rollers of a paper ejection roller pair 29, and is ejected to the outside of the apparatus. The to-be-transferred-to member P thus ejected to the outside of the apparatus by the paper ejection roller pair 29 is stacked onto a stack part 30 as an output image, in sequence.

Thus, a series of image forming processes in the image forming apparatus is finished.

Next, using FIG. 3, a configuration and operations of the development unit in the image forming part will be described in more detail.

The development unit 5Y includes a development roller 51Y facing the photosensitive drum 1Y, a doctor blade 52Y facing the development roller 51Y, two conveyance screws 55Y disposed in developer containing parts 53Y, 54Y and a concentration detection sensor 56Y detecting toner concentration in the developer. The development roller 51Y includes a magnet fixed in the inside and a sleeve rotating around the magnet. In the developer containing parts 53Y, 54Y, the binary developer G including carrier and toner is contained. The developer containing part 54Y communicates with a toner conveyance pipe 43Y via an opening formed at a top part of the developer containing part 54Y.

The development unit 5Y configured as described above operates as follows:

The sleeve of the development roller 51Y is rotated in a direction of an arrow AR2 in FIG. 3. Then, the binary developer G carried on the development roller 51Y by means of a magnetic field generated by the magnet moves on the development roller 51Y as the sleeve is rotated.

It is noted that the ratio of the toner (toner concentration) in the developer is adjusted to fall within a predetermined range. In detail, in response to toner consumption in the development unit 5Y, the toner contained in the toner container 32Y is supplied to the developer containing part 54Y via a toner supply unit 59 (see FIG. 4).

After that, the toner supplied to the developer containing part 54Y is mixed and stirred together with the binary developer G by the two conveyance screws 55Y, and is circulated in the two developer containing parts 53Y and 54Y (including movements in directions perpendicular to FIG. 3). Then, the toner in the binary developer G is attracted by the carrier by means of frictional electrification between the toner and the carrier, and is carried on the development roller 51Y together with the carrier by means of magnetic force created on the development roller 51Y.

The binary developer G carried on the development roller 51Y is conveyed in the direction of the arrow AR2, and reaches a position of the doctor blade 52Y. Then, after the amount of the binary developer G on the development roller 51Y is controlled to be an appropriate amount, the binary developer G is conveyed to the position (development area) facing the photosensitive drum 1Y. Then, by means of an electric field created at the development area, the toner is attracted by the latent image formed on the photosensitive drum 1Y. After that, the binary developer G remaining on the development roller 51Y reaches a position above the developer containing part 53Y as the sleeve is rotated, and at this position, is removed from the development roller 51Y.

Next, using FIG. 4, the toner supply unit 59 introducing the toner contained in the toner container 32Y into the development unit 5Y will be described in detail.

It is noted that for the purpose of easy understanding, in FIG. 4, the direction of the arrangement of the toner container 32Y, the toner conveyance pipe 43Y, a screw pump 60, a nozzle 70, a tube 71 and the development unit 5Y is changed. Actually, in FIG. 4 a part of the toner supply path including the toner conveyance pipe 43Y, the screw pump 60, the nozzle 70 and the tube 71, and, the longitudinal direction of the toner container 32Y, are perpendicular to FIG. 4 (see FIG. 2).

Figure 9:
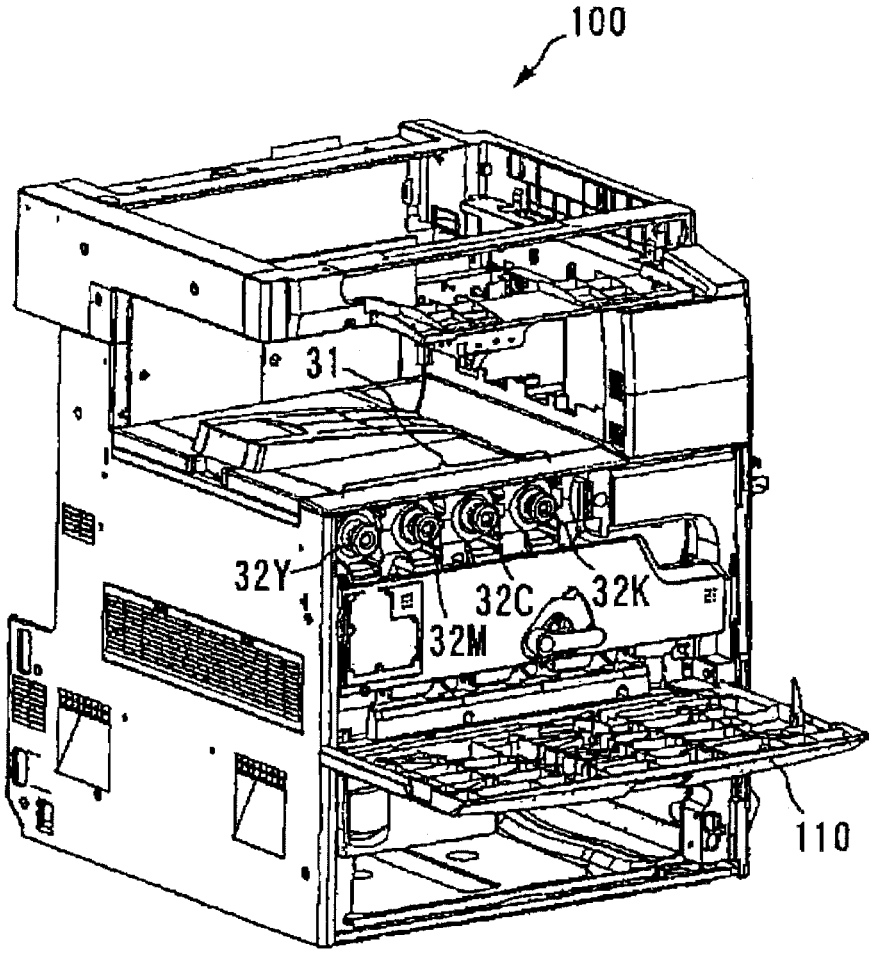
FIG. 9 is a perspective view showing a state where a body door is opened in the image forming apparatus.

As shown in FIGS. 5 and 9, the toners in the respective toner containers 32Y, 32M, 32C and 32K installed in the toner container receiving part 31 of the image forming apparatus body 100 are supplied to the respective development units appropriately through the toner supply paths provided for the respective toner colors, in response to toner consumptions in the development units of the respective colors. The four toner supply paths have approximately the same structures except that the colors of the toners used in the image forming processes are different.

In detail, as shown in FIG. 4, when the toner container 32Y is set in the toner container receiving part 31 of the image forming apparatus body 100, the nozzle 70 of the toner container receiving part 31 is connected to the bottle cap 34Y of the toner container 32Y. At this time, a plugging member (opening/closing member) 34*d* of the toner container 32Y opens a toner outlet of the bottle cap 34Y in a state of being inserted between a claw member 76 pressed by a leaf spring 77 and the nozzle 70. Thereby, the toner contained in a container body 33Y of the toner container 32Y is conveyed into the nozzle 70 via the toner outlet.

On the other hand, the other end of the nozzle 70 is connected to one end of the tube 71 as a conveyance pipe. The tube 71 is made of a flexible material excellent at toner resistance, and the other end thereof is connected to the screw pump 60 (Mohno Pump) of the toner supply unit.

The screw pump 60 is a suction-type single-axis eccentric screw pump, and includes a rotor 61, a stator 62, a suction port 63, a universal joint 64 and a motor 66. The rotor 61, the stator 62 and the universal joint 64 are contained in a case (not shown). The stator 62 is a female screw like member made of an elastic material such as a rubber, and a helical groove of double pitch is formed on the inner surface. The rotor 61 is a male screw like member made of a rigid material such as a metal having an axis which is twisted spirally, and is inserted into the stator rotatably. One end of the rotor 61 is connected to the motor 66 via the universal joint 64.

In the screw pump 60 configured as described above, the rotor 61 in the stator 62 is driven and rotated in a predetermined direction (counterclockwise viewed from the upstream side of the toner conveyance direction), and thereby, a suction force is created at a suction port 63 (negative pressure is created in the tube 71 as a result of air being suctioned from the tube 71). Thereby, the toner in the toner container 32Y is suctioned to the suction port 63 via the tube 71 together with air. The toner thus suctioned to the suction port 63 is supplied to the space between the stator 62 and the rotor 61, and is supplied to the other end as the rotor 61 is rotated. The supplied toner is ejected from a supply outlet 67 of the screw pump 60, and is supplied into the development unit 5Y via the toner conveyance pipe 43Y (a movement in a direction of arrows AR3).

Next, using FIGS. 6 and 7, the toner container will be described.

As described above using FIGS. 2 and 5, the four approximately cylindrical toner containers 32Y, 32M, 32C and 32K (toner bottles) are detachably installed in the toner container receiving part 31. The toner containers 32Y, 32M, 32C and 32K are replaced by new ones when they have come to the end of their lives, i.e., almost all of the contained toners have been consumed, for example. The toners of the respective colors contained in the toner containers 32Y, 32M, 32C and 32K are supplied to the development units of the respective image forming parts 6Y, 6M, 6C and 6K through the toner supply paths described above using FIG. 4 as is necessary.

Figure 6:
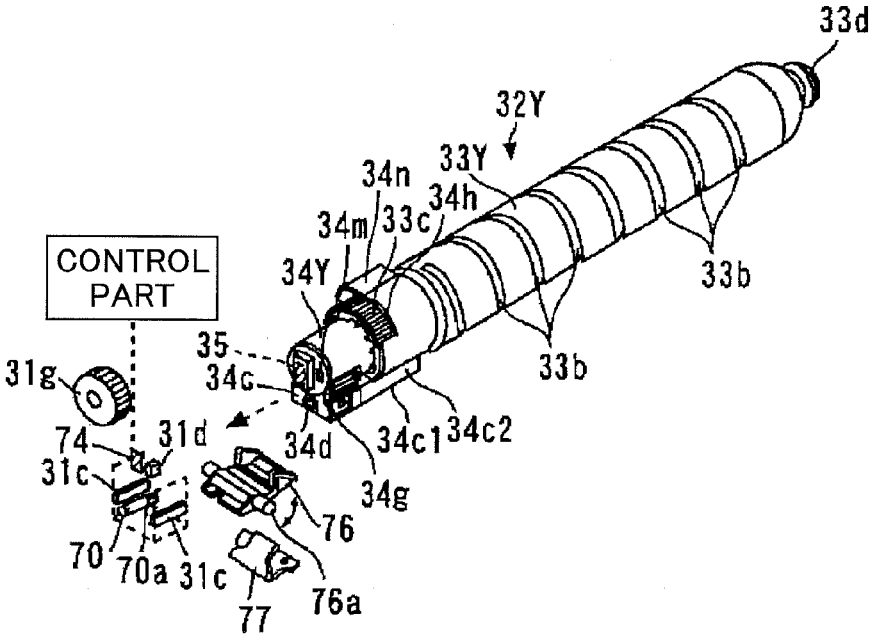
FIG. 6 is a general perspective view showing the toner container in a state of being installed in the toner container receiving part.

FIG. 6 is a general perspective view showing the toner container 32Y. FIG. 7 is a sectional view showing a side of a head part (i.e., a part at which the bottle cap 34Y is installed) of the toner container 32Y.

It is noted that the other three toner containers 32M, 32C and 32K have approximately the same configuration as that of the toner container 32Y except that the colors of the contained toners are different and the positions of a depression part 34*m* and a projection part 34*n* are different. Below, description of the other three toner containers 32M, 32C and 32K will be omitted as it is appropriate, and only the toner container 32Y containing the yellow toner will be described.

As shown in FIG. 6, the toner container 32Y includes mainly the container body 33Y containing the toner and the bottle cap 34Y provided at the head part of the container body 33Y.

Figure 7:
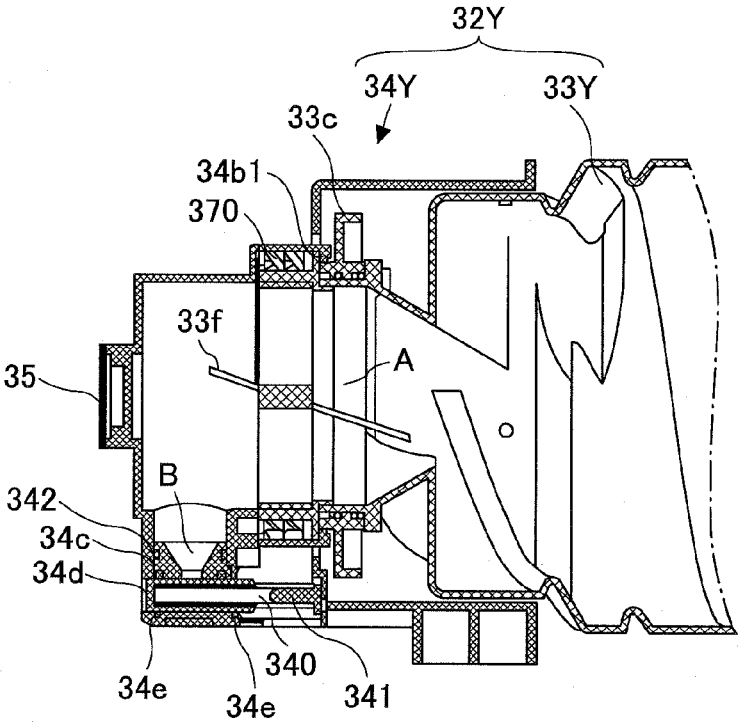
FIG. 7 is a sectional view showing a head part of the toner container.

At the head part of the container body 33Y, a gear part 33*c* which is rotated together with the container body 33Y integrally and an opening A are provided (see FIG. 7). The opening A is provided at the head part (i.e., the front position when the toner container 32Y is loaded) of the container body 33Y, and is used to eject the toner contained in the container body 33Y toward a space (hollow) in the bottle cap 34Y.

The gear part 33*c* (gear) engages with a driving gear 31*g* of a driving part provided to the toner container receiving part 31 of the image forming apparatus body 100, transmits a rotation driving force to the container body 33Y, and drives and rotates the container body 33Y about a rotation axis. In detail, a part of the gear part 33*c* is exposed through a cut out part 34*h* formed on the bottle cap 34Y, and engages with the driving gear 31*g* of the image forming apparatus body 100. Then, the rotation driving force is transmitted from the driving gear 31*g* to the gear part 33*c*, and the container body 33Y is rotated in a predetermined direction.

As shown in FIG. 6, at a rear end part (bottom part) of the container body 33Y, a gripping part 33*d* used by the user to grip when the user loads or removes the toner container 32Y is provided.

Further, on an inner circumferential surface of the container body 33Y, a spiral projection 33*b* is provided (appearing as a spiral groove when viewed from the outer circumferential side). The spiral projection 33*b* is used for ejecting the toner through the opening A by driving and rotating the toner container 33Y in the predetermined direction. The container body 33Y configured as described above may be produced by means of blow molding (except for the gear part 33*c*).

It is noted that in the toner container 32Y, a stirring member 33*f* which is rotated together with the container body 33Y is installed in the opening A. The stirring member 33*f* is a rod-shaped member that extends toward the inside of the container body 33Y from the space in the inside of the bottle cap 34Y, and is disposed obliquely with respect to the rotation axis of the container body 33Y. As a result of the stirring member 33*f* being rotated together with the container body 33Y, the performance of ejecting the toner from the opening A is improved.

Further, according to the embodiments, the container body 33Y of the toner container 32Y is rotated counterclockwise viewed from the upstream side of the toner conveyance direction. Further, the spiral direction (winding direction) of the spiral projection 33*b* in the container body 33Y is set clockwise. Thereby, as a result of the rotation of the container body 33Y, a vortex air flow of the clockwise direction the same as the rotation direction of created in the screw pump 60 is created in the toner container 32Y.

As shown in FIGS. 6 and 7, in the bottle cap 34Y, a holder 34*c*, the plugging member 34*d* (shutter) as the opening/closing member, packing 34*e* and an IC chip 35 as an electronic part are installed. Further, as shown in FIG. 6, on both side faces of the bottle cap 34Y, engagement parts 34*g* (grooves) which the positioning members 31*c* of the toner container receiving part 31 engage with are provided. Further, on an end face of the bottle cap 34Y, the depression part 34*m* into which a fitting member 31*d* of the toner container receiving part 31 is fitted is provided. Further, on a circumferential surface of the bottle cap 34Y, the projection part 34*n* is provided which another fitting member (not shown) of the toner container receiving part 31 is fitted to. Further, the cut out part 34*h* through which the part of the gear part 33*c* is exposed is provided at a top part of the bottle cap 34Y.

The bottle cap 34Y communicates with the container body 33Y through the opening A and ejects the toner from the opening A, through the toner outlet B (see FIG. 7).

It is noted that according to the embodiments, the space (hollow) formed in the inside of the bottle cap 34 has an approximately cylindrical shape. Further, a toner ejection path (vertical path) from the cylindrical space formed in the inside of the bottle cap 34Y to the toner outlet B has a conical shape. Thereby, the vortex air flow created in the inside of the container body 33Y through the rotation of the container body 33Y is maintained without disappearing, and is transferred toward the toner outlet B efficiently. Therefore, conveyance performance of the toner ejected from the toner outlet B and moving through the tube 71 is improved.

The bottle cap 34Y is not rotated together with the rotation of the container body 33Y, and is held by a holding part 73 of the toner container receiving part 31 without being rotated in a state where the engagement parts 34*g* engage with the positioning members 31*c*.

A claw 34*b*1 is provided to the bottle cap 34Y (see FIG. 7), and as a result of the claw 34*b*1 engaging with an engagement member formed at the head part of the container body 33Y (the gear part 33*c*), the container body 33Y is held rotatably with respect to the bottle cap 34Y relatively. It is noted that in order that the rotation driving of the container body 33Y is carried out smoothly, the claw 34*b*1 of the bottle cap 34Y and the engagement member of the container body 33Y engage with one another with an adequate clearance provided therebetween.

Figure 8:
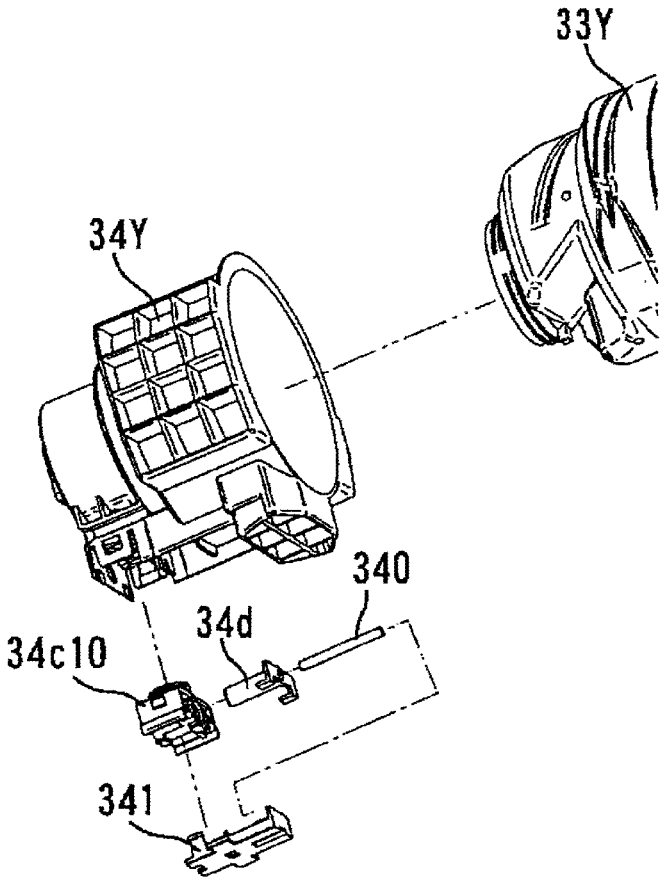
FIG. 8 is an exploded perspective view showing a holder of the toner container.

Further, at a bottom part of the bottle cap 34Y, the holder 34*c* is provided. In the holder 34*c*, the plugging member 34*d* (shutter) acts as the opening/closing member, opening and closing the toner outlet B in response to an operation of loading or removing the toner container 32Y, is installed. In more detail, as shown in FIGS. 7 and 8, the detachable holder 34*c* installed to the bottle cap 34Y includes a holder main part 34*c*10, a holder cover 341, the plugging member 34*d*, and a compression spring 340 as a pressing member. In the holder main part 34*c*10, the toner outlet, and a through hole, communicating with the toner outlet and to which the nozzle 70 is inserted, are formed. The plugging member 34*d* is inserted into the through hole. Further, in a state where the compression spring 340 is inserted from the rear part of the plugging member 34*d*, the holder main part 34*c*10, the plugging member 34*d* and the compression spring 340 are held to the bottle cap 34Y by means of the holder cover 341. The holder main part 34*c*10 is installed to the bottle cap 34Y via an O-ring 342, and thereby, it is possible to prevent the toner from scattering from the outer circumferential surface of the holder main part 34*c*10.

As shown in FIG. 7, in the plugging member 34*d*, a blind hole is formed to guide a part of the compression spring 340. Thereby, buckling of the compression spring 340 is avoided.

As described above, in the toner container 32Y according to the embodiments, the compression spring 340 pressing the plugging member 34*d* in a direction of closing the toner outlet is installed. Therefore, the toner outlet is positively closed by the plugging member 34*d* even in a state where the toner container 32Y exists alone without being installed in the image forming apparatus body 100. Therefore, it is possible to positively prevent the toner from scattering.

Further, as shown in FIG. 7, two sets of packing 370, i.e., G-seal, and the like, as sealing members are provided in parallel in order to seal a space between the opposite surfaces of the container body 33Y and the bottle cap 34Y around the opening A in the toner container 32Y according to the embodiments.

It is noted that the packing 370, such as G-seal, is such that even when the container body 33Y is assembled eccentrically or is driven and rotated eccentrically with respect to the bottle cap 34Y, lip parts (rubber parts) are deformed to follow a movement of the container body 33Y, and also, a permanent strain due to aging appears a little. Therefore, the sealing performance between the container body 33Y and the bottle cap 34Y is stably improved. Especially, according to the embodiments, since the plural sets of packing 370 are installed, the advantageous effect is further improved.

Below, operations of loading and removing (loading/removing operations) the toner container 32Y into and from the toner container receiving part 31 will be simply described.

As shown in FIG. 9, in a case where the toner container 32Y is loaded into the toner container receiving part 31 of the image forming apparatus body 100, first a body cover 110 provided on a front face of the image forming apparatus body 100 is opened, and the toner container receiving part 31 is exposed to the front side.

After that, the toner container 32Y is pressed into the inside of the toner container receiving part 31. That is, the toner container 32Y is loaded into the toner container receiving part 31 along with the longitudinal direction of the container body 33Y (toner container 32Y) in such a manner that the bottle cap 34Y is positioned at the front position with respect to the container body 33Y.

At this time, while a first sliding part 34*c*1 (see FIG. 6) is sliding on a slide fit surface of the toner container receiving part 31 at the front position of the toner container 32Y, the toner container 32Y is pressed into the inside of the toner container receiving part 31 by the user who grips the gripping part 33*d* at the rear end part of the toner container 32Y, in a well-balanced manner, After that, when the holder 34*c* of the toner container 32Y reaches the holding part 73 of the toner container receiving part 31 (see FIG. 5), positioning of the bottle cap 34Y is started while in addition to the sliding operation of the first sliding part 34*c*1, a second sliding part 34*c*2 is sliding on a slide fit surface (side surface). In more detail, engagement between the engagement parts 34*g* of the bottle cap 34Y and the positioning members 31*c* of the toner container receiving part 31 is started. At this time, by means of an arm pair (not shown), the bottle cap 34Y of the toner container 32Y is pressed toward the holding part 73.

Further, at this time, the claw member 76 (see FIGS. 4 and 6) installed at the holding part 73 of the toner container receiving part 31 is rotated about a rotation shaft 76*a* to retreat to a position to avoid obstructing the loading of the bottle cap 34Y. That is, the claw member 76 is pressed downward in a direction to move against the pressing force of the leaf spring 77 by means of the first sliding part 34*c*1.

After that, when the operation to load the toner container 32Y is further proceeded with, opening of the toner outlet B is started by the plugging member 34*d* in a state where the engagement parts 34*g* and the positioning members 31*c* engage with each other. That is, along with the front end of the nozzle 70 being inserted into a hole of the holder 34*c* (see FIG. 4), the plugging member 34*d* is pressed and moved by the nozzle 70.

At this time, the claw member 76 is rotated about the rotation shaft 76*a*, and projects from the above-described retreating position to a position to engage with the plugging member 34*d*. That is, the claw member 76 becomes free from being pressed and moved by the first sliding part 34*c*1, and is pressed upward to the default position by the pressing force of the leaf spring 77.

At this time, the plugging member 34*d* is sandwiched by the nozzle 70 and the claw member 76 (see FIG. 4), and is in a state where the position in the toner container receiving part 31 (the holding part 73) is fixed. Then, when the toner container 32Y is further moved in the loading direction from the state, the toner outlet B is opened in the state where the position of the plugging member 34*d* is fixed.

Then, the position of the bottle cap 34Y is fixed at a position (abutting reference position) where the holder 34*c* comes into contact with the holding part 73. Further, at the same time, the plugging member 34*d* completely opens the toner outlet B, and also, the driving gear 31*g* of the driving part of the toner container receiving part 31 engages with the gear part 33*c* of the toner container 32Y (see FIG. 6). Further, the IC chip 35 faces a communication circuit 74 at a position where radio communication can be carried out therebetween. Further, the depression part 34*m* and the projection part 34*n* for ensuring non-interchangeability of the toner container are fitted to the fitting members of the image forming apparatus body 100. Then, the toner outlet B of the toner container 32Y communicates with a toner supply port 70*a* of the nozzle 70, and thus, the operations of loading the toner container 32Y are completed.

On the other hand, in a case where the toner container 32Y is removed from the toner container receiving part 31 of the image forming apparatus body 100, operations are carried out in procedures reverse to those at the time of loading described above.

First, the in response to an operation of the toner container 32Y being removed from the holding part 73 (removing operation), the plugging member 34*d* is pressed by the claw member 76 and the toner outlet B is closed, in a state where the position of the plugging member 34*d* in the holding part 73 is fixed by the nozzle 70 and the claw member 76. At this time, an end face of the plugging member 34*d* is fitted to the fitting part formed in the bottle cap 34Y, and the closing of the toner outlet B by the plugging member 34*d* is completed. After that, when the toner container 32Y is further moved in the removing direction, the claw member 76 is moved to a position of not preventing the removal of the bottle cap 34Y. Then, after the bottle cap 34Y is completely removed, the claw member 76 becomes free from being pressed and moved by the first sliding part 32*c*1, and is returned to the default position by the pressing force of the leaf spring 77.

There is a likelihood that toner container 32 (i.e., any one of the toner containers 32Y, 32C, 32M and 32K) used in the image forming apparatus according to the embodiments is dropped in any direction (any position/attitude) during a process of physical distribution, and therefore, the toner container 32 is contained in a box as a packaging member via a cushioning member(s) to hold the toner container 32.

Below, a packaging box that is a packaging member by which it is possible to package the toner container 32 as a cylindrical toner bottle in the inside of the packaging box will be described.

Configuration Example 1

Figure 10:
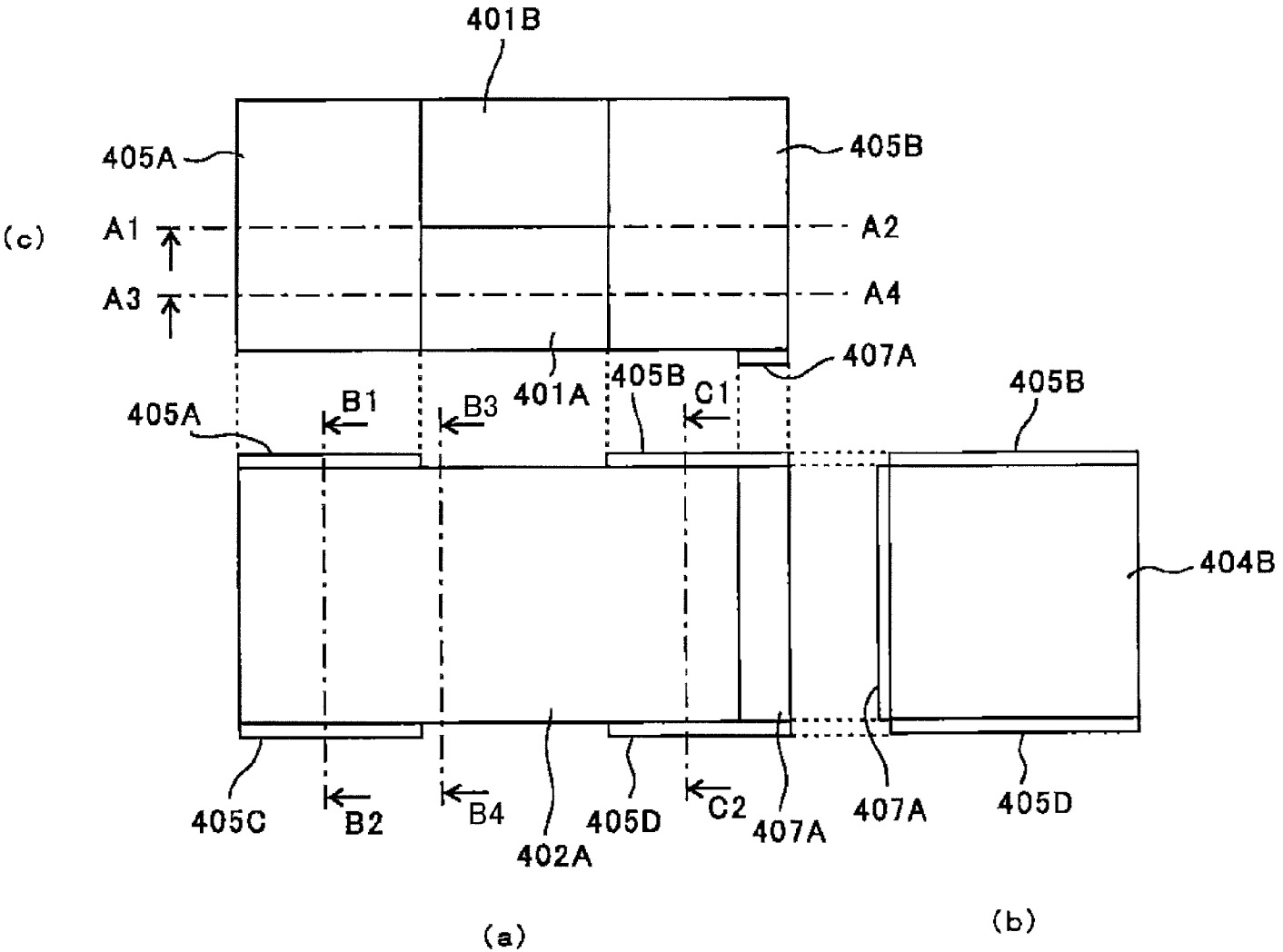
FIG. 10(*a*) shows a front view of a packaging box according to a configuration example 1 (according to an embodiment of the present invention), (*b*) shows a side view of the packaging box according to the configuration example 1, and (*c*) shows a plan view of the packaging box according to the configuration example 1.

FIG. 10(*a*) shows a front view of a packaging box 400 according to a configuration example 1 (according to an embodiment of the present invention) where a box and cushioning members are integrated into one piece. FIG. 10(*b*) shows a side view of the packaging box 400, and FIG. 10(*c*) shows a plan view of the packaging box 400.

Figure 11:
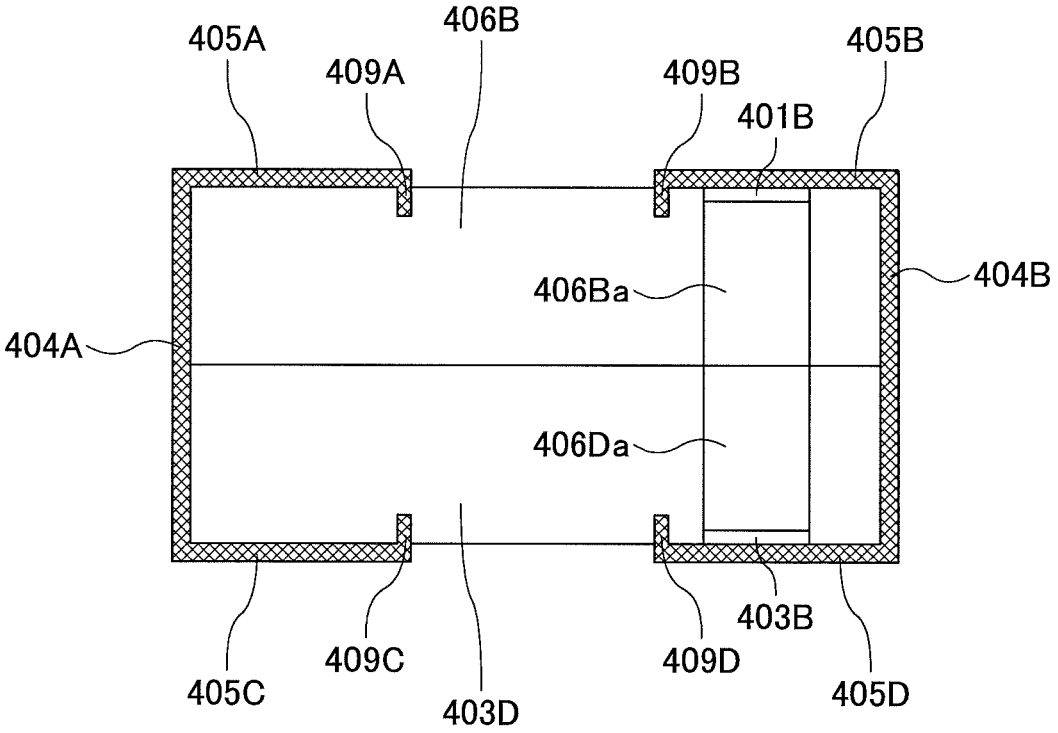
FIG. 11 is a sectional view taken from cutting, by a cutting line A1-A2 in FIG. 10(*c*), the packaging box in which the toner container is not packaged.
Figure 12:
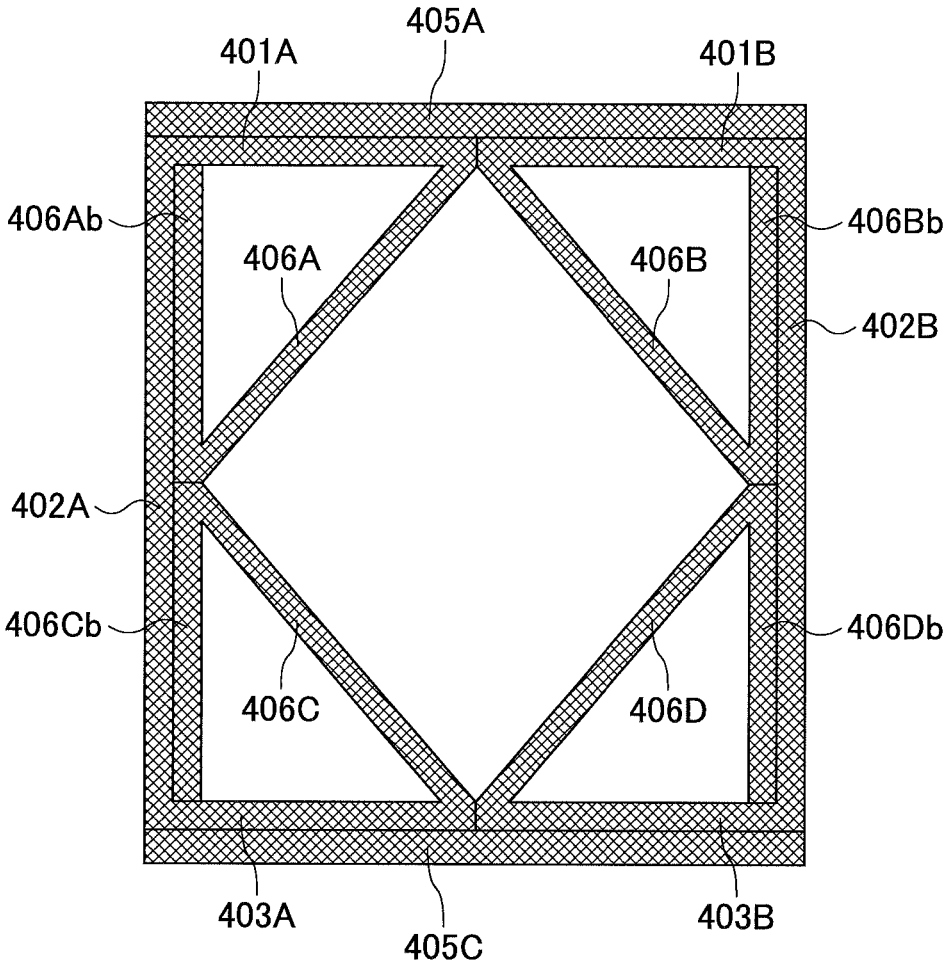
FIG. 12 is a sectional view taken from cutting, by a cutting line B1-B2 in FIG. 10(*a*), the packaging box in which the toner container is not packaged.
Figure 13:
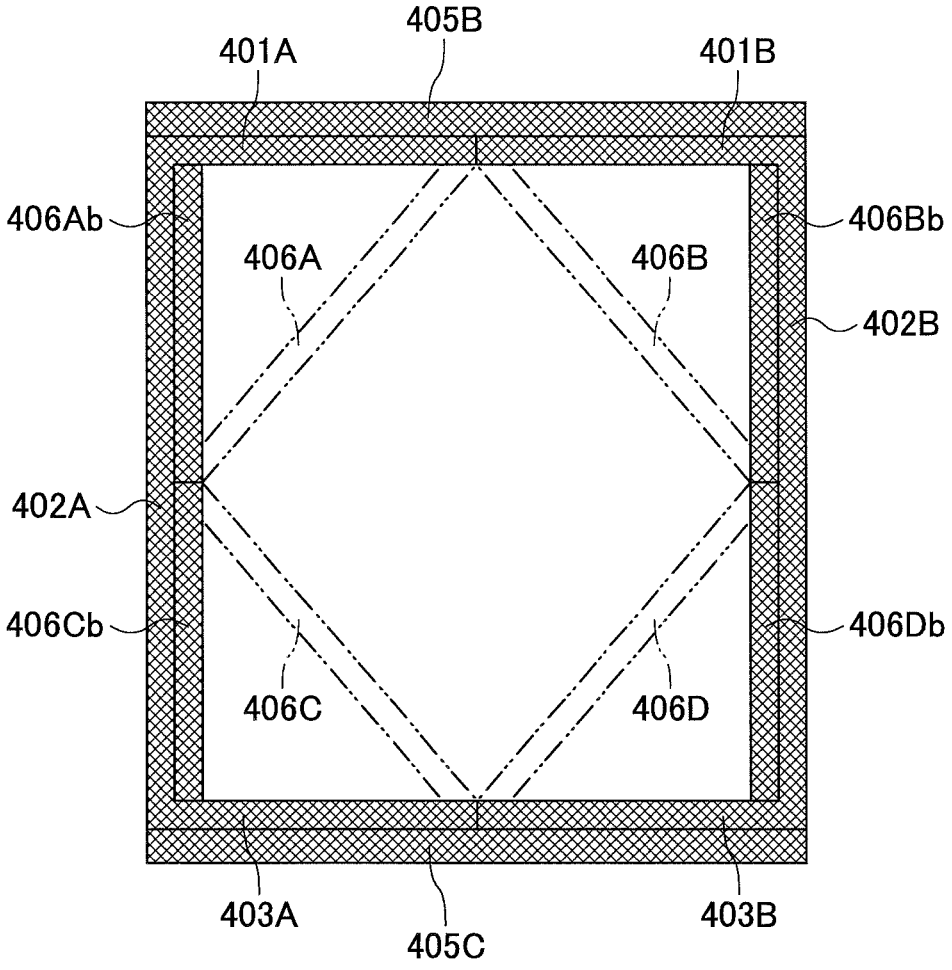
FIG. 13 is a sectional view taken from cutting, by a cutting line C1-C2 in FIG. 10(*a*), the packaging box in which the toner container is not packaged.
Figure 14:
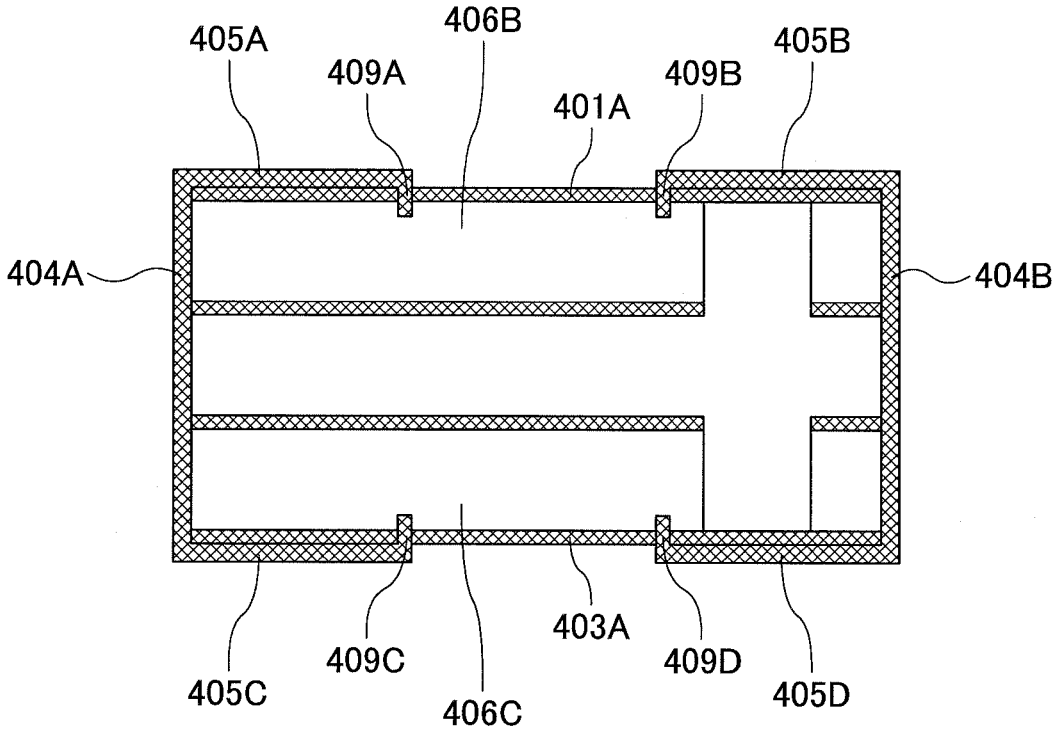
FIG. 14 is a sectional view taken from cutting, by a cutting line A3-A4 in FIG. 10(*c*), the packaging box in which the toner container is not packaged.

Further, FIG. 11 is a sectional view taken from cutting, by a cutting line A1-A2 in FIG. 10(*c*), the packaging box 400 in which a toner container 32 is not packaged. FIG. 12 is a sectional view taken from cutting, by a cutting line B1-B2 in FIG. 10(*a*), the packaging box 400 in which the toner container 32 is not packaged. FIG. 13 is a sectional view taken from cutting, by a cutting line C1-C2 in FIG. 10(*a*), the packaging box 400 in which the toner container 32 is not packaged. FIG. 14 is a sectional view taken from cutting, by a cutting line A3-A4 in FIG. 10(*c*), the packaging box 400 in which the tone container 32 is not packaged.

A method of fabricating the packaging box 400 will now be described.

Figure 15:
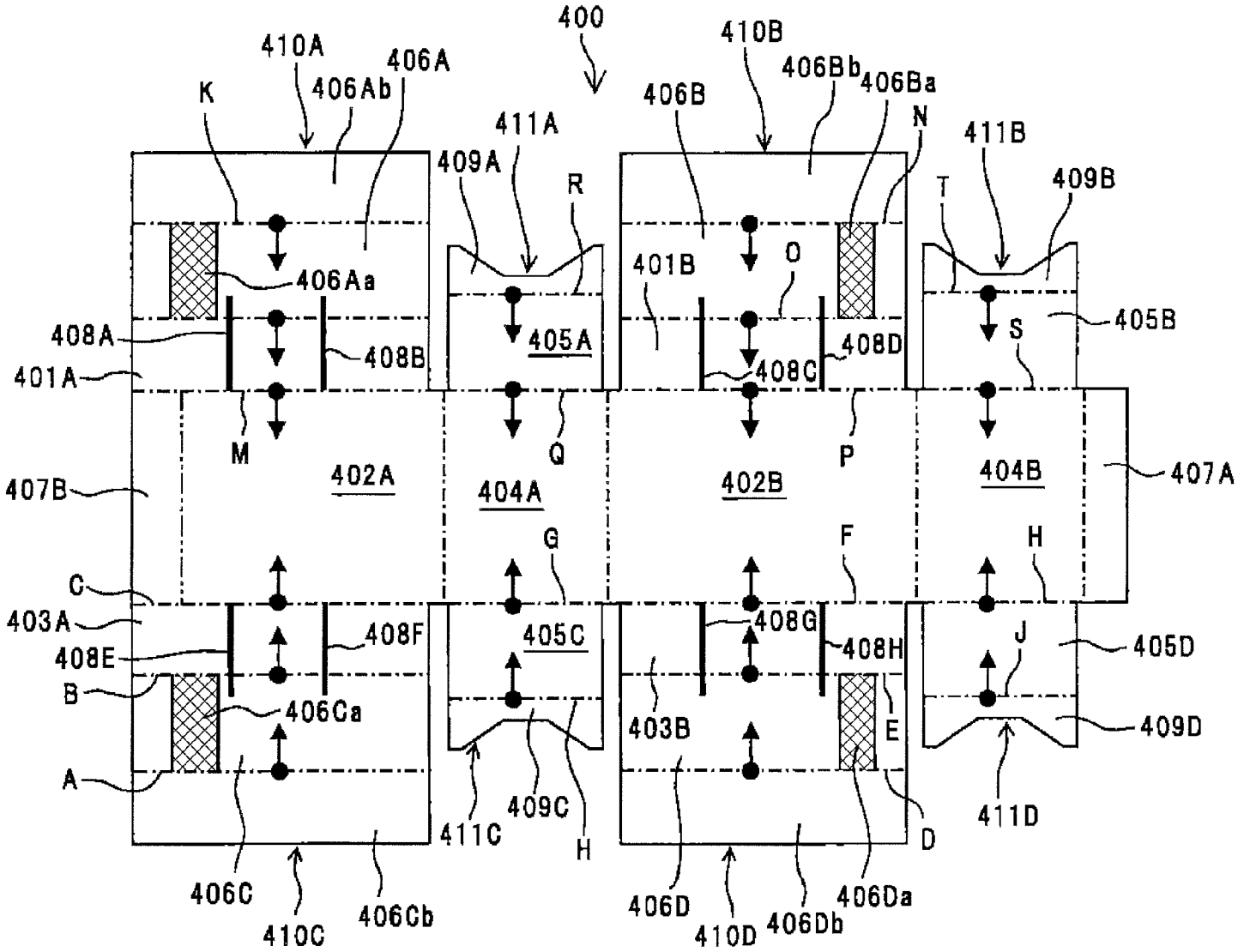
FIG. 15 is a development of the packaging box with cushioning members function according to the configuration example 1.

FIG. 15 is a development of the packaging box 400. A material of the packaging box 400 used in the configuration example 1 is corrugated paper, and is so-called A-type corrugated paper. A material of the corrugated paper is (220/150/220) BF, and a shape shown in FIG. 15 is cut out. Then, the cut-out corrugated paper is cut along the bold solid lines to form cuts, and is folded to form creases along the alternate long and short dashed lines. It is noted that it is not necessary to be limited to the above-mentioned material of the corrugated paper, and instead, a sheet having elasticity such as a plastic corrugated paper, a pasteboard, a plastic sheet, a plastic foamed sheet and the like may be used, for example. In FIG. 15, arrows indicate directions of folding.

When the packaging box 400 is formed by folding the corrugated paper, upper flaps 410A and 410B and lower flaps 410C and 410D are formed to side face parts 402A and 402B that are side face parts facing one another from among four side face parts, i.e., the side face part 402A, an end face part 404A, the side face part 402B and an end face part 404B. The upper flaps 410A and 410B form a top opening of the packaging box 400 and act as a top face and cushioning members. The lower flaps 410C and 410D form a bottom opening of the packaging box 400 and act as a bottom face and cushioning members. Further, an upper flap 411A to be positioned outside of the upper flaps 410A and 410B and a lower flap 411C to be positioned outside of the lower flaps 410C and 410D are formed to the end face part 404A from among the end face parts 404A and 404B that are the other side face parts facing one another. Further, an upper flap 411B to be positioned outside of the upper flaps 410A and 410B and a lower flap 411D to be positioned outside of the lower flaps 410C and 410D are formed to the end face part 404B.

Cuts are provided between the upper flaps 410A, 410B, lower flaps 410C, 410D and the upper flaps 411A, 411B, lower flaps 411C, 411D, and a tab for sticking 407A is provided to the rear end of the end face part 404B. The tab for sticking 407A is used for connecting to a tab for sticking 407B provided to the front end of the side face part 402A, by bonding together by using an adhesive such as a paste, when the packaging box 400 is formed as a result of folding inside the four side face parts, i.e., the side face part 402A, the end face part 404A, the side face part 402B and the end face part 404B in sequence. It is noted that the alternate long and two short dashed line in FIG. 15 indicates a boundary between the side face part 402A and the tab for sticking 407B.

<Procedure 1>

First, the side face section of the packaging box 400 is formed by folding inside the side face part 402A, end face part 404A, side face part 402B and end face part 404B in sequence and bonding together the tag for sticking 407A and tag for sticking 407B using a paste.

<Procedure 2>

Next, in order to form a triangle by a bottom face part 403A, a lower cushioning wall part 406C and a lower cushioning wall support part 406Cb of the lower flap 410C, the bottom face part 403A, lower cushioning wall part 406C and lower cushioning wall support part 406Cb are folded inside in a manner of a valley fold at creases A, B and C shown in FIG. 15. Thus, a bottom part at one side of the packaging box 400 is formed by the lower flap 410C. It is noted that it is preferable that the angle formed between the bottom face part 403A and the lower cushioning wall part 406C of the triangle formed by the bottom face part 403A, the lower cushioning wall part 406C and the lower cushioning wall support part 406Cb is 45°.

<Procedure 3>

The same as the procedure 1 described above, in order to form a triangle by a bottom face part 403B, a lower cushioning wall part 406D and a lower cushioning wall support part 406Db of the lower flap 410D, the bottom face part 403B, lower cushioning wall part 406D and lower cushioning wall support part 406Db are folded inside in a manner of a valley fold at creases D, E and F shown in FIG. 15. Thus, a bottom part at the other side of the packaging box 400 is formed by the lower flap 410D. It is noted that it is preferable that the angle formed between the bottom face part 403B and the lower cushioning wall part 406D of the triangle formed by the bottom face part 403B, the lower cushioning wall part 406D and the lower cushioning wall support part 406Db is 45°.

<Procedure 4>

Figure 16:
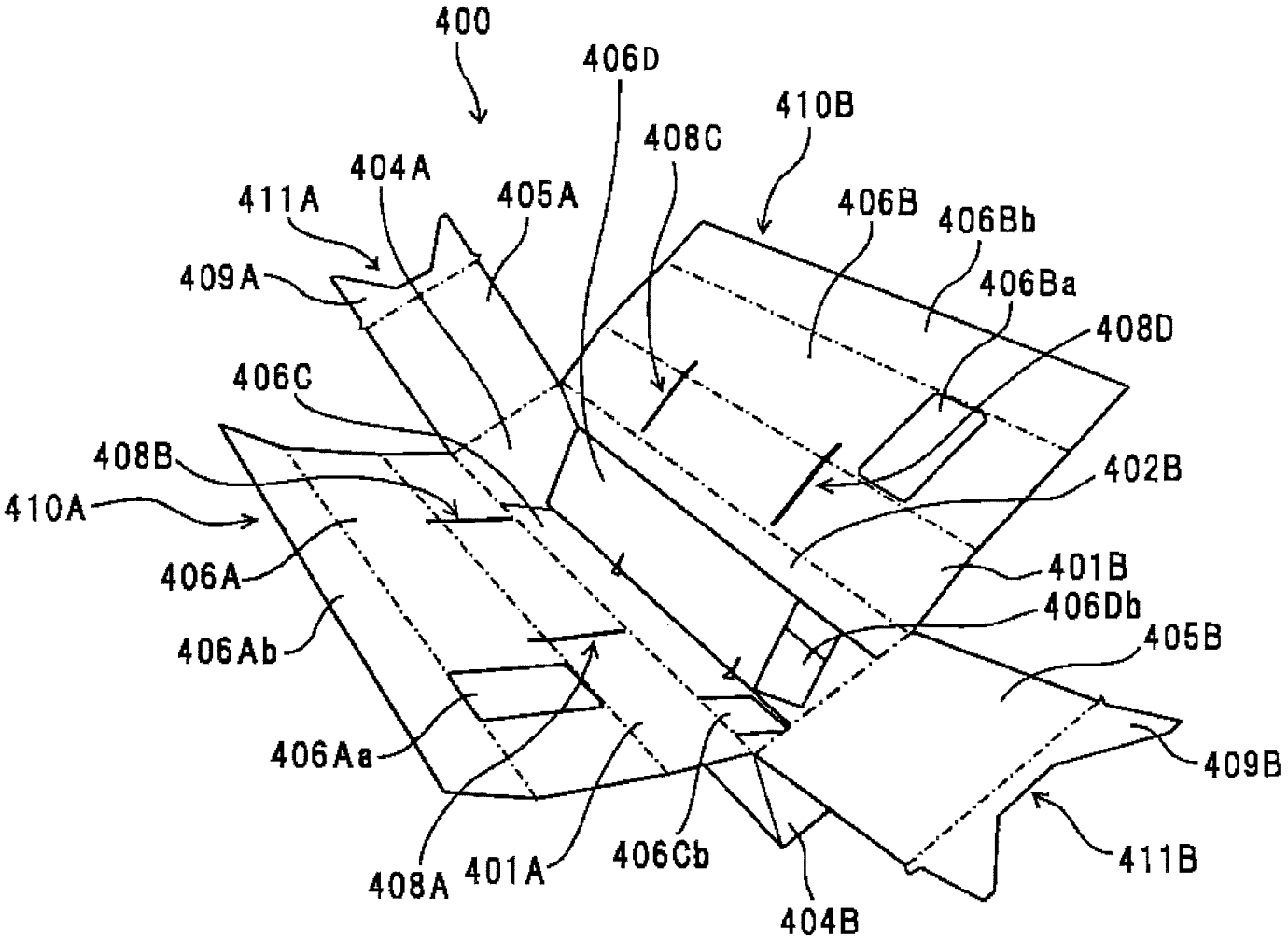
FIG. 16 shows a perspective view of the packaging box after a bottom part is fabricated.

Then, a short flap 405C and an insert part 409C of the lower flap 411C are folded inside, and the insert part 409C is inserted into a cut 408F of the lower flap 410C and a cut 408G of the lower flap 410D, so that creases G and H shown in FIG. 15 of the lower flap 411C are folded in a manner of a valley fold. Further, a short flap 405D and an insert part 409D of the lower flap 411D are folded inside, and the insert part 409D is inserted into a cut 408E of the lower flap 410C and a cut 408H of the lower flap 410D, so that creases I and J shown in FIG. 15 of the lower flap 411D are folded in a manner of a valley fold. Thereby, the lower flaps 410C and 410D folded inside of the packaging box 400 as mentioned above are prevented from opening by the lower flaps 411C and 411D, and thus, fabrication of the bottom part of the packaging box 400 is completed. FIG. 16 shows a perspective view of the packaging box 400 where fabrication of the bottom part is completed.

<Procedure 5>

When the bottom part of the packaging box 400 has been thus completed, a toner container 32 is set in the inside of the packaging box 400 in such a manner that the container body 33 of the toner container 32 is placed on the respective faces of the lower cushioning wall parts 406C and 406D. At this time, the bottle cap 34 (i.e., the corresponding one of the bottle caps 34Y, 34C, 34M and 34K) of the toner container 32 is positioned at a position of facing openings 406Ca and 406Da formed on the lower cushioning wall parts 406C and 406D, respectively, so that the bottle cap 34 is prevented from coming into contact with the lower cushioning wall parts 406C and 406D.

<Procedure 6>

Next, in order to form a triangle by a top face part 401A, an upper cushioning wall part 406A and an upper cushioning wall support part 406Ab of the upper flap 410A, the top face part 401A, upper cushioning wall part 406A and upper cushioning wall support part 406Ab are folded inside in a manner of a valley fold at creases K, L and M shown in FIG. 15. Thus, a top part of one side of the packaging box 400 is formed by the upper flap 410A. It is noted that it is preferable that the angle formed between the top face part 401A and the upper cushioning wall part 406A of the triangle formed by the top face part 401A, the upper cushioning wall part 406A and the upper cushioning wall support part 406Ab is 45°.

<Procedure 7>

The same as the procedure 6 described above, in order to form a triangle by a top face part 401B, an upper cushioning wall part 406B and an upper cushioning wall support part 406Bb of the upper flap 410B, the top face part 401B, upper cushioning wall part 406B and upper cushioning wall support part 406Bb are folded inside in a manner of a valley fold at creases N, O and P shown in FIG. 15. Thus, a top part at the other side of the packaging box 400 is formed by the upper flap 410B. It is noted that it is preferable that the angle formed between the top face part 401B and the upper cushioning wall part 406B of the triangle formed by the top face part 401B, the upper cushioning wall part 406B and the upper cushioning wall support part 406Bb is 45°.

<Procedure 8>

Then, a short flap 405A and an insert part 409A of the upper flap 411A are folded inside, and the insert part 409A is inserted into a cut 408B of the upper flap 410A and a cut 408C of the upper flap 410B, so that creases Q and R shown in FIG. 15 of the upper flap 411A are folded in a manner of a valley fold. Further, a short flap 405B and an insert part 409B of the upper flap 411B are folded inside, and the insert part 409B is inserted into a cut 408A of the upper flap 410A and a cut 408D of the upper flap 410B, so that creases S and T shown in FIG. 15 of the upper flap 411B are folded in a manner of a valley fold. Thereby, the upper flaps 410A and 410B folded inside of the packaging box 400 as mentioned above are prevented from opening by the upper flaps 411A and 411B, and thus, fabrication of the top face part of the packaging box 400 is completed.

It is noted that when the top face part of the packaging box 400 is fabricated, the same as the above-mentioned case of fabrication of the bottom part, the bottle cap 34 of the toner container 32 is positioned at a position of facing openings 406Aa and 406Ba formed on the upper cushioning wall parts 406A and 406B, respectively, so that the bottle cap 34 is prevented from coming into contact with the upper cushioning wall parts 406A and 406B.

By thus carrying out fabrication according to the above-described procedures, the packaging box 400 as a carton having a cushioning function is formed. In the configuration example 1, since the cushioning members and the packaging box 400 are formed in one piece as a result of the single sheet of corrugated paper being folded, it is possible to reduce the required number of parts/components.

Figure 17:
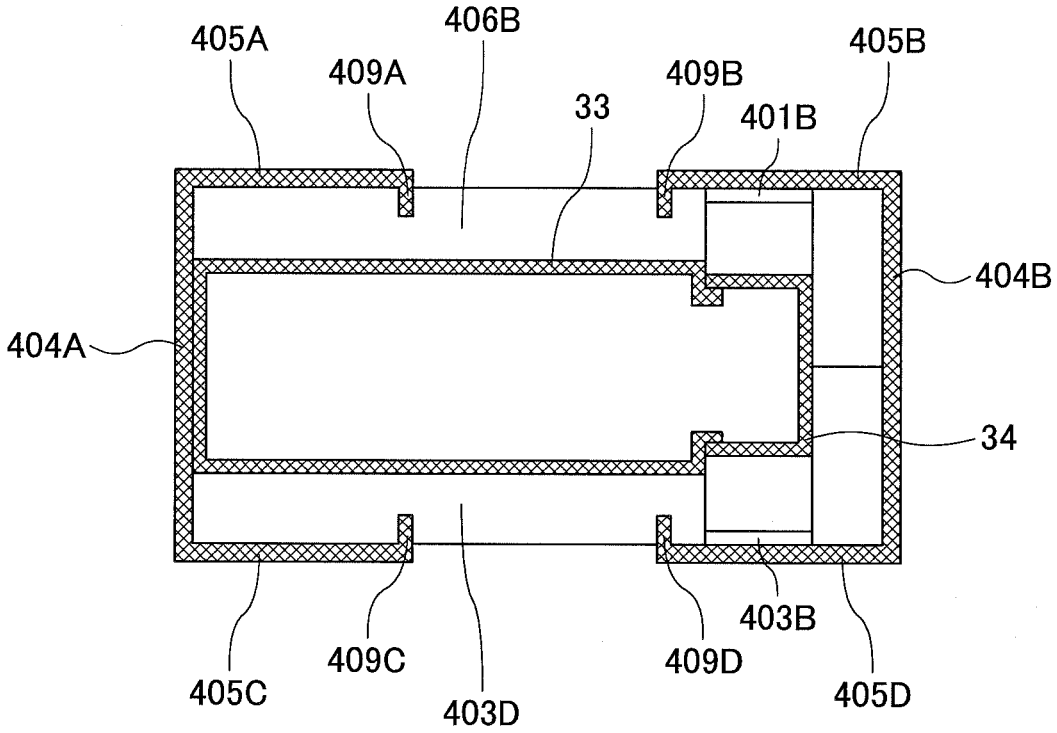
FIG. 17 is a sectional view taken from cutting, by a cutting line A1-A2 in FIG. 10(*c*), the packaging box in which the toner container is packaged.
Figure 18:
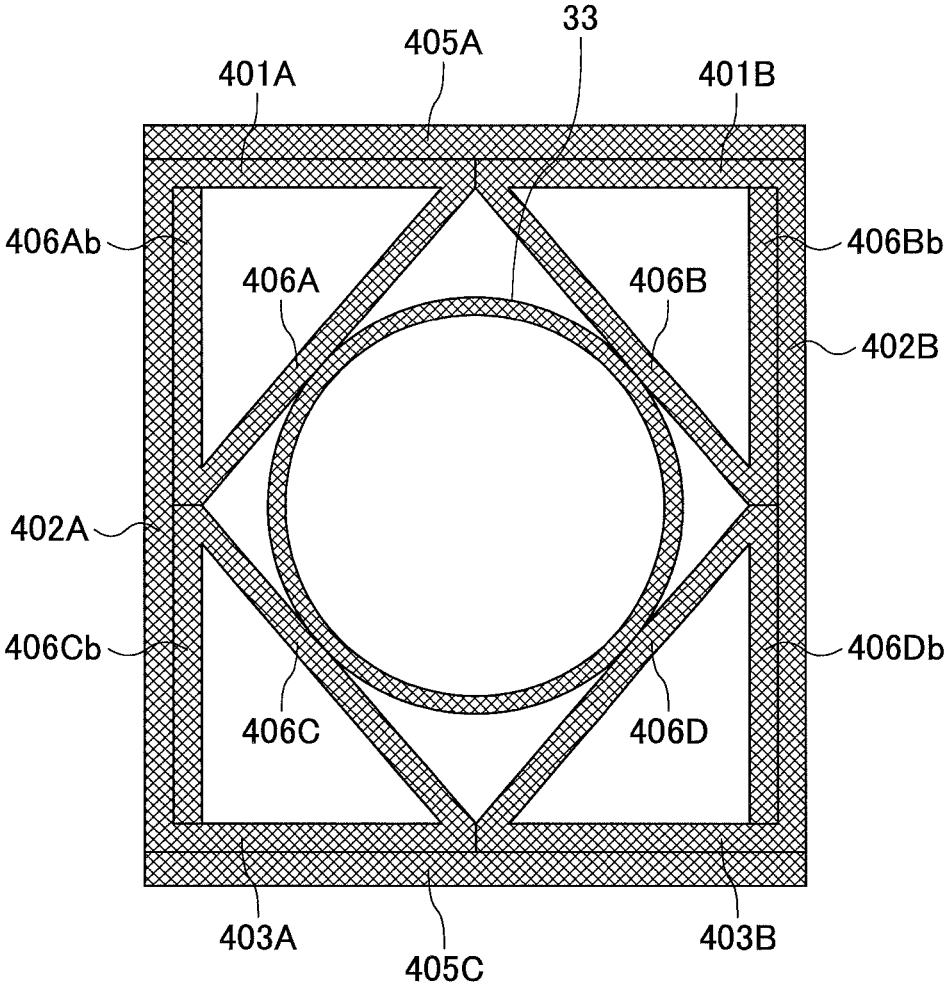
FIG. 18 is a sectional view taken from cutting, by a cutting line B1-B2 in FIG. 10(*a*), the packaging box in which the toner container is packaged.
Figure 19:
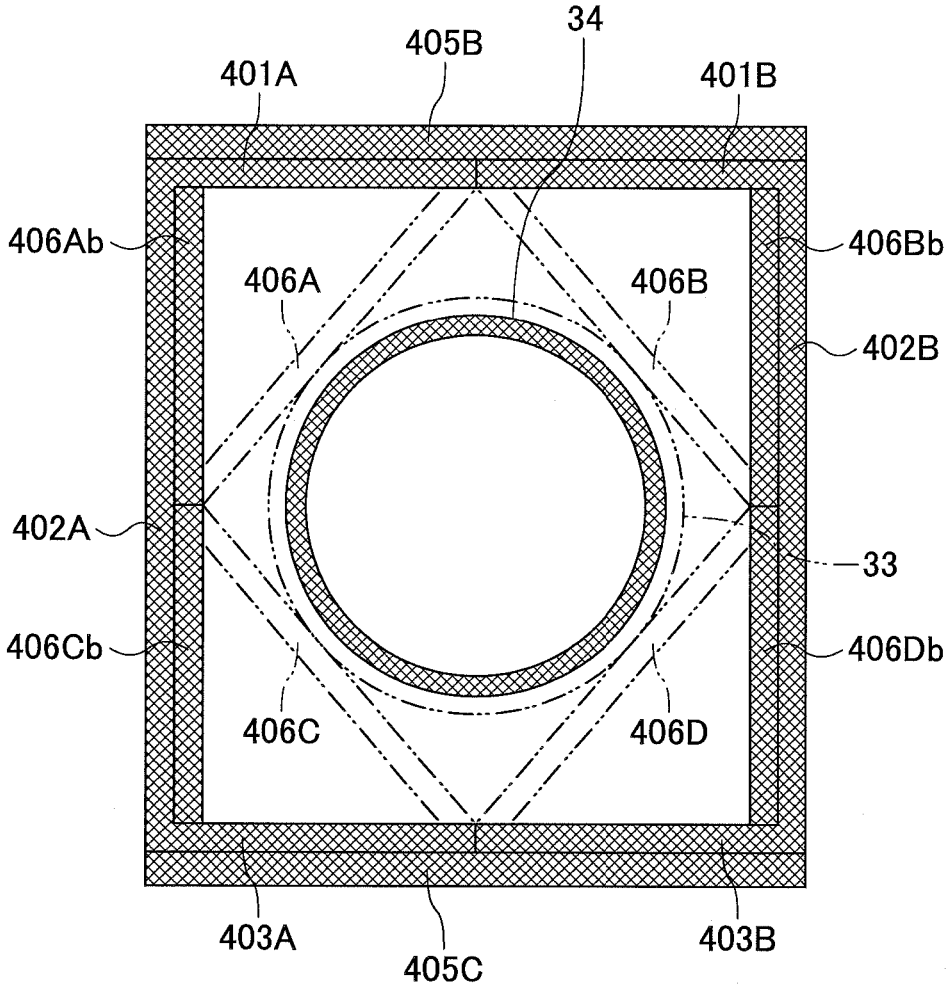
FIG. 19 is a sectional view taken from cutting, by a cutting line C1-C2 in FIG. 10(*a*), the packaging box in which the toner container is packaged.
Figure 20:
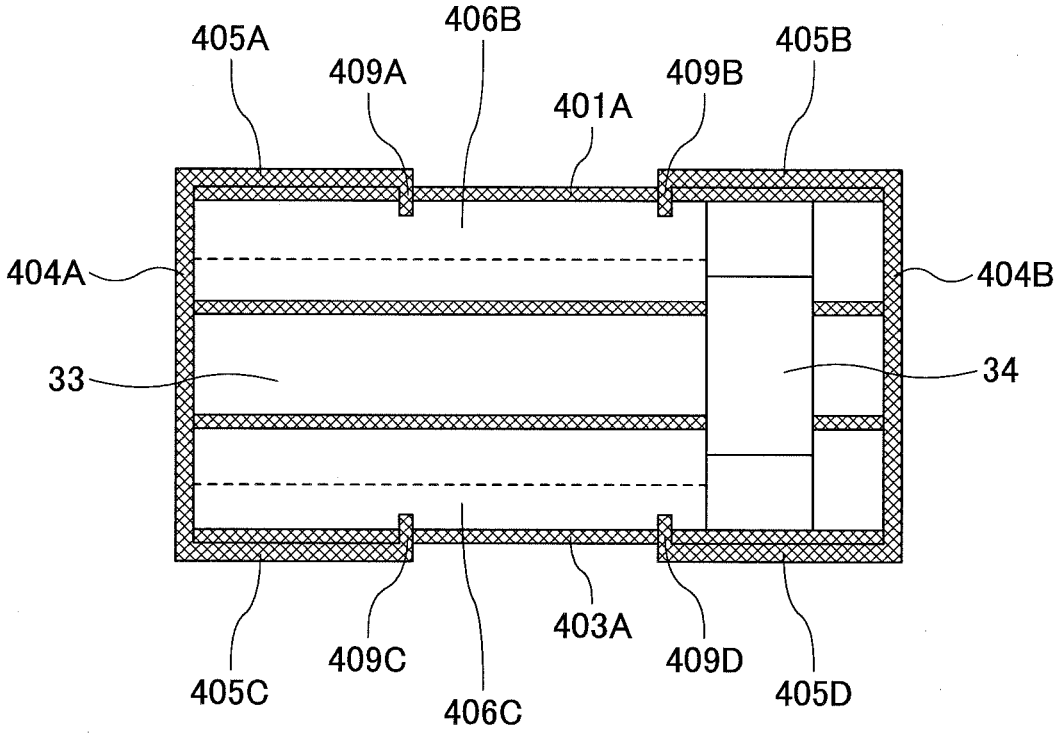
FIG. 20 is a sectional view taken from cutting, by a cutting line A3-A4 in FIG. 10(*c*), the packaging box in which the toner container is packaged.

FIG. 17 is a sectional view taken from cutting, by a cutting line A1-A2 in FIG. 10(*c*), the packaging box 400 in which the toner container 32 is packaged. FIG. 18 is a sectional view taken from cutting, by a cutting line B1-B2 in FIG. 10(*a*), the packaging box 400 in which the toner container 32 is packaged. FIG. 19 is a sectional view taken from cutting, by a cutting line C1-C2 in FIG. 10(*a*), the packaging box 400 in which the toner container 32 is packaged. It is noted that the alternate long and two short dashed lines in FIG. 19 are imaginary lines. FIG. 20 is a sectional view taken from cutting, by a cutting line A3-A4 in FIG. 10(*c*), the packaging box 400 in which the toner container 32 is packaged. As can be seen from FIGS. 17, 18 and 20, the container body 33 is in contact with the respective cushioning wall parts, and as can be seen from FIGS. 17, 19 and 20, the bottle cap 34 is not in contact with the respective cushioning wall parts.

By thus packaging the toner container 32 in the packaging box 400, the bottle cap 34 is suspended in the space without coming into contact with any one of the upper cushioning wall parts 406A, 406B and the lower cushioning wall parts 406C, 406D. Therefore, even when a shock is given to the packaging box 400 from the outside, the shock does not directly transmit to the bottle cap 34 from the cushioning wall parts or the packaging box 400. Thus, it is possible to prevent such a force that the axial line of the bottle cap 34 is inclined from the axial line of the container body 33 (i.e., the corresponding one of the container bodies 33Y, 33M, 33C and 33K) from being applied to the bottle cap 34. Therefore, it is possible to avoid a situation in which the packing 370 as the sealing member inserted between the container body 33 and the bottle cap 34 is shifted, a gap is created between the container body 33 and the bottle cap 34, and the toner leaks through the gap.

Figure 21:
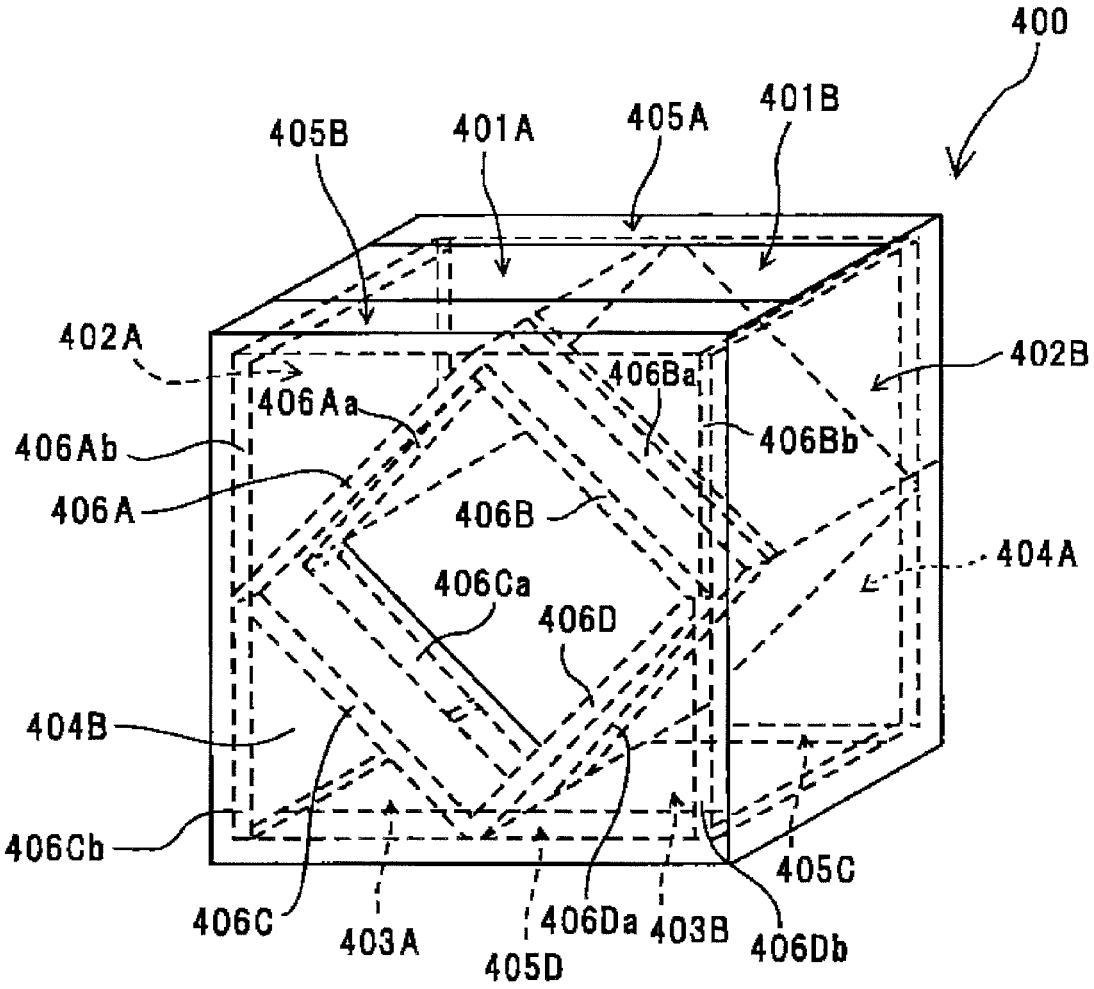
FIG. 21 shows the packaging box after fabrication is finished.

Further, as shown in FIG. 21, in the packaging box 400 as the carton having the cushioning function, the upper cushioning wall parts 406A, 406B and the lower cushioning wall parts 406C, 406D form a rectangle to contain the container body 33 in the inside of the packaging box 400. Further, the ridge lines on which the mutually adjacent ones of the upper cushioning wall parts 406A, 406B and the lower cushioning wall parts 406C, 406D intersect, respectively, are positioned at approximately the centers of the four wall surfaces that form the top and bottom faces and both side faces, respectively.

Figure 22:
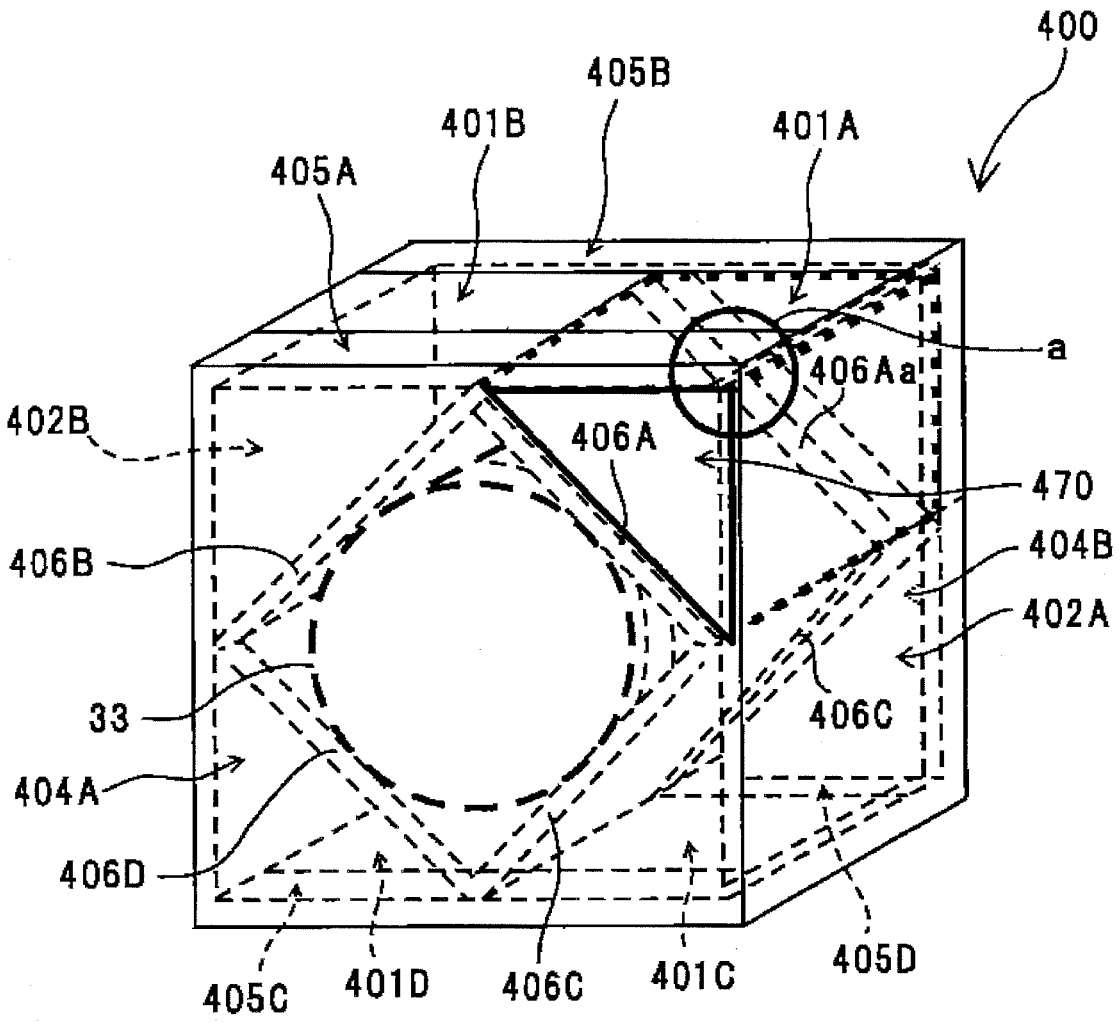
FIG. 22 illustrates an air layer part cushioning a shock in a state where the packaging box is dropped on corner "a"

Therefore, when the toner container 32 is contained in the packaging box 400, spaces are created between the above-mentioned ridge lines and the container body 33. Therefore, even when a shock or such is given to the packaging box 400 from the outside during transportation, the shock transmitting to the container body 33 is reduced, and it is possible to prevent the toner container 32 from being damaged during transportation, or so Further, when the packaging box 400 is dropped on corner "a" shown in FIG. 22, the shock is cushioned as a result of the buckling of an air layer 470 enclosed by the upper cushioning wall part 406A, the top face part 401A and the side face part 402B, and therefore, a shock given to the container body 33 in the packaging box 400 can be reduced.

Figure 23:
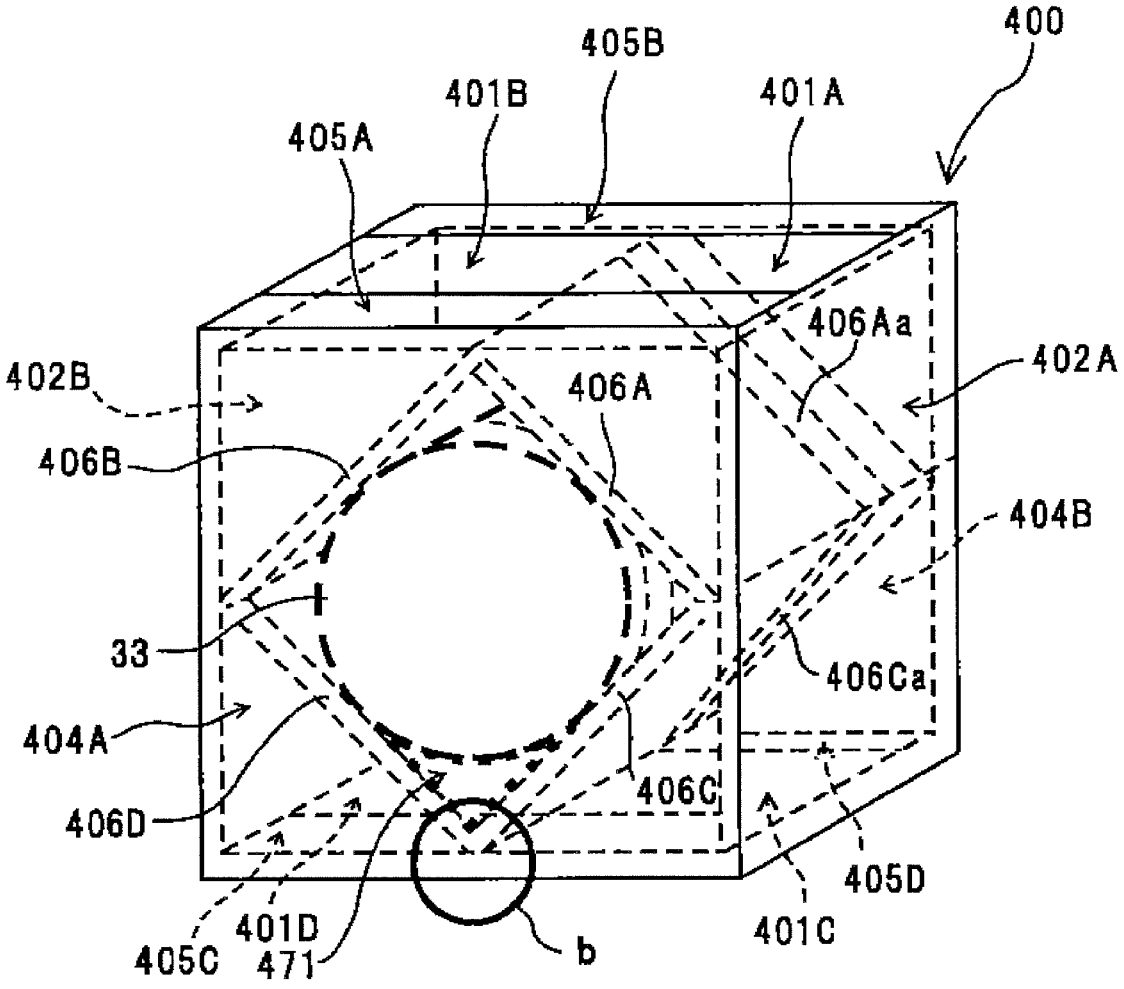
FIG. 23 illustrates a part (corner), at which a cushioning member and another cushioning member intersect, cushioning a shock in a state where the packaging box is dropped on corner "b"

Further, when the packaging box 400 is dropped on corner "b" shown in FIG. 23, the shock is cushioned as a result of the buckling of an air layer part 471 enclosed by the lower cushioning wall parts 406C, 406D and the container body 33 being created and an intersection part (corner) formed between the lower cushioning wall parts 406C and 406D, and therefore, a shock given to the container body 33 in the packaging box 400 can be reduced.

Thus, even when a shock or such is given to the packaging box 400 from the outside during transportation, the shock transmitting to the container body 33 is reduced, and it is possible to prevent the toner container 32 from being damaged during transportation, or so.

Figure 24:
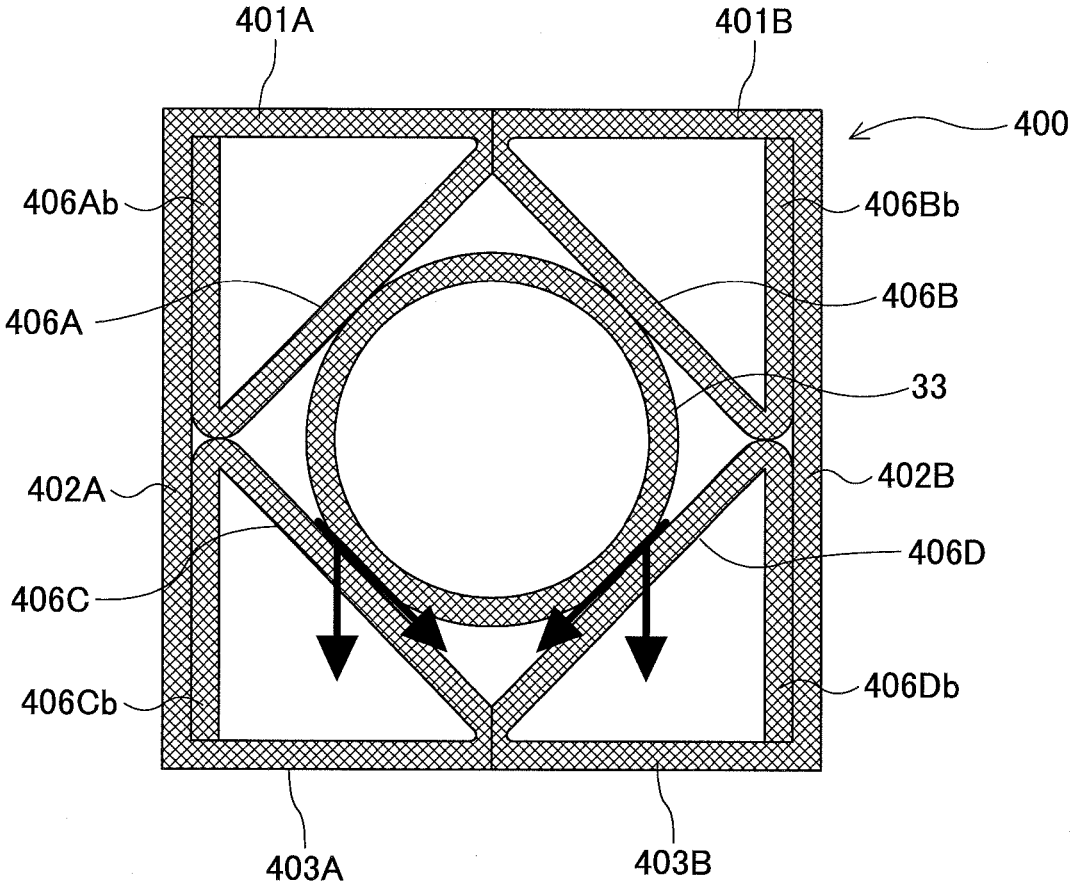
FIG. 24 is a sectional view taken from cutting, by a cutting line B3-B4 in FIG. 10(*c*), the packaging box according to the configuration example 1 in which the toner container is packaged.
Figure 25:
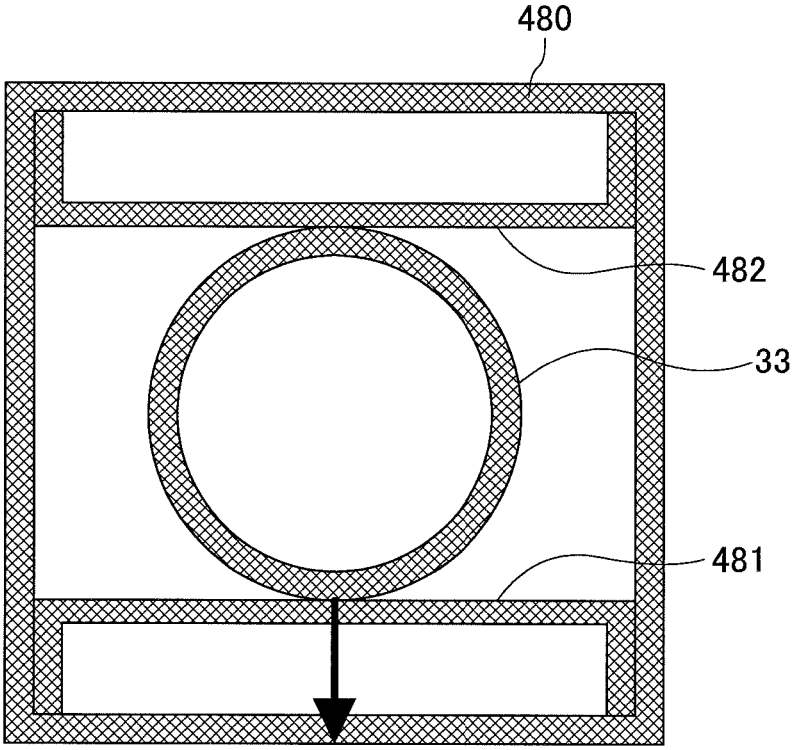
FIG. 25 is a sectional view taken from cutting, in a direction perpendicular to the axial direction of the container body at the position of the container body, a packaging box in which the container body is sandwiched from the top and bottom directions by two cushioning members.

FIG. 24 is a sectional view taken from cutting, by a cutting line B3-B4 in FIG. 10(*c*), the packaging box 400 according to the configuration example 1 in which the toner container 32 is packaged. FIG. 25 is a sectional view taken from cutting, in a direction perpendicular to the axial direction of the container body 33 at the position of the container body 33, a packaging box 480 in which the container body 33 is sandwiched from the top and bottom directions by cushioning members 481 and 482, as a comparison example.

In the packaging box 400 according to the configuration example 1, as shown in FIG. 24, for example, the load of the toner container 32 is received by the two faces i.e., the lower cushioning wall parts 406C and 406D, and the load is distributed as indicated by arrows shown in FIG. 24. Therefore, in comparison to the case of FIG. 25 where the load of the toner container 32 is received by only the single face, i.e., the cushioning member 481 from among the cushioning members 481 and 482 in the packaging box 480 as indicated by an arrow shown in FIG. 25, it is possible to reduce the shock given to the packaging box 400 from the outside and reaching the toner container 32 in the packaging box 400 according to the configuration example 1.

<Experiment>

Based on JIS Z 0202 "Method of drop test for packaged freights", a drop test was carried out using a RICOH Pro toner C900. The RICOH Pro toner C900 has a total weight of 3 kg, and the corrugated paper was made of BF 220/150. The drop test was carried out in a manner of 1-corner, 3-ridge, 6-face free fall from 90 cm onto a concrete floor. Further, as a comparison example, a drop test was carried out in the same conditions for a case where a cushioning member was used for holding the rear end of the container body 33 and the bottle cap 34 of the toner container 32, and the toner container 32 was contained in a packaging box. Results of these drop tests are shown below as Table 1:

TABLE 1

| NUMBER OF TIMES OF DROP | PACKAGING BOX IN COMPARISON EXAMPLE | PACKAGING BOX IN CONFIGURATION EXAMPLE 1 |
|---|---|---|
| 1 | ○ | ○ |
| 2 | ○ | ○ |
| 3 | ○ | ○ |
| 4 | ○ | ○ |
| 5 | Δ | ○ |
| 6 | Δ | ○ |
| 7 | Δ | ○ |
| 8 | Δ | ○ |
| 9 | X | ○ |
| 10 | X | ○ |

(○: NO TONER LEAKAGE, Δ: SOME BUCKLING IN CUSHIONING MEMBER, X: SOME TONER LEAKAGE)

In the case where the toner container 32 was contained in the packaging box 400 according to the configuration example 1, no damage was discovered in the parts such as the container body 33, the bottle cap 34 and so forth, and also no leakage of the toner from the toner container 32 was discovered. In contrast thereto, in the case where the toner container 32 was contained in the packaging box in the comparison example, a leakage of the toner from the toner container 32 was discovered.

Configuration Example 2

In a configuration example 2 according to an embodiment of the present invention, cushioning members and a packaging box are separate parts, and three parts are included, i.e., the two cushioning members that hold the container body of the toner container and cushion a shock transmitted to the container body, and the packaging box containing the cushioning members, are included.

Figure 26:
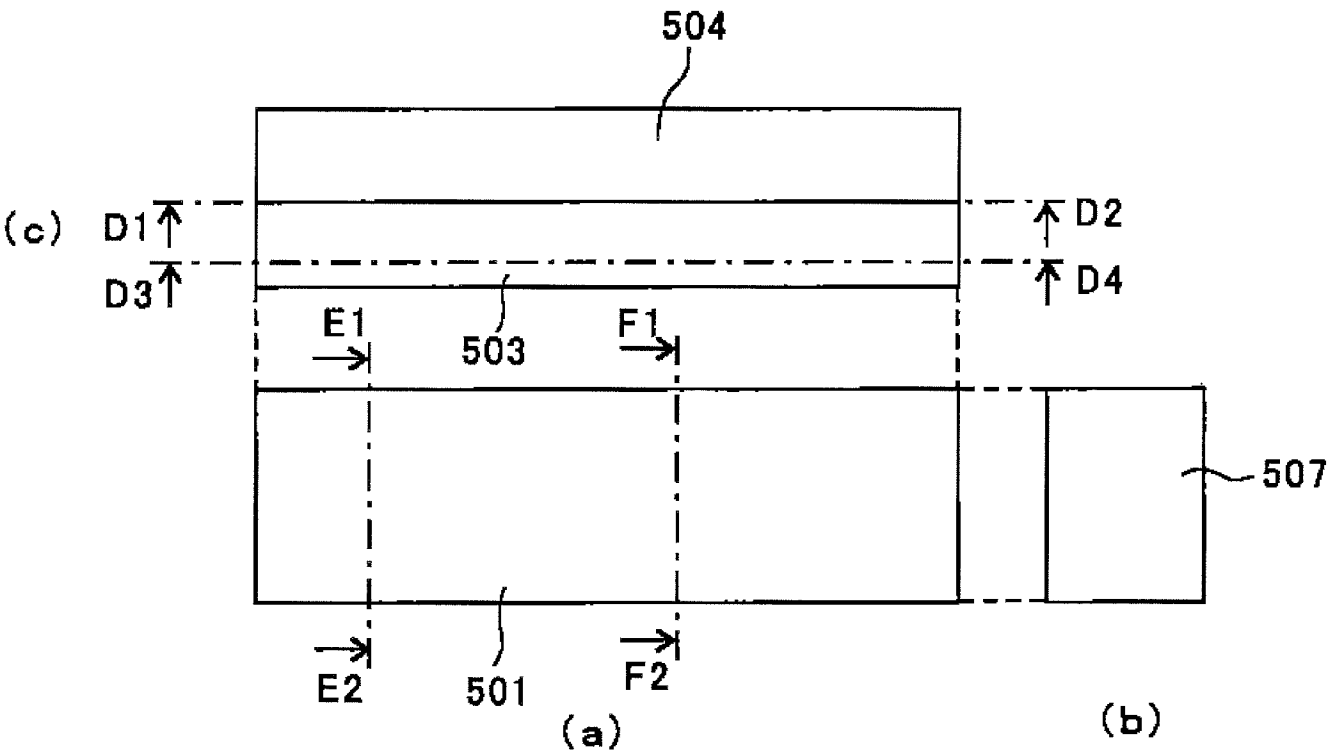
FIG. 26(*a*) shows a front view of a packaging box according to the configuration example 2, (*b*) shows a side view of the packaging box according to the configuration example 2, and (*c*) shows a plan view of the packaging box according to the configuration example 2.

FIG. 26 shows an external appearance of the packaging box 500 according to the configuration example 2. FIG. 26(*a*) shows a front view of the packaging box 500, FIG. 26(*b*) shows a side view of the packaging box 500, and FIG. 26(*c*) shows a plan view of the packaging box 500.

Figure 27:
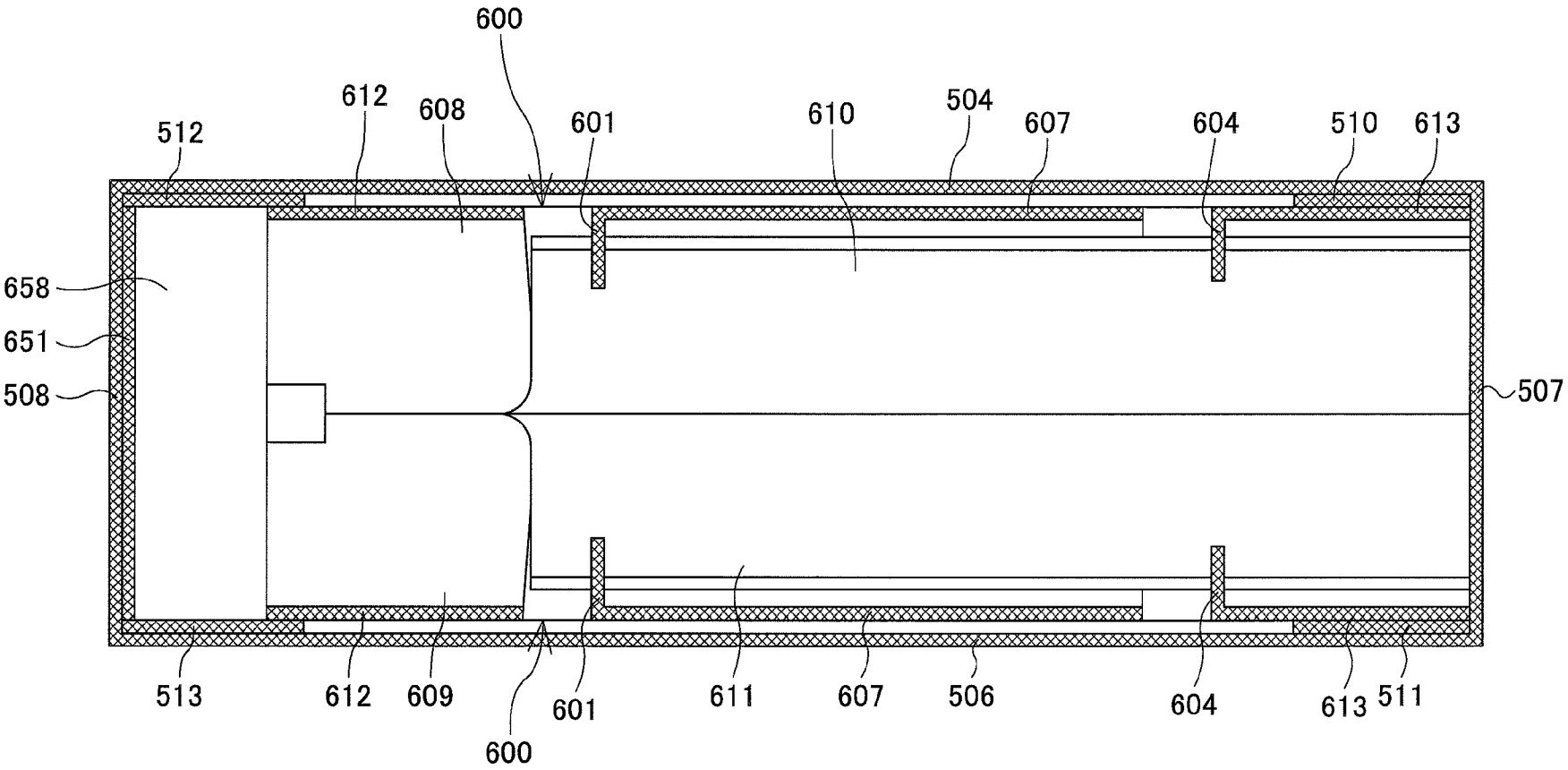
FIG. 27 is a sectional view taken from cutting, by a cutting line D1-D2 in FIG. 26(*c*), the packaging box in which cushioning members are contained and the toner container is not packaged.
Figure 28:
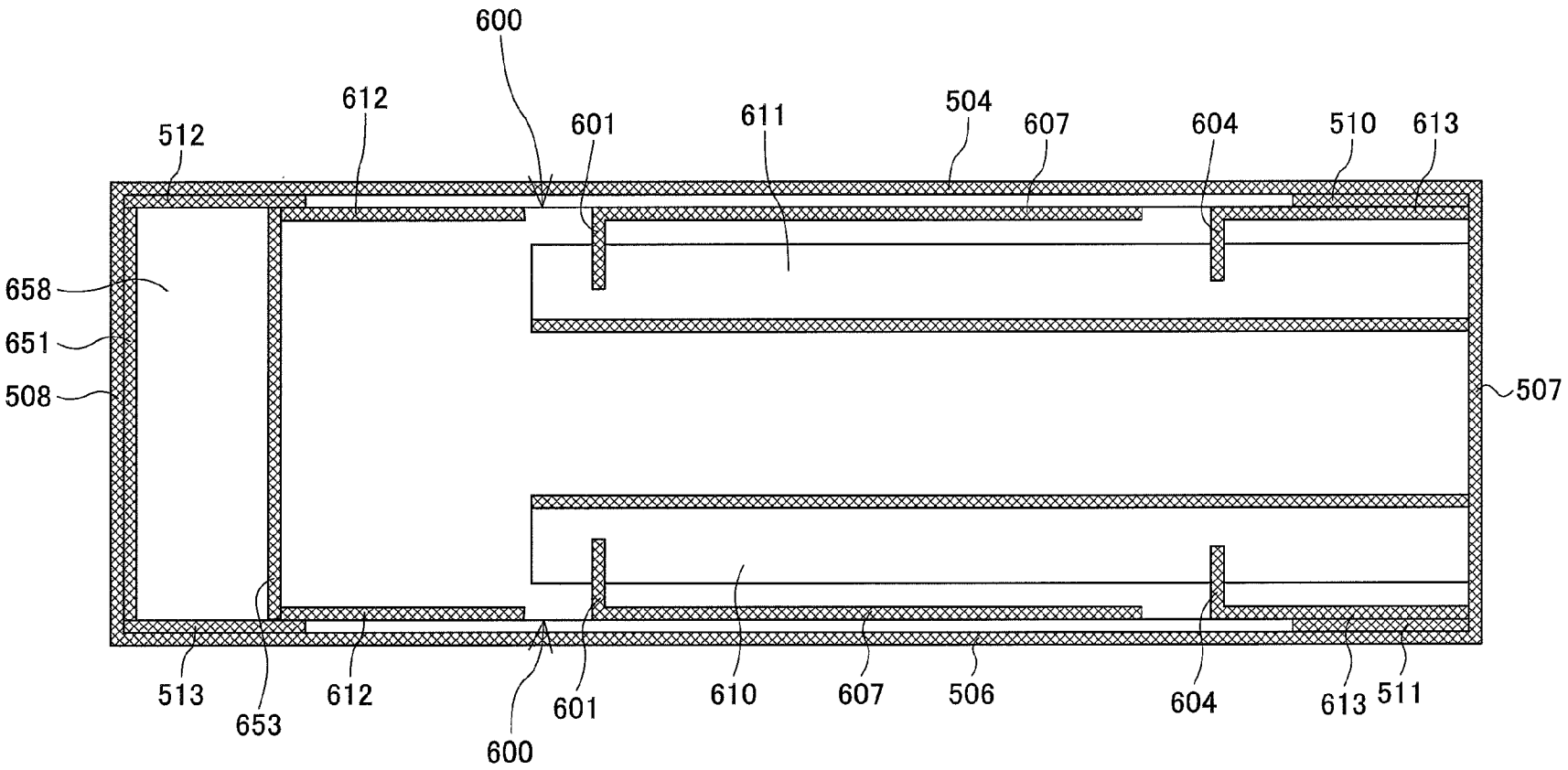
FIG. 28 is a sectional view taken from cutting, by a cutting line D3-D4 in FIG. 26(*c*), the packaging box in which the cushioning members are contained and the toner container is not packaged.
Figure 29A:
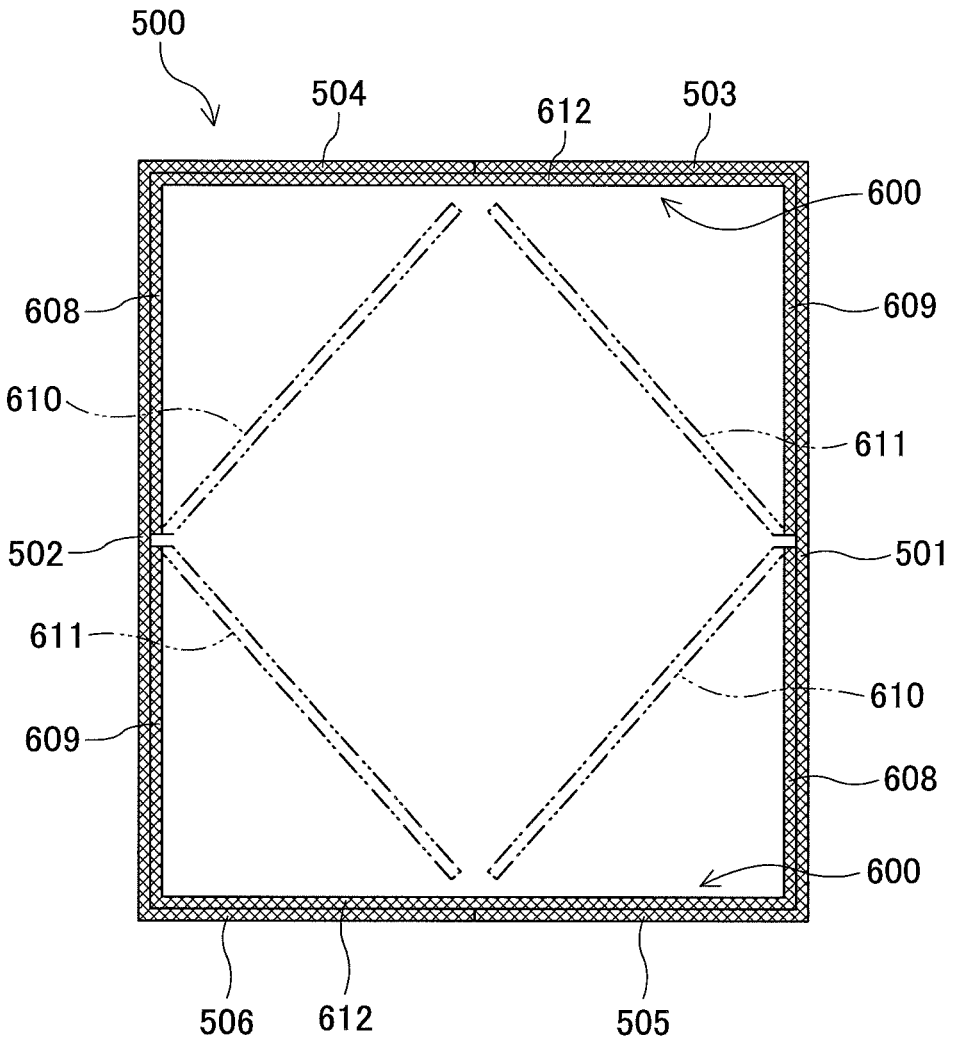
FIG. 29A shows a sectional view taken from cutting, by a cutting line E1-E2 of FIG. 26(*a*), the packaging box in which the cushioning members are contained and the toner container is not packaged.
Figure 29B:
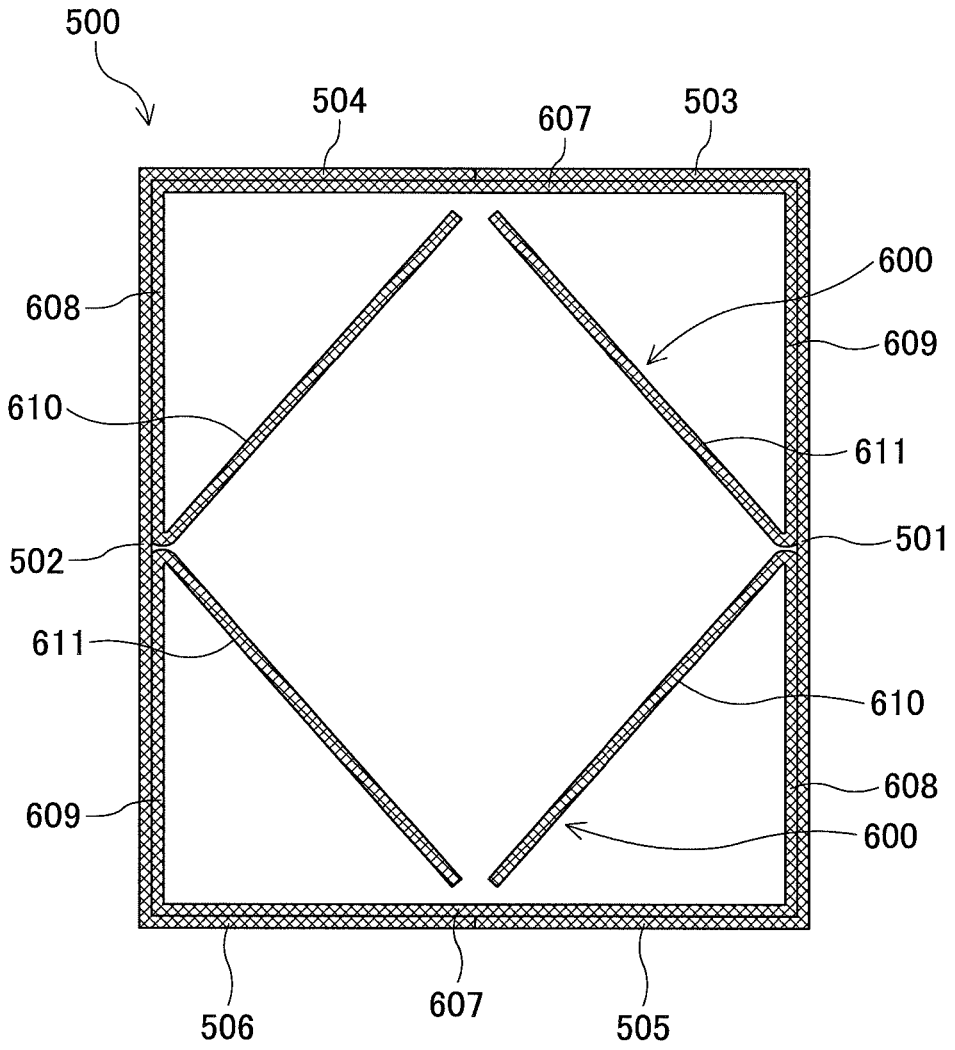
FIG. 29B shows a sectional view taken from cutting, by a cutting line F1-F2 of FIG. 26(*a*), the packaging box in which the cushioning members are contained and the toner container is not packaged.

Further, FIG. 27 is a sectional view taken from cutting, by a cutting line D1-D2 in FIG. 26(*c*), the packaging box 500 in which the cushioning members 600 are contained and the toner container 32 is not packaged. FIG. 28 is a sectional view taken from cutting, by a cutting line D3-D4 in FIG. 26(*c*), the packaging box 500 in which the cushioning members 600 are contained and the toner container 33 is not packaged. FIG. 29A shows a sectional view taken from cutting, by a cutting line E1-E2 of FIG. 26(*a*), the packaging box 500 in which the cushioning members 600 are contained and the toner container 32 is not packaged. FIG. 29B shows a sectional view taken from cutting, by a cutting line F1-F2 of FIG. 26(*a*), the packaging box 500 in which the cushioning members 600 are contained and the toner container 32 is not packaged. It is noted that the alternate long and two short dashed lines in FIG. 29A are imaginary lines.

Figure 30:
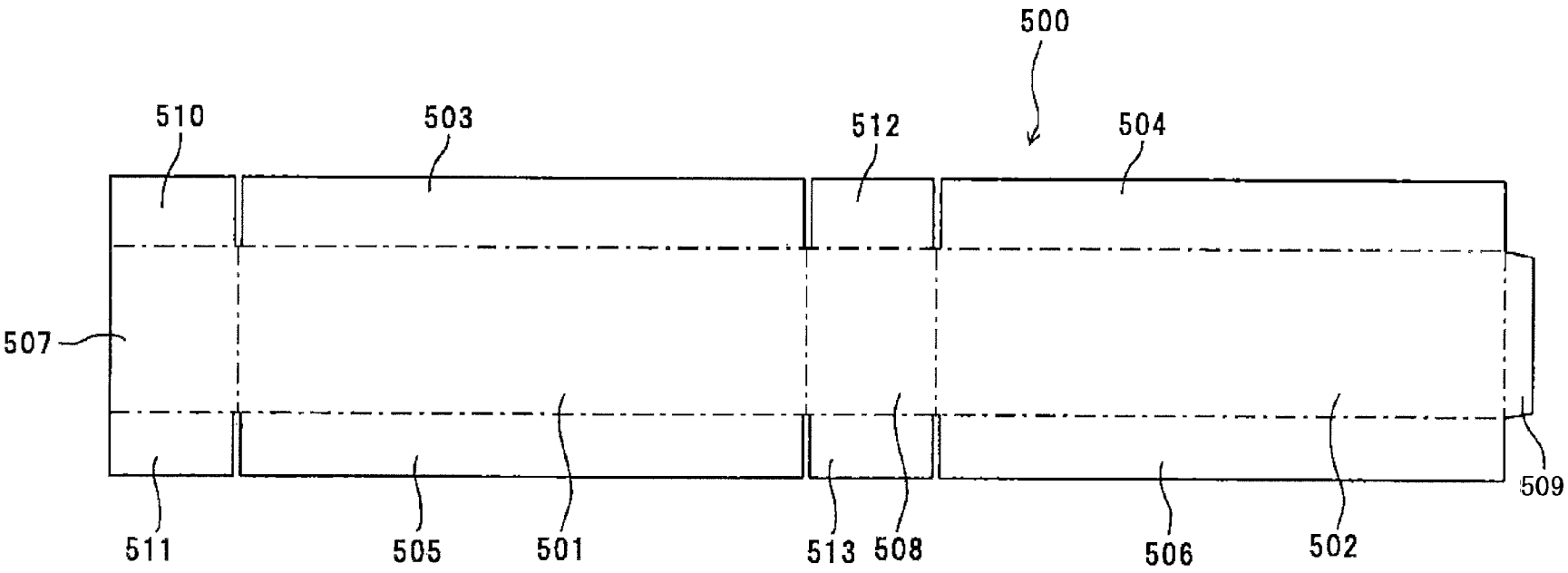
FIG. 30 shows a development of the packaging box according to the configuration example 2.

FIG. 30 shows a development of the packaging box 500, and the alternate long and short dashed lines in FIG. 30 show crease parts for creases. The packaging box 500 is formed as a result of a so-called A-type corrugated paper having a plate shape being folded. When the packaging box 500 is formed by folding this corrugated paper, outer upper flaps 503 and 504 and outer lower flaps 505 and 506 are formed to respective ones of side face parts 501 and 502 that are side face parts facing one another from among four side face parts, i.e., the side face part 501, an end face part 507, the side face part 502 and an end face part 508. The outer upper flaps 503 and 504 close a top opening of the packaging box 500 and act as a top face. The outer lower flaps 505 and 506 close a bottom opening of the packaging box 500 and act as a bottom face. On the other hand, an inner upper flap 510 to be disposed inside of the outer upper flaps 503 and 504, and an inner lower flap 511 to be disposed inside of the outer lower flaps 505 and 506 are formed to the end face part 507 from among the end face parts 507 and 508 that are the other side face parts facing one another. Further, an inner upper flap 512 to be disposed inside of the outer upper flaps 503 and 504, and an inner lower flap 513 to be disposed inside of the outer lower flaps 505 and 506 are formed to the end face part 508.

A tab for sticking 509 is provided to the rear end of the side face part 502, and is used for connecting the rear end of the side face part 502 to the front end of the end face part 507 by bonding together by using an adhesive such as a paste when the packaging box 500 is formed as a result of folding inside the side face part 501, the end face part 507, the side face part 502 and the end face part 508 in sequence.

It is noted that fabrication of the packaging box 500 is carried out in such a manner that in order that the toner container 32 can be installed in the packaging box 500 from the top opening of the packaging box 500, the inner lower flaps 511, 513 are folded inside, thereafter the outer lower flaps 505 and 506 are folded inside, the bottom opening is thus closed, and thus the bottom of the packaging box 500 is formed. On the other hand, the outer upper flaps 503 and 504 and the inner upper flaps 510 and 512 are not folded, and a state where the top opening of the packaging box 500 is opened is maintained. Then, after the toner container 32 is contained into the packaging box 500 from the top opening, the inner upper flaps 510 and 512 are folded inside, thereafter the outer flaps 503 and 504 are folded inside, thus the top opening of the packaging box 500 is closed, and thus the packaging box 500 is covered.

Figure 31:
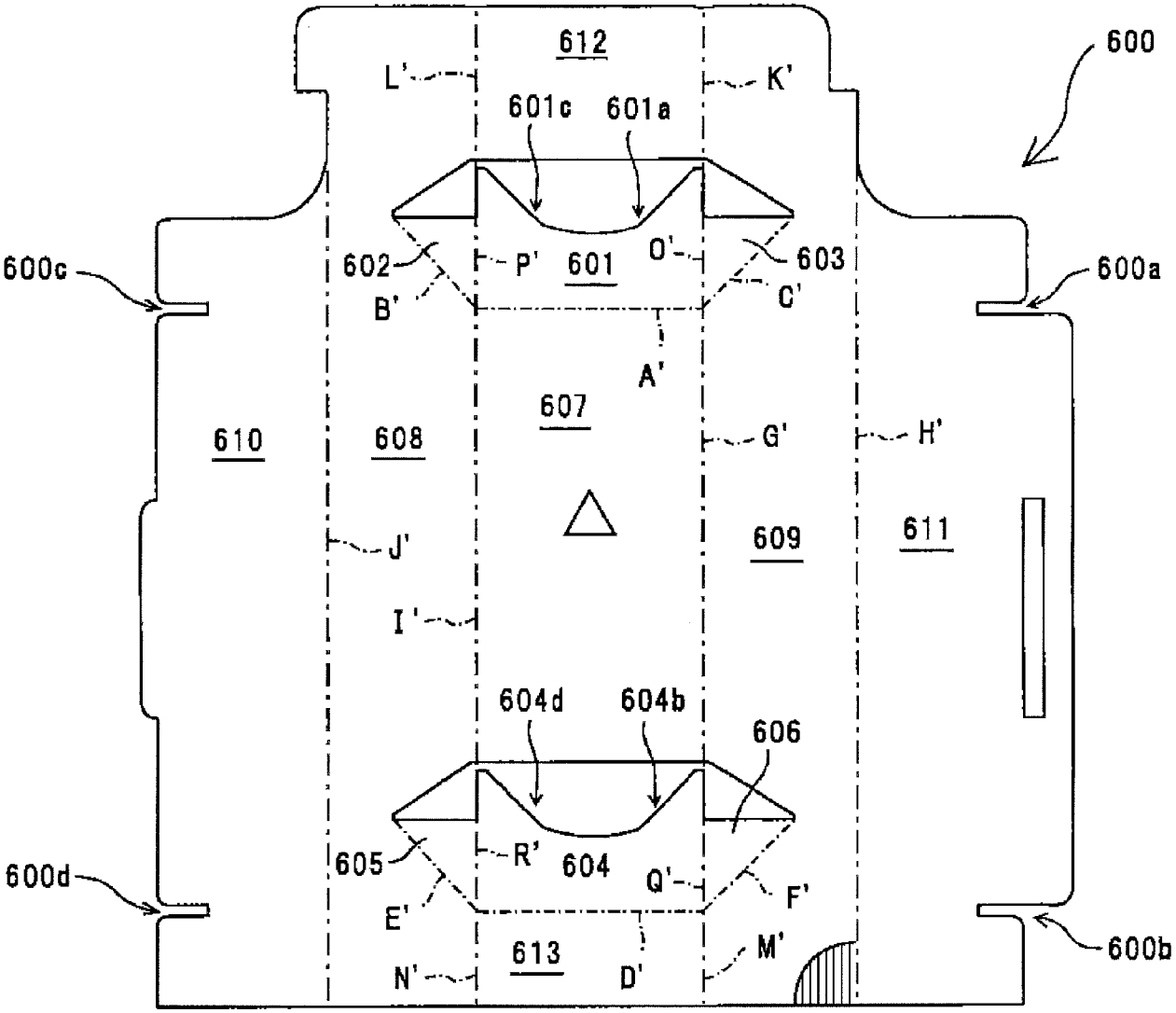
FIG. 31 shows a development of the cushioning member according to the configuration example 2.

FIG. 31 is a development of the cushioning member 600, and the alternate long and short dashed lines in FIG. 31 indicate crease parts for creases.

Figure 32:
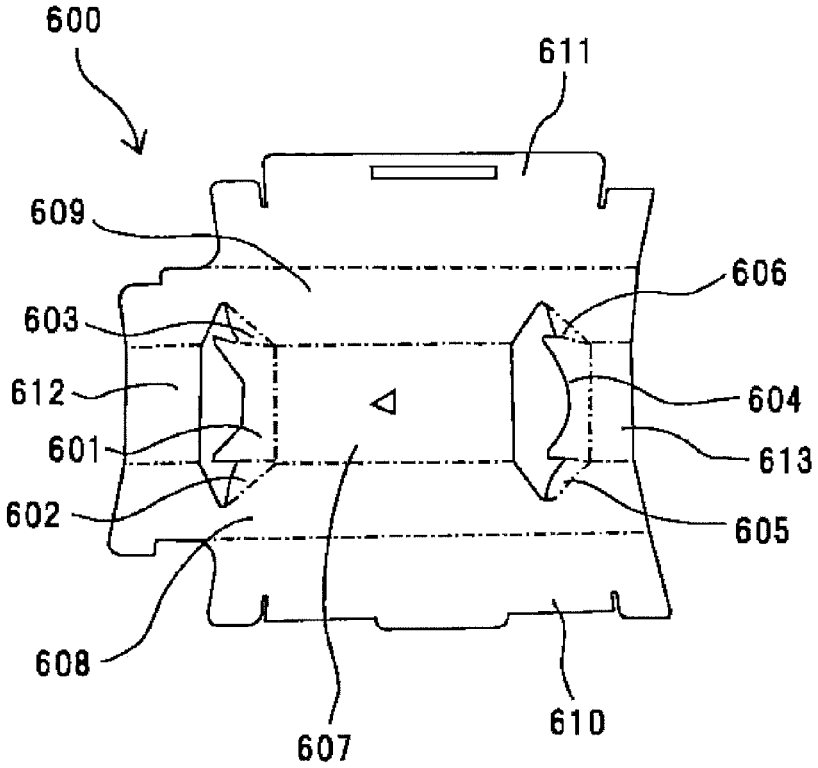
FIGS. 32 and 33 illustrate fabrication of the cushioning member.

First, wall parts 601, 602 and 603 are folded to the front side to stand up as one piece from wall parts 607 and 612 in such a manner that creases A', B' and C' are a valley fold and creases O' and P' are a mountain fold. Similarly, wall parts 604, 605 and 606 are folded to the front side to stand up as one piece from wall parts 607 and 613 in such a manner that creases D', E' and F' are a valley fold and creases Q' and R' are a mountain fold. FIG. 32 shows a state of the cushioning member 600 obtained from these folding operations.

Figure 33:
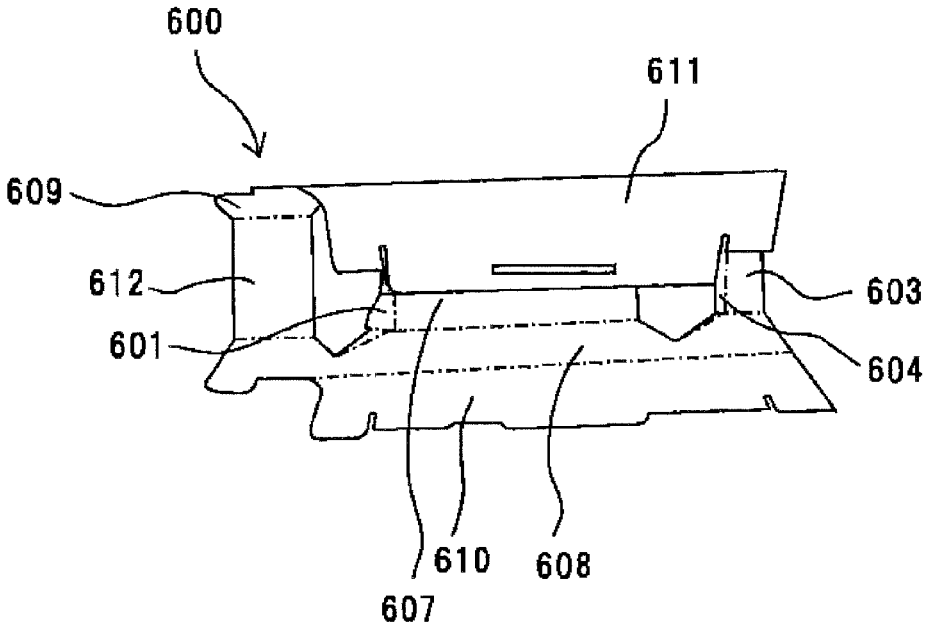
Figure 34:
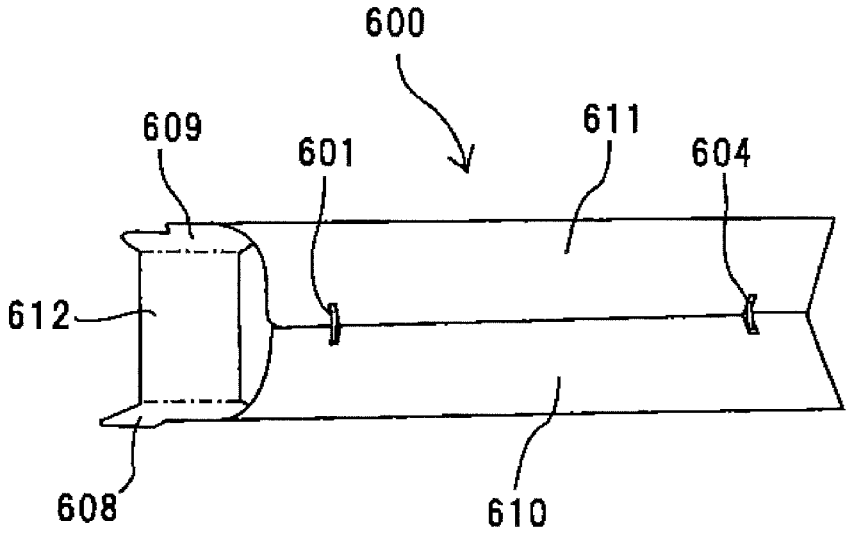
FIG. 34 is a schematic diagram showing the cushioning member after fabrication is finished.

Next, wall parts 609 and 611 are folded in such a manner that creases G', K', M' and H' are a valley fold, a cut 600*a* of the wall part 611 is fitted to a fitting part 601*a* of the wall part 601, a cut 600*b* of the wall part 611 is fitted to a fitting part 604*b* of the wall part 604, and thus, a state shown in FIG. 33 is created. It is noted that it is preferable that the angle formed between the wall part 609 and the wall part 611 is 45°. Similarly, wall parts 608 and 610 are folded in such a manner that creases I', L', N' and J' are a valley fold, a cut 600*c* of the wall part 610 is fitted to a fitting part 601*c* of the wall part 601, a cut 600*d* of the wall part 610 is fitted to a fitting part 604*d* of the wall part 604, and thus, a state shown in FIG. 34 is created. It is noted that it is preferable that the angle formed between the wall part 608 and the wall part 610 is 45°.

Figure 35:
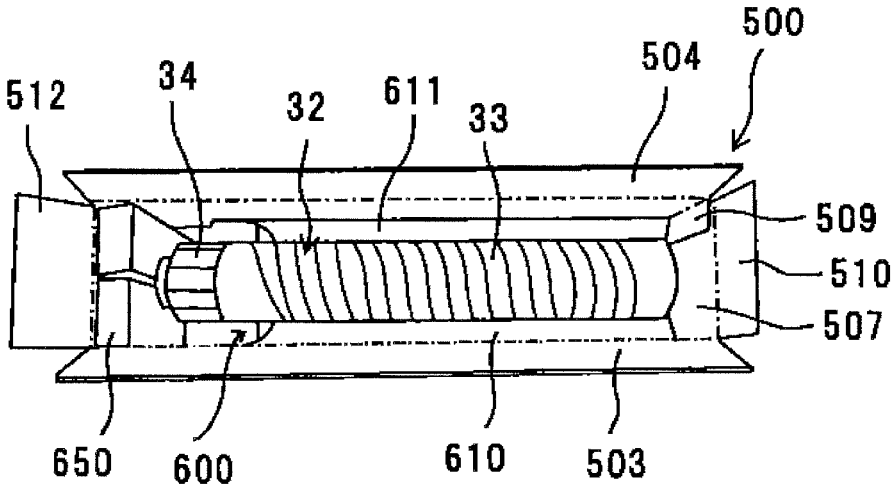
FIG. 35 shows a state where the container body of the toner container is placed on the cushioning member incorporated in the packaging box.

The cushioning member 600 thus fabricated is incorporated into the packaging box 500 as shown in FIG. 35, and the toner container 32 is set on the cushioning member 600 in the packaging box 500 in such a manner that the container body 33 of the toner container 32 is placed on the respective faces of the wall parts 610 and 611.

Figure 36:
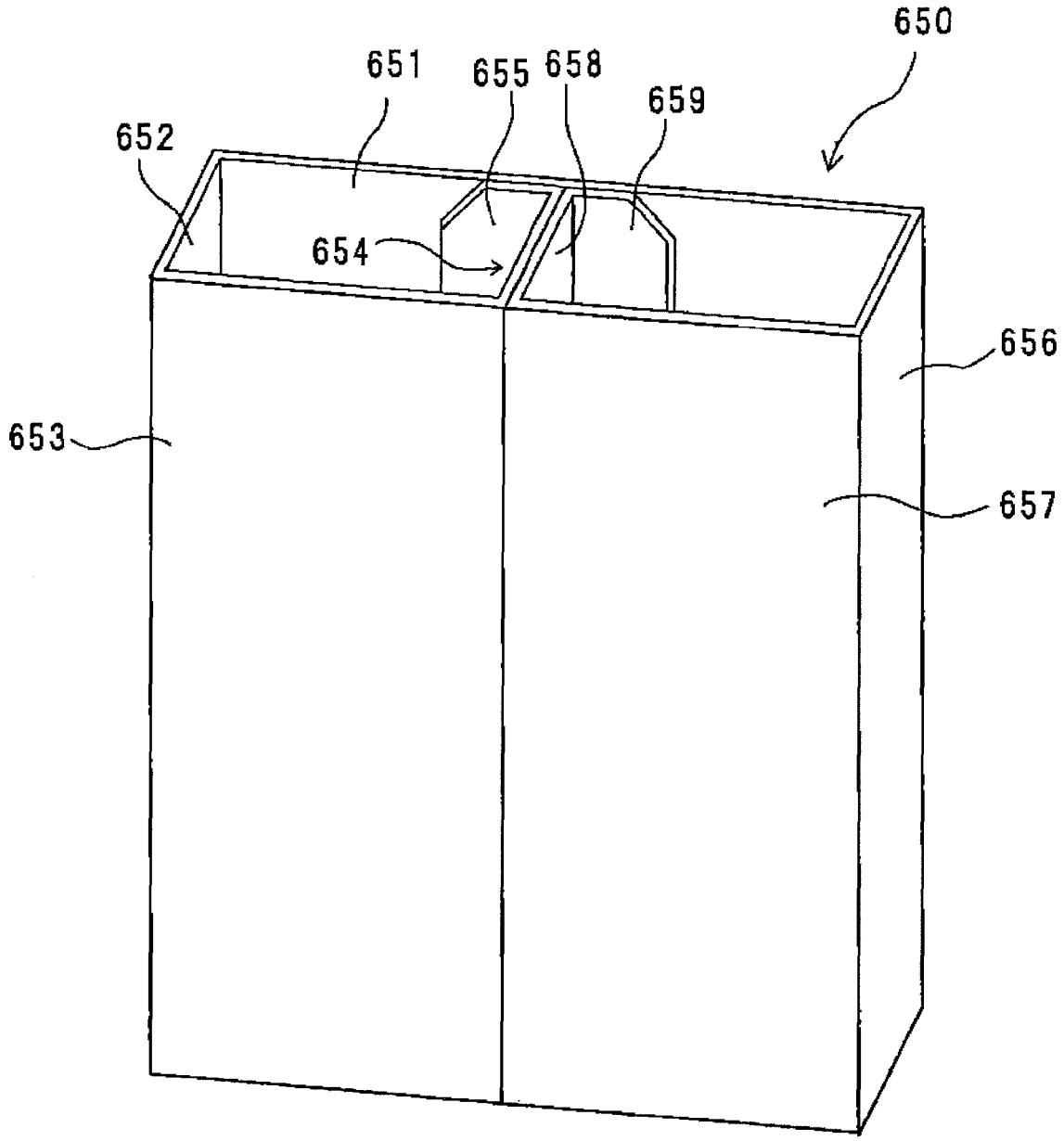
FIG. 36 shows a perspective view of a pad to be fitted between a bottle cap and an inner end face of the packaging box in an axial direction of the toner container.
Figure 37:
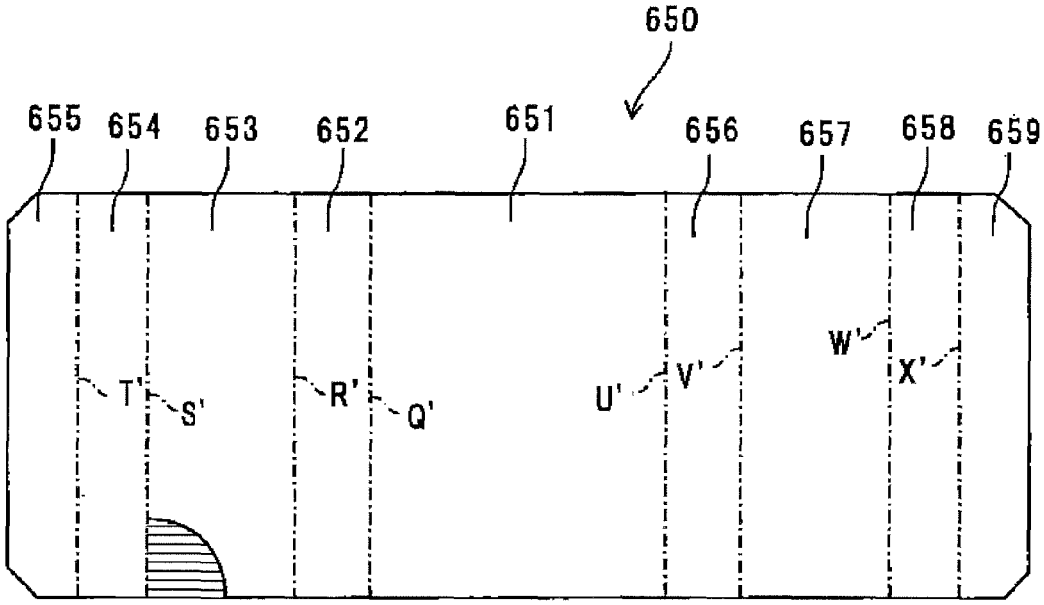
FIG. 37 shows a development of the pad to be fitted between the bottle cap and the inner end face of the packaging box in the axial direction of the toner container.

Further, as shown in FIG. 35, a pad 650 shown in FIG. 36 is fitted between the bottle cap 34 and the inner end face of the packaging box 500 in the axial direction of the toner container 32, and thus, movements of the toner container 32 in the packaging box 500 are restricted. FIG. 37 is a development of the pad 650, and the alternate long and short dashed lines indicate crease parts for creases. Fabrication of the pad 650 is carried out in such a manner that in order that prismatic parts having hollows are formed at both sides (see FIG. 36), side wall parts 652, 653, 654 and 655 are folded to the side of a side wall 651 with creases Q', R', S' and T' being a valley fold, and further, side wall parts 656, 657, 658 and 659 are folded to the side of the side wall 651 with creases U', V', W' and X' being a valley fold. After these folding operations, the face of the side face part 655 and the face of the side face part 659 are bonded together by means of an adhesive such as a paste, and thus, the fabrication of the pad 650 is completed.

Figure 38:
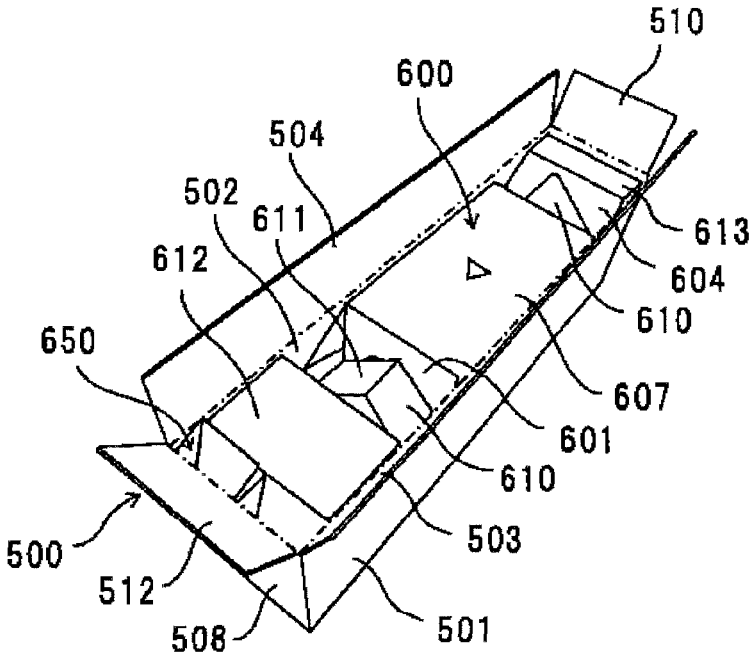
FIG. 38 shows a state where the toner container is sandwiched by two cushioning members from the top and bottom directions in the inside of the packaging box.

Then, on the toner container 32 thus having been set on the cushioning member 600 in the packaging box 500, another cushioning member 600 is placed. Then, as shown in FIG. 38, a state where the toner container 32 is sandwiched by the cushioning members 600 from the top and bottom directions in the packaging box 500 is created, the inner upper flaps 510, 512 and the outer upper flaps 503, 504 are closed, and thus, packaging is completed.

Figure 1B:
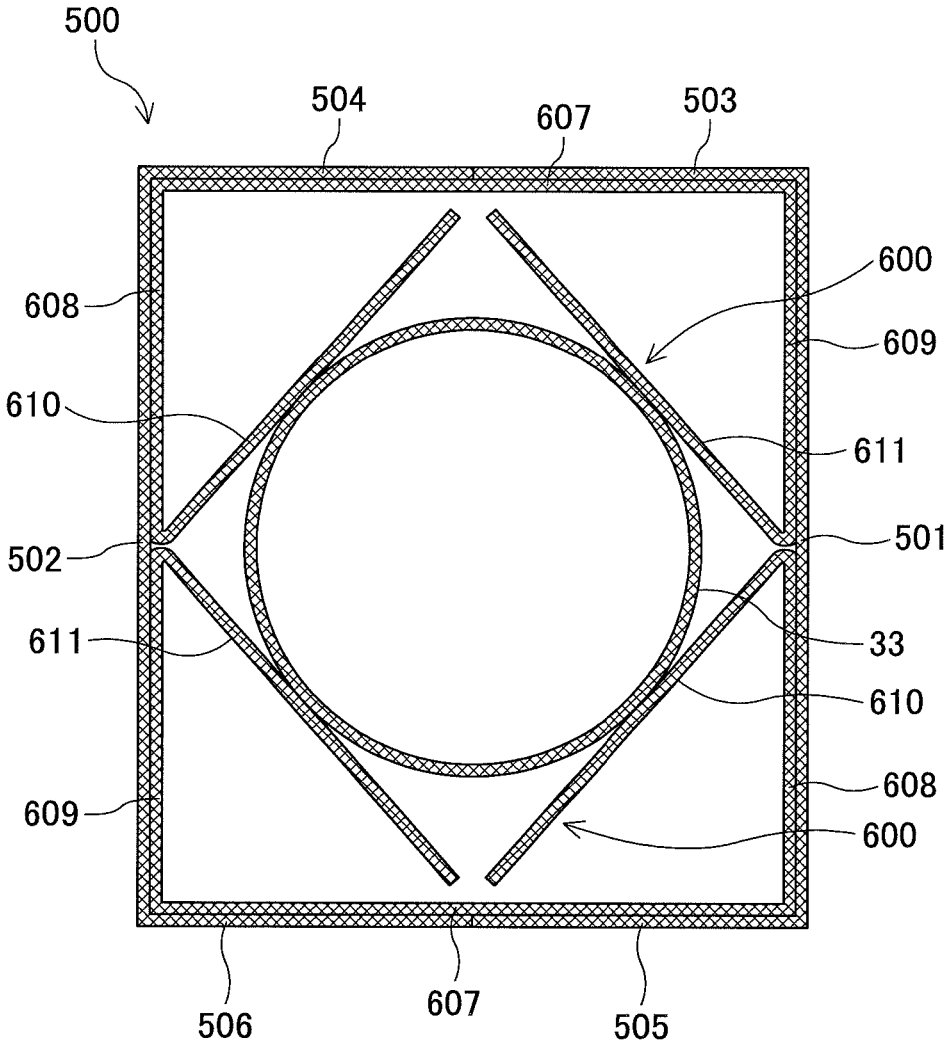
FIG. 1B shows a sectional view taken from cutting, by a cutting line F1-F2 of FIG. 26(*a*), the packaging box according to the configuration example 2 in which the toner container is packaged via the cushioning members.
Figure 39:
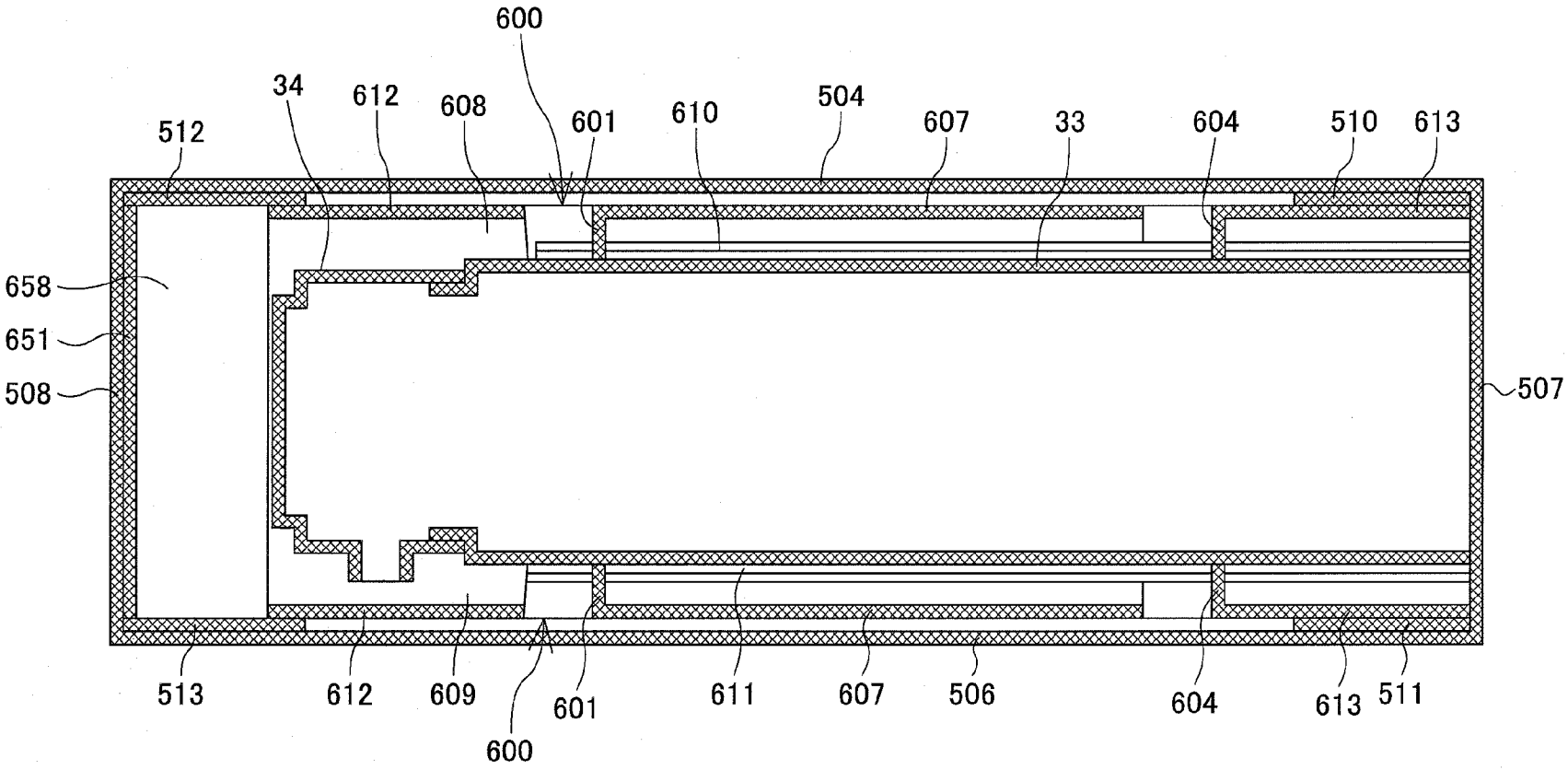
FIG. 39 shows a sectional view taken from cutting, by a D1-D2 line in FIG. 26(*c*), the packaging box in which the toner container is packaged via the cushioning members.
Figure 40:
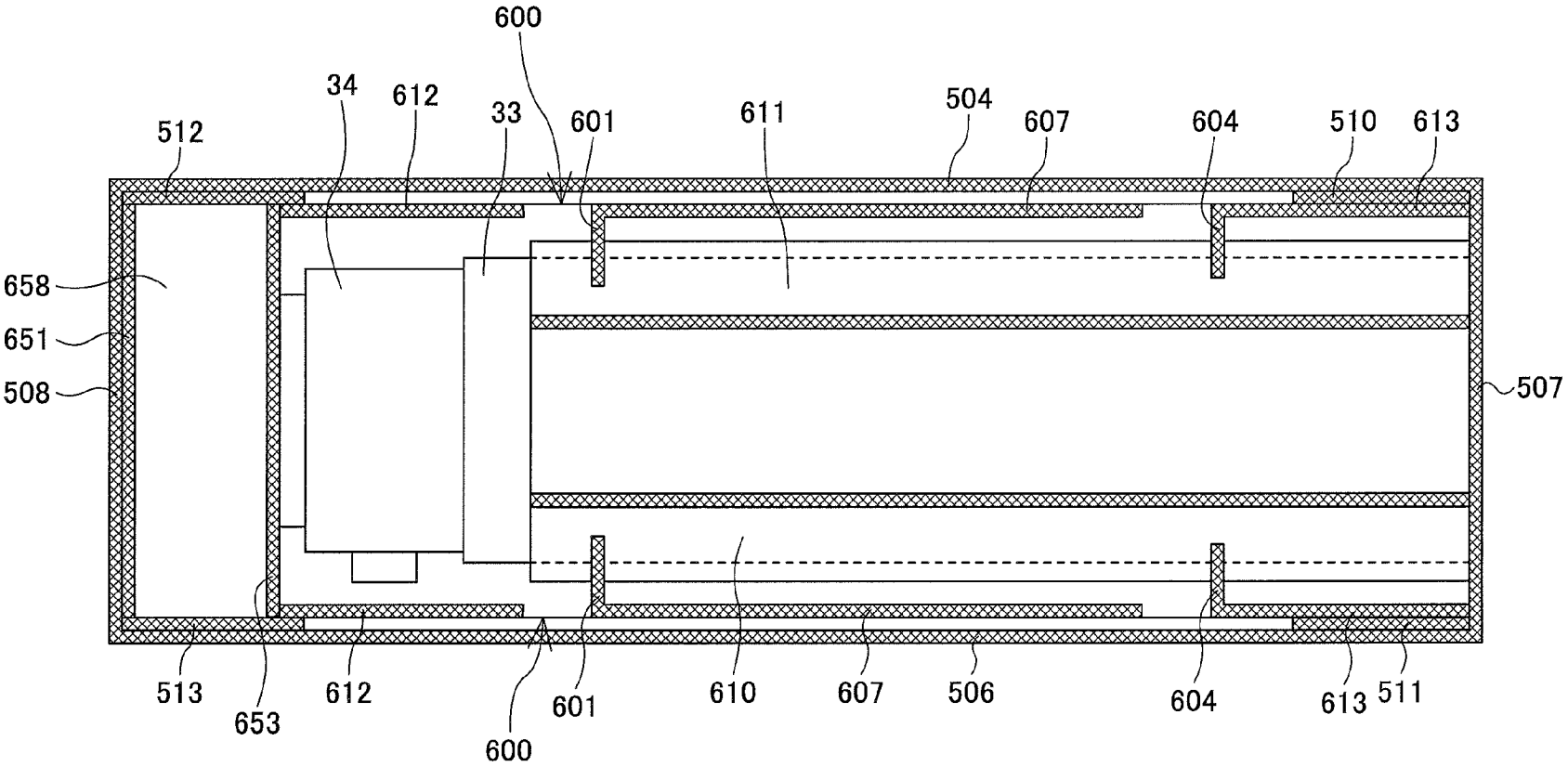
FIG. 40 shows a sectional view taken from cutting, by a D3-D4 line in FIG. 26(*c*), the packaging box in which the toner container is packaged via the cushioning members.

FIG. 39 shows a sectional view taken from cutting, by a D1-D2 line in FIG. 26(*c*), the packaging box 500 in which the toner container 32 is packaged via the cushioning members 600. FIG. 40 shows a sectional view taken from cutting, by a D3-D4 line in FIG. 26(*c*), the packaging box 500 in which the toner container 32 is packaged via the cushioning members 600. FIG. 1A shows a sectional view taken from cutting, by a cutting line E1-E2 of FIG. 26(*a*), the packaging box 500 in which the toner container 32 is packaged via cushioning members 600. FIG. 1B shows a sectional view taken from cutting, by a cutting line F1-F2 of FIG. 26(*a*), the packaging box 500 in which the toner container 32 is packaged via the cushioning members 600. It is noted that the alternate long and two short dashed lines in FIG. 1A indicate imaginary lines.

As a result of the toner container 32 being packaged into the packaging box 500 via the cushioning members 600 as described above, the bottle cap 34 of the toner container 32 is suspended in the space without coming into contact with the cushioning members 600 as shown in FIG. 1A. That is, as shown in FIG. 1B, the toner container 32 is contained in the packaging box 500 in a state where only the container body 33 is held by the cushioning members 600. Further, between the holder 34*c* of the bottle cap 34 which is a projection part most projecting and the inner wall surface of the packaging box 500, a space is provided having a size such that even if a shock is given from the outside as a result of the packaging box 500 being dropped, the holder 34*c* of the bottle cap 34 is prevented from coming into contact with the inner wall surface of the packaging box 500 via the wall part 612 of the cushioning member 600.

Thus, by packaging the toner container 32 in the packaging box 500, the bottle cap 34 is suspended in the space without coming into contact with the cushioning members 600. Therefore, even when a shock is given to the packaging box 500 from the outside, the shock does not directly transmit to the bottle cap 34 from the cushioning members 600 or the packaging box 500. Therefore, it is possible to prevent such a force that the axial line of the bottle cap 34 is inclined from the axial line of the container body 33 from being applied to the bottle cap 34. Therefore, it is possible to avoid a situation in which the sealing member inserted between the container body 33 and the bottle cap 34 is shifted, a gap is created between the container body 33 and the bottle cap 34, and the toner leaks through the gap.

<Experiment>

Based on JIS Z 0202 "Method of drop test for packaged freights", a drop test was carried out where a RICOH Pro toner C900 as the toner container 32 was contained in the packaging box 500 via the cushioning members 600 according to the configuration example 2. The RICOH Pro toner C900 has a total weight of 3 kg, and the corrugated paper was made of BF 220/150. The drop test was carried out in a manner of 1-corner, 3-ridge, 6-face free fall from 90 cm onto a concrete floor. As a result of the experiment, no damage was discovered in the parts such as the container body 33, the bottle cap 34 and so forth, and also no leakage of the toner from the toner container 32 was discovered.

Figure 41:
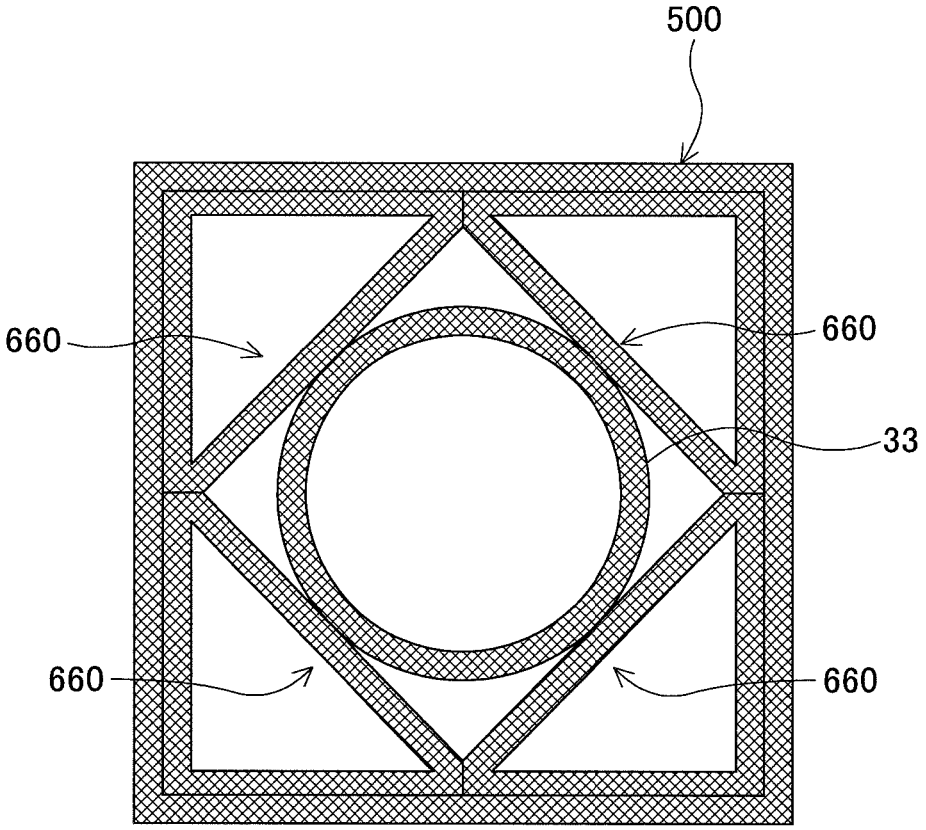
FIG. 41 is a sectional view taken from cutting, in a direction perpendicular to the axial direction of the container body at the position of the container body, the packaging box in which the container body of the toner container is sandwiched from the top and bottom directions by four cushioning members having the same shapes.

FIG. 41 is a sectional view taken from cutting, by a F1-F2 cutting line of FIG. 26(*a*), the packaging box 500 in which four cushioning members 660 having the same shapes instead of the cushioning members 600 are contained and the container body 33 of the toner container 32 is sandwiched and held from the top and bottom directions by the cushioning members 660.

In the configuration example 2, the cushioning members 600 are disposed separately into the two parts, i.e., the top part and the bottom part, in the packaging members 500. However, instead, as shown in FIG. 41, the cushioning members 660 which are separate from the packaging box 500 may be disposed separately into the four parts, i.e., the top right part, the top left part, the bottom right part and the bottom left part. Then, as a result of the toner container 32 being contained in the packaging box 500 in a state where only the container body 33 of the toner container 32 is held by the cushioning members 660 and the bottle cap 34 is suspended in the space without coming into contact with the cushioning members 660, the advantages of the above-described various effects can be obtained the same as those obtained in the case of using the cushioning members 600.

Configuration Example 3

A configuration example 3 according to an embodiment of the present invention is another configuration example where a packaging box and cushioning members are separate from each other, the two cushioning members and the box containing the cushioning members are included, and thus, the three parts are included. The packaging box according to the configuration example 3 has the same as or similar to the packaging box 500 described above for the configuration example 2, and therefore, description of how to fabricate the packaging box 500, and so forth, will be omitted.

Figure 42:
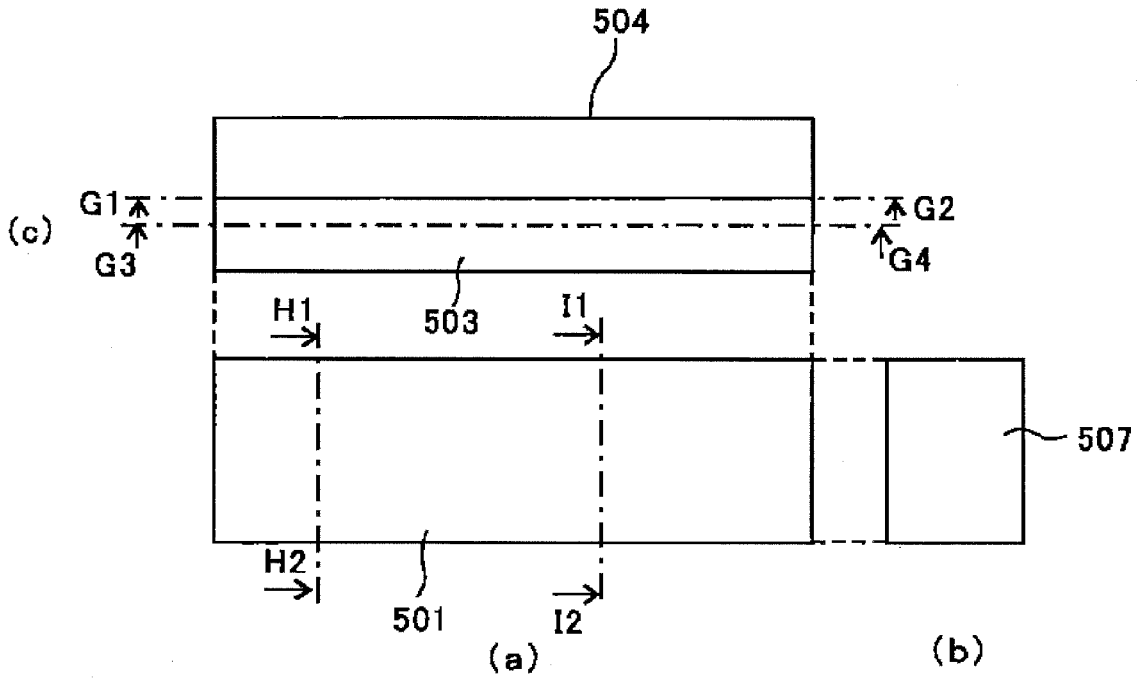
FIG. 42(*a*) shows a front view of a packaging box according to a configuration example 3 (according to an embodiment of the present invention), (*b*) shows a side view of the packaging box according to the configuration example 3, and (*c*) shows a plan view of the packaging box according to the configuration example 3.
Figure 43:
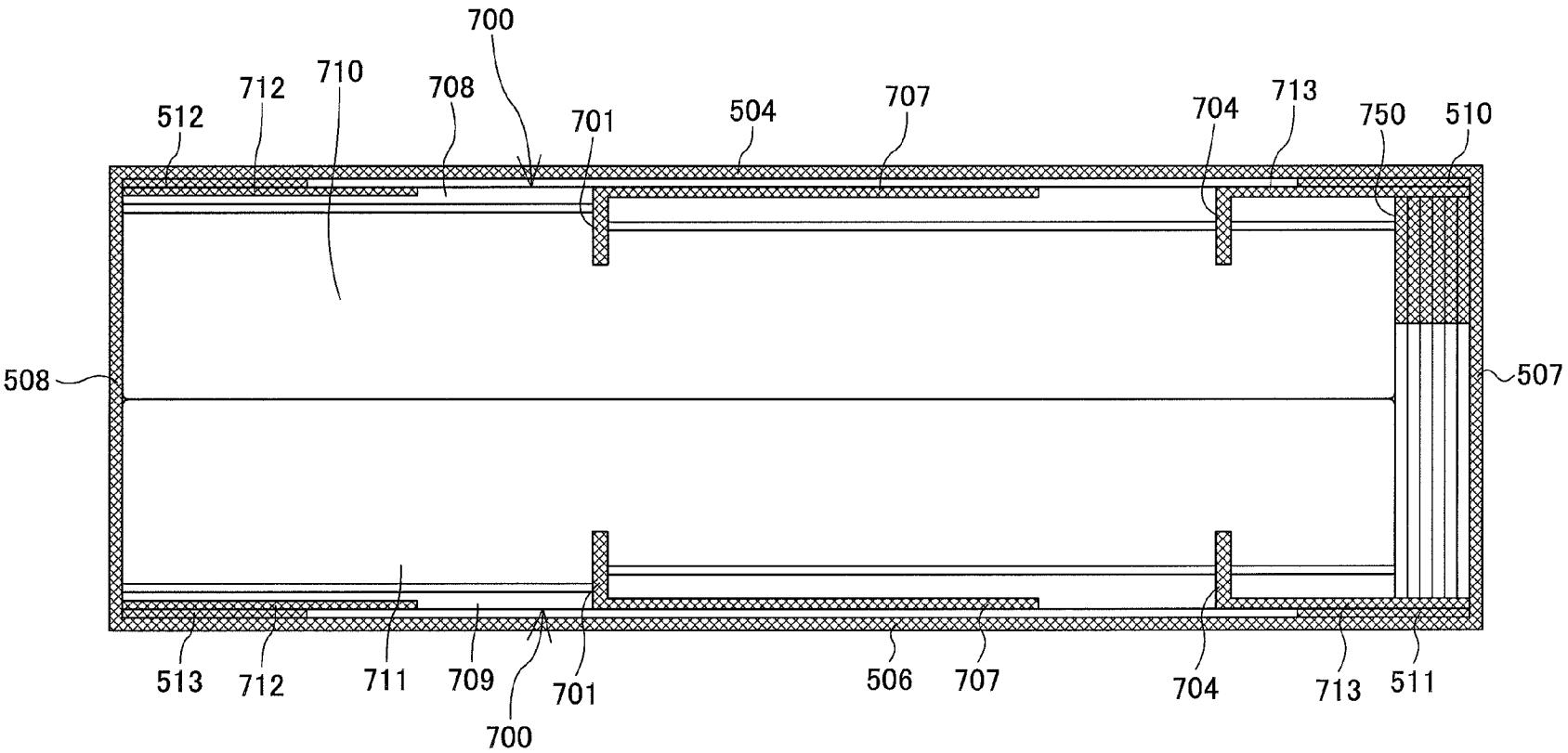
FIG. 43 is a sectional view taken from cutting, by a cutting line G1-G2 in FIG. 42(*c*), the packaging box in which cushioning members are contained and the toner container is not packaged.
Figure 44:
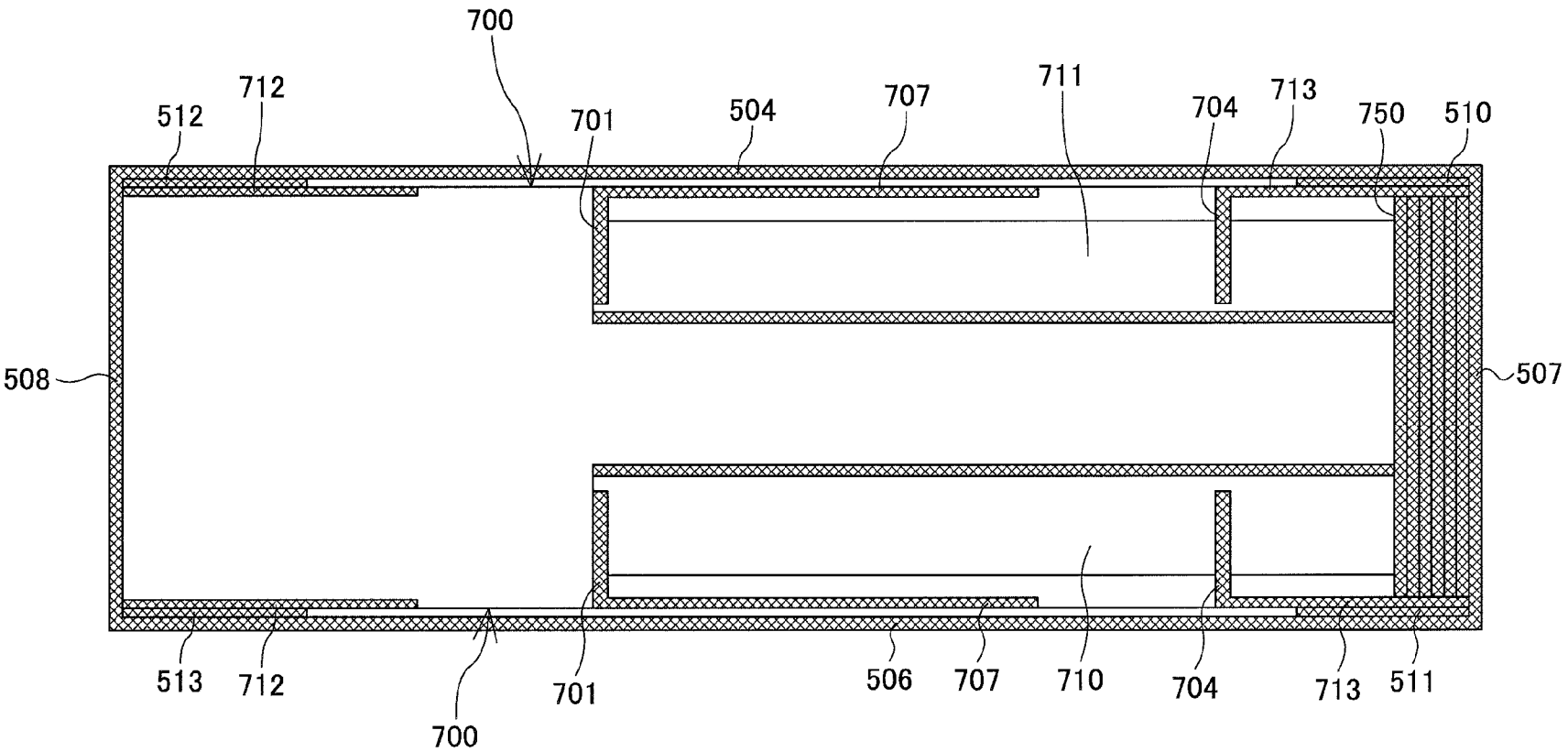
FIG. 44 is a sectional view taken from cutting, by a cutting line G3-G4 in FIG. 42(*c*), the packaging box in which the cushioning members are contained and the toner container is not packaged.
Figure 45A:
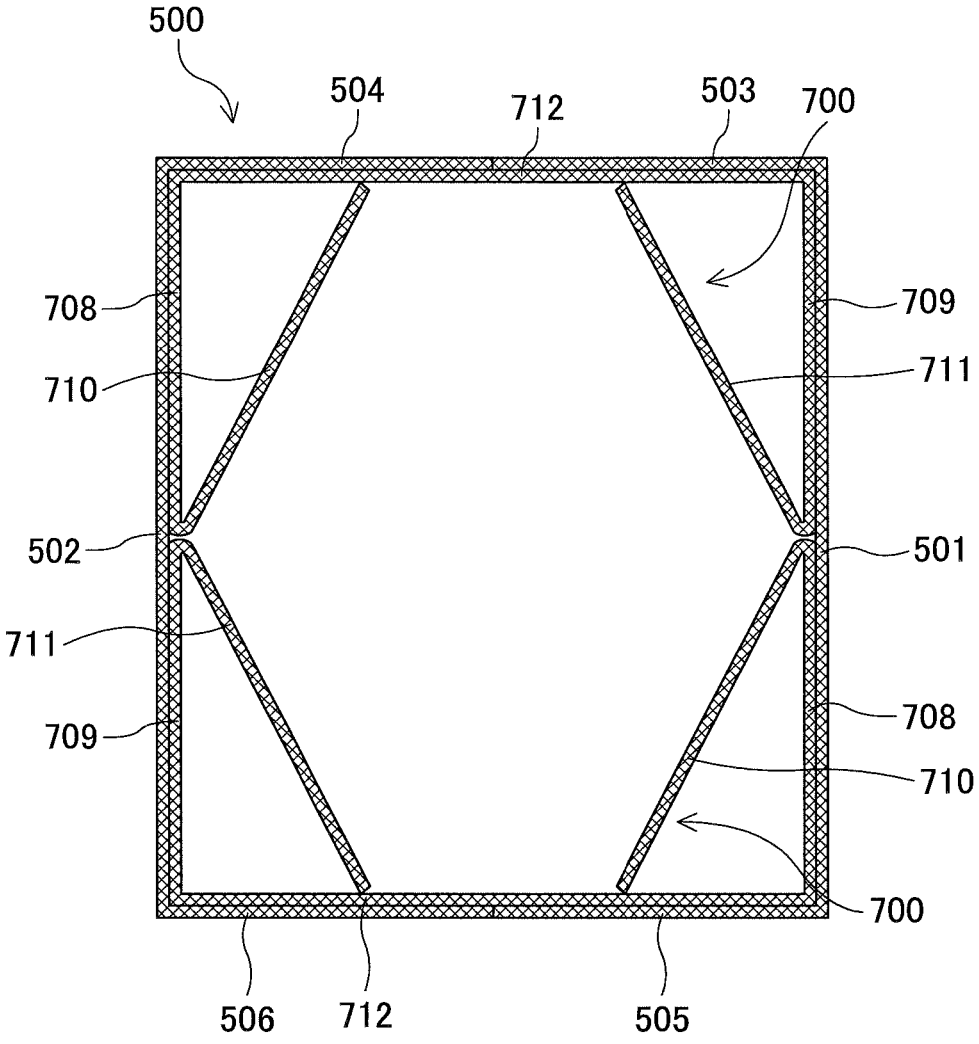
FIG. 45A shows a sectional view taken from cutting, by a cutting line H1-H2 of FIG. 42(*a*), the packaging box in which the cushioning members are contained and the toner container is not packaged.
Figure 45B:
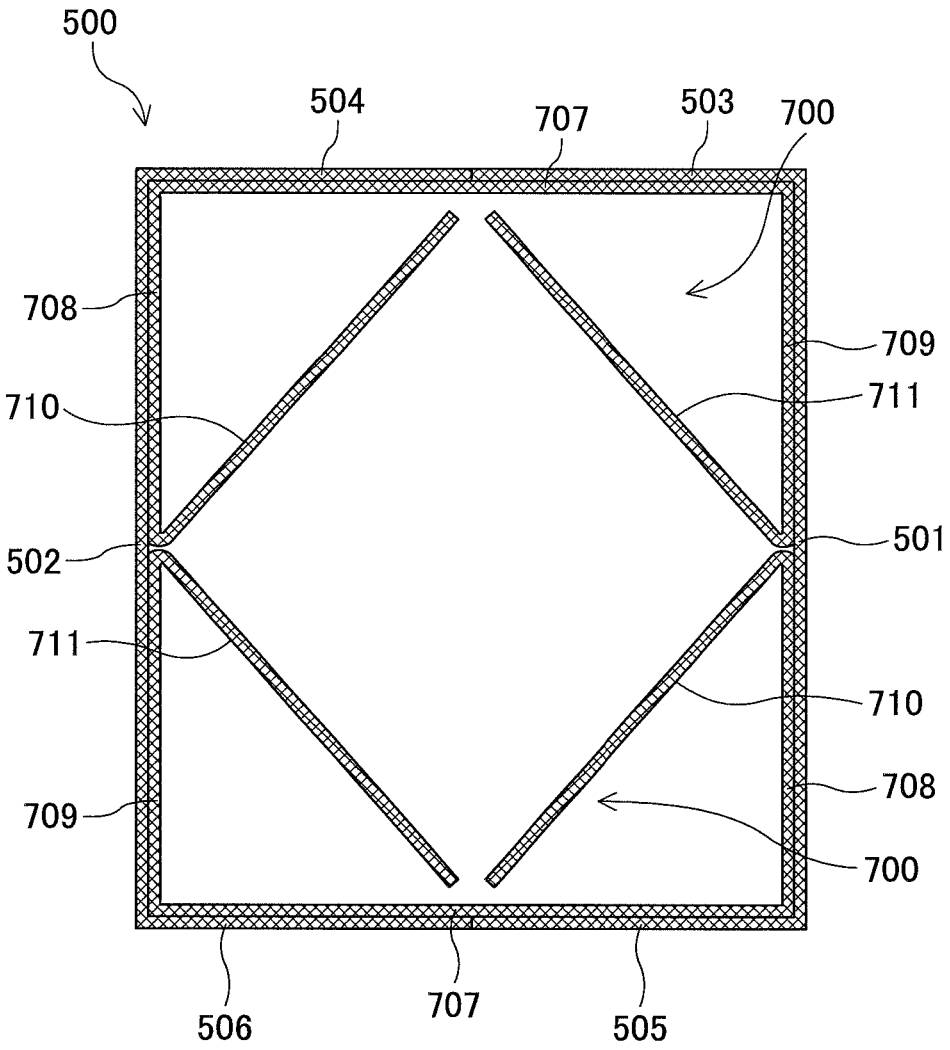
FIG. 45B shows a sectional view taken from cutting, by a cutting line I1-I2 of FIG. 42(*a*), the packaging box in which the cushioning members are contained and the toner container is not packaged.

FIG. 42(*a*) shows a front view of the packaging box 500 according to the configuration example 3, FIG. 42(*b*) shows a side view of the packaging box 500 according to the configuration example 3, and FIG. 42(*c*) shows a plan view of the packaging box 500 according to the configuration example 3;

Further, FIG. 43 is a sectional view taken from cutting, by a cutting line G1-G2 in FIG. 42(*c*), the packaging box 500 in which the cushioning members 700 are contained and the toner container 32 is not packaged. FIG. 44 is a sectional view taken from cutting, by a cutting line G3-G4 in FIG. 42(*c*), the packaging box 500 in which the cushioning members 700 are contained and the toner container 32 is not packaged. FIG. 45A shows a sectional view taken from cutting, by a cutting line H1-H2 of FIG. 42(*a*), the packaging box 500 in which the cushioning members 700 are contained and the toner container 32 is not packaged. FIG. 45B shows a sectional view taken from cutting, by a cutting line I1-I2 of FIG. 42(*a*), the packaging box 500 in which the cushioning members 700 are contained and the toner container 32 is not packaged.

Figure 46:
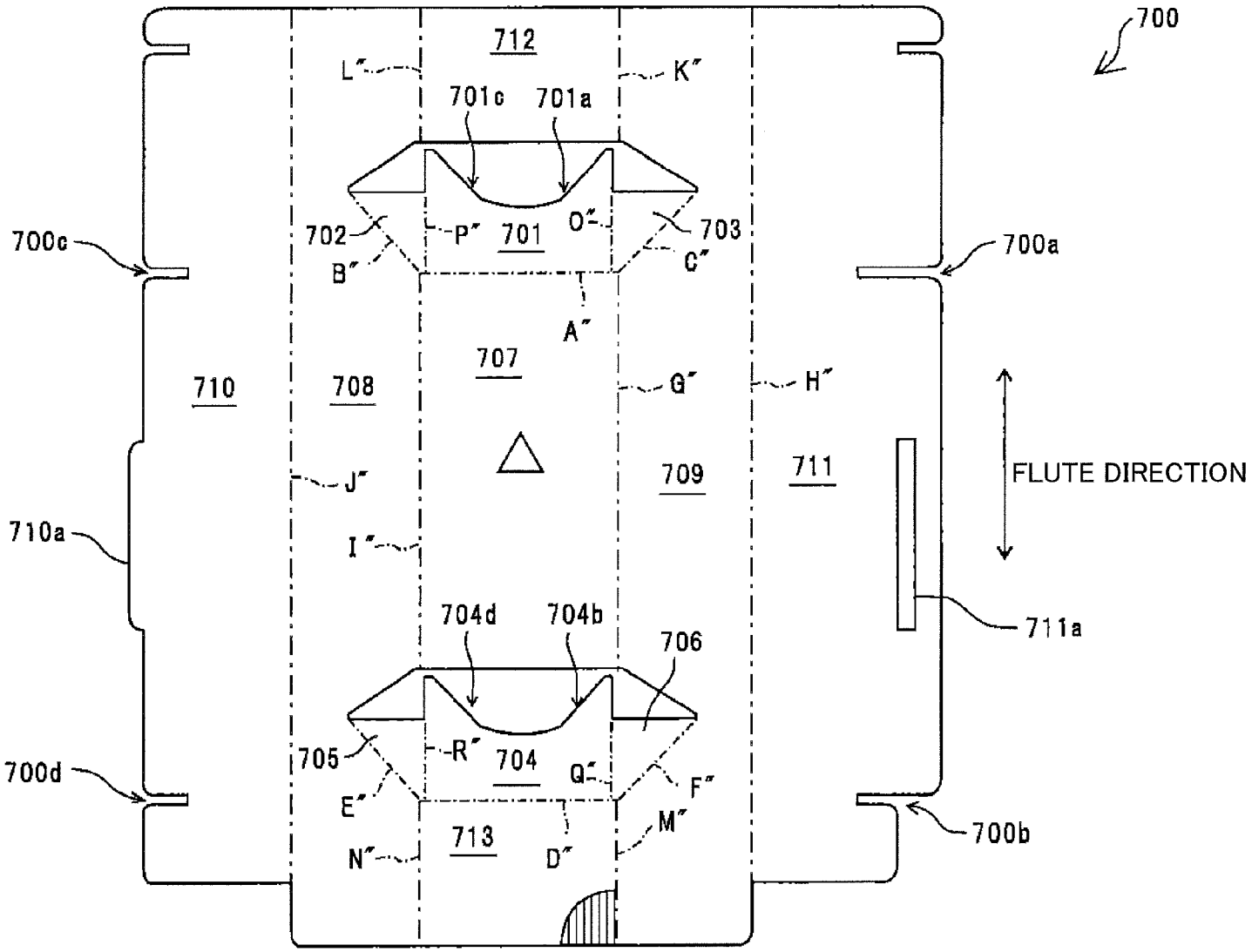
FIG. 46 shows a development of the cushioning member according to the configuration example 3.

FIG. 46 shows a development of the cushioning member 700 according to the configuration example 3. The alternative long and short dashed lines indicate crease parts for creases.

Figure 47:
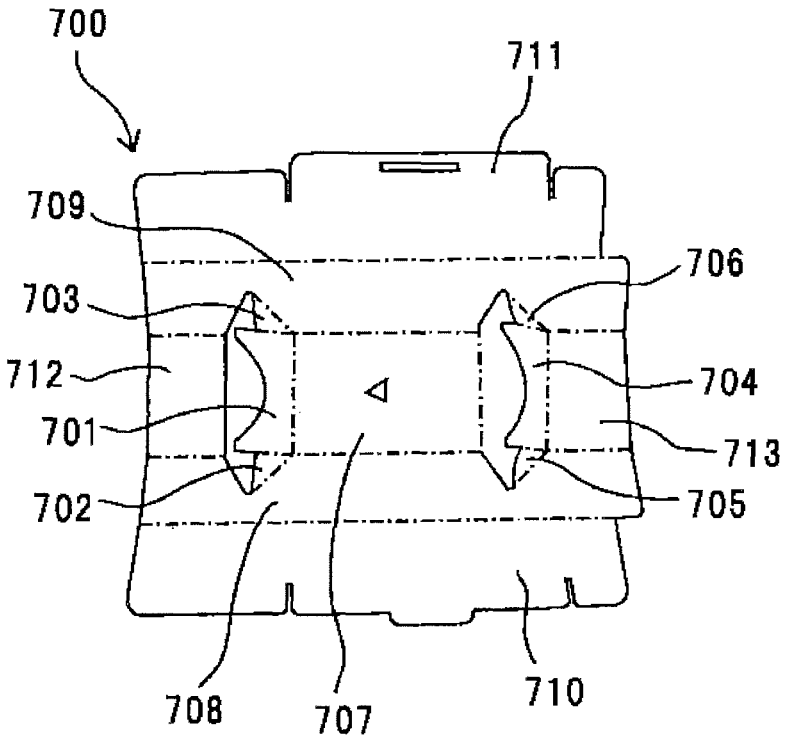
FIGS. 47 and 48 illustrate fabrication of the cushioning member.

First, wall parts 701, 702 and 703 are folded to the front side to stand up as one piece from wall parts 707 and 712 in such a manner that creases A", B" and C" are a valley fold and creases O" and P" are a mountain fold. Similarly, wall parts 704, 705 and 706 are folded to the front side to stand up as one piece from wall parts 707 and 713 in such a manner that creases D", E" and F" are a valley fold and creases Q" and R" are a mountain fold. FIG. 47 shows a state of the cushioning member 700 obtained from these folding operations.

Figure 48:
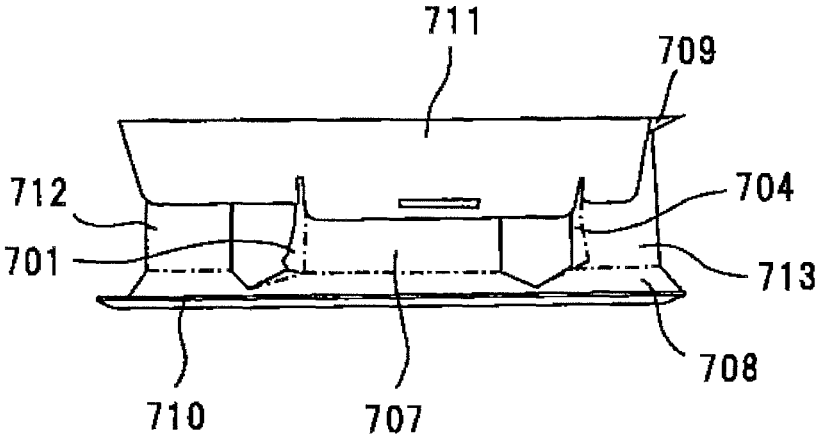
Figure 49:
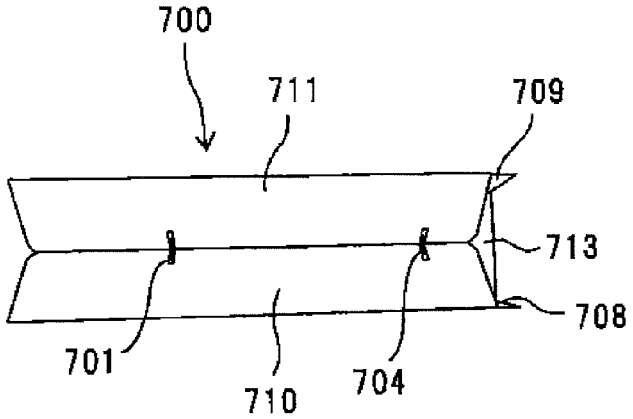
FIG. 49 is a schematic diagram showing the cushioning member after fabrication is finished.

Next, wall parts 709 and 711 are folded in such a manner that creases G", K", M" and H" are a valley fold, a cut 700*a* of the wall part 711 is fitted to a fitting part 701*a* of the wall part 701, a cut 700*b* of the wall part 711 is fitted to a fitting part 704*b* of the wall part 704, and thus, a state shown in FIG. 48 is created. It is noted that it is preferable that the angle formed between the wall part 709 and the wall part 711 is 45°. Similarly, wall parts 708 and 710 are folded in such a manner that creases I", L", N" and J" are a valley fold, a cut 700*c* of the wall part 710 is fitted to a fitting part 701*c* of the wall part 701, a cut 700*d* of the wall part 710 is fitted to a fitting part 704*d* of the wall part 704, further, an insert part 710*a* of the wall part 710 is inserted into an opening 711*a* of the wall part 711, and thus, a state shown in FIG. 49 is created. It is noted that it is preferable that the angle formed between the wall part 708 and the wall part 710 is 45°.

Figure 50:
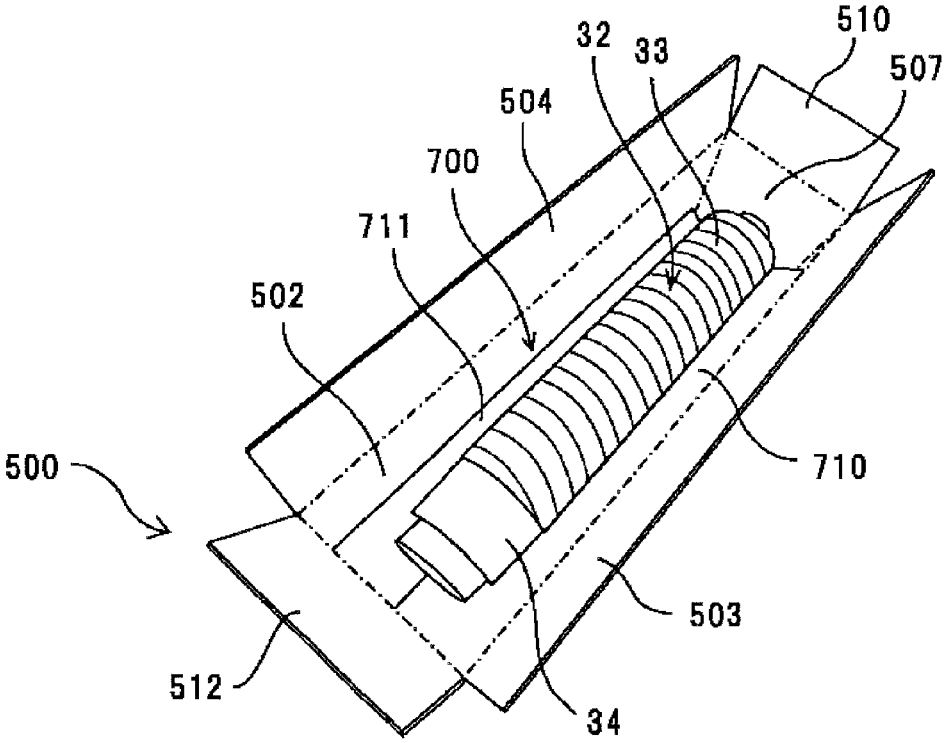
FIG. 50 shows a state where the container body of the toner container is placed on the cushioning member incorporated in the packaging box.
Figure 51:
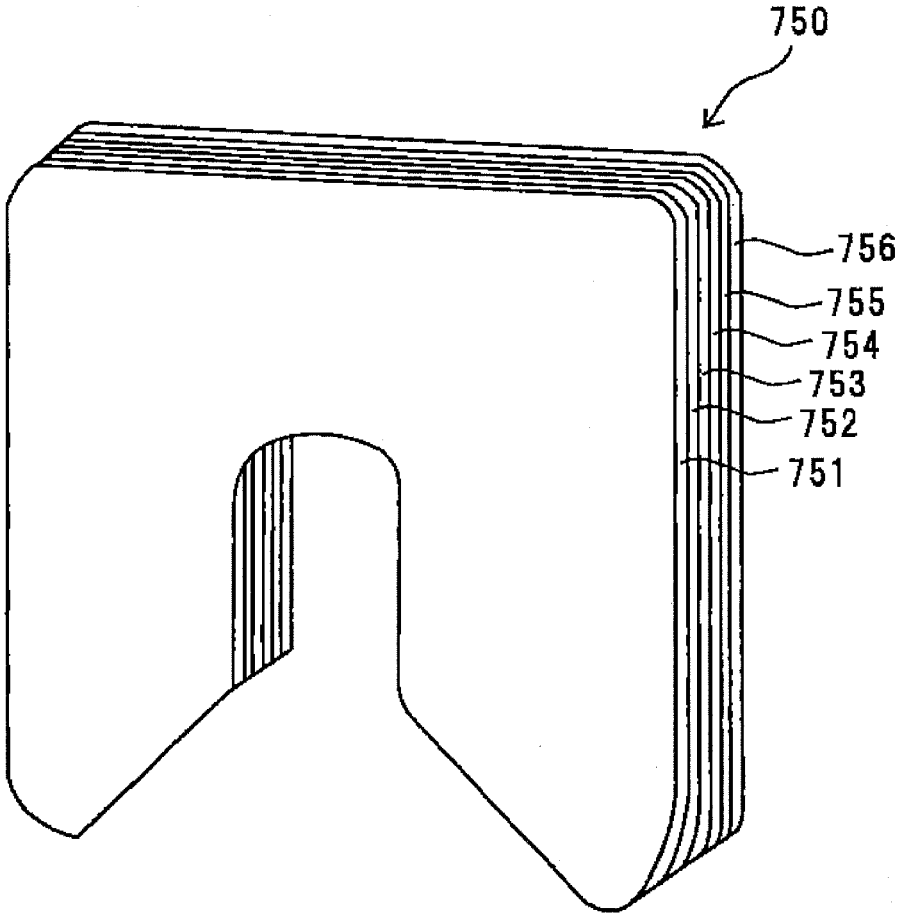
FIG. 51 shows a perspective view of a U-shaped pad to be fitted to a gripping part provided at a rear end part of the container body.
Figure 52:
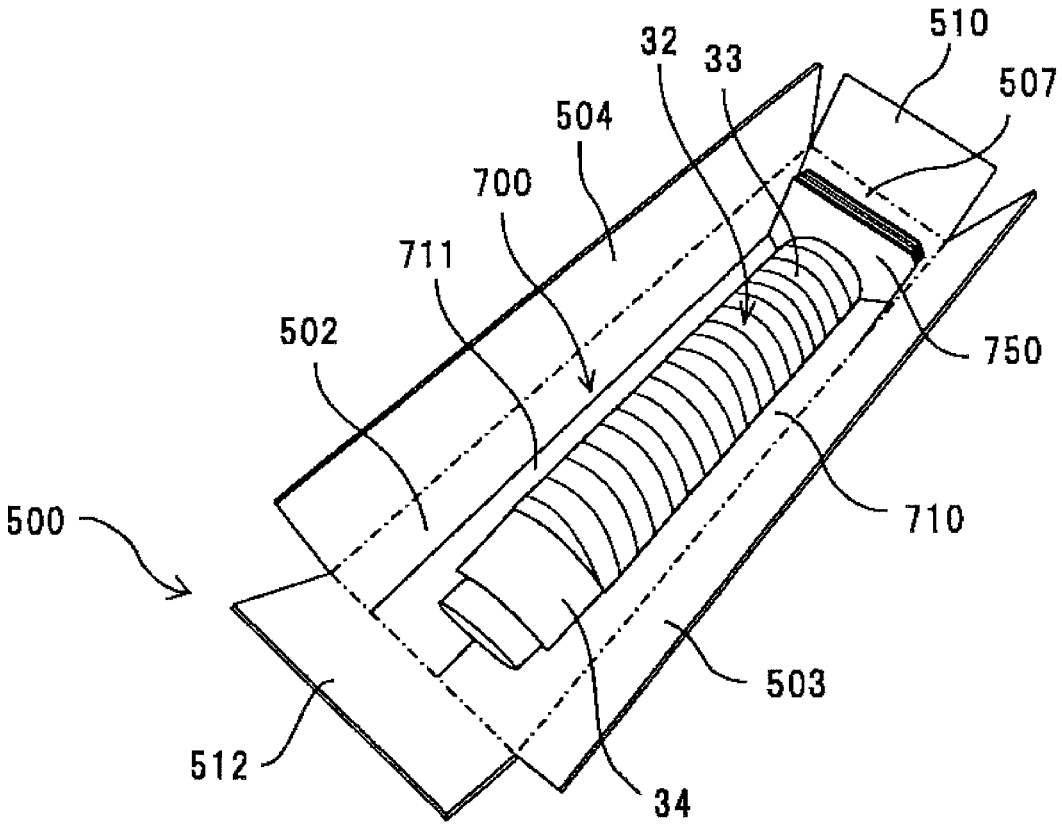
FIG. 52 shows a state where the U-shaped pad to be fitted to the gripping part provided at the rear end part of the container body is fitted.

The cushioning member 700 thus fabricated is incorporated into the packaging box 500 as shown in FIG. 50, and the toner container 32 is set on the cushioning member 700 in the packaging box 500 in such a manner that the container body 33 of the toner container 32 is placed on the respective faces of the wall parts 710 and 711. At this time, a pad 750 having a U-shape shown in FIG. 51 is fitted to the gripping part 33*d* provided at the rear end of the container body 33 of the toner container 32, and as shown in FIG. 52, movements of the toner container 32 in the axial directions in the packaging box 500 are restricted.

Figure 53:
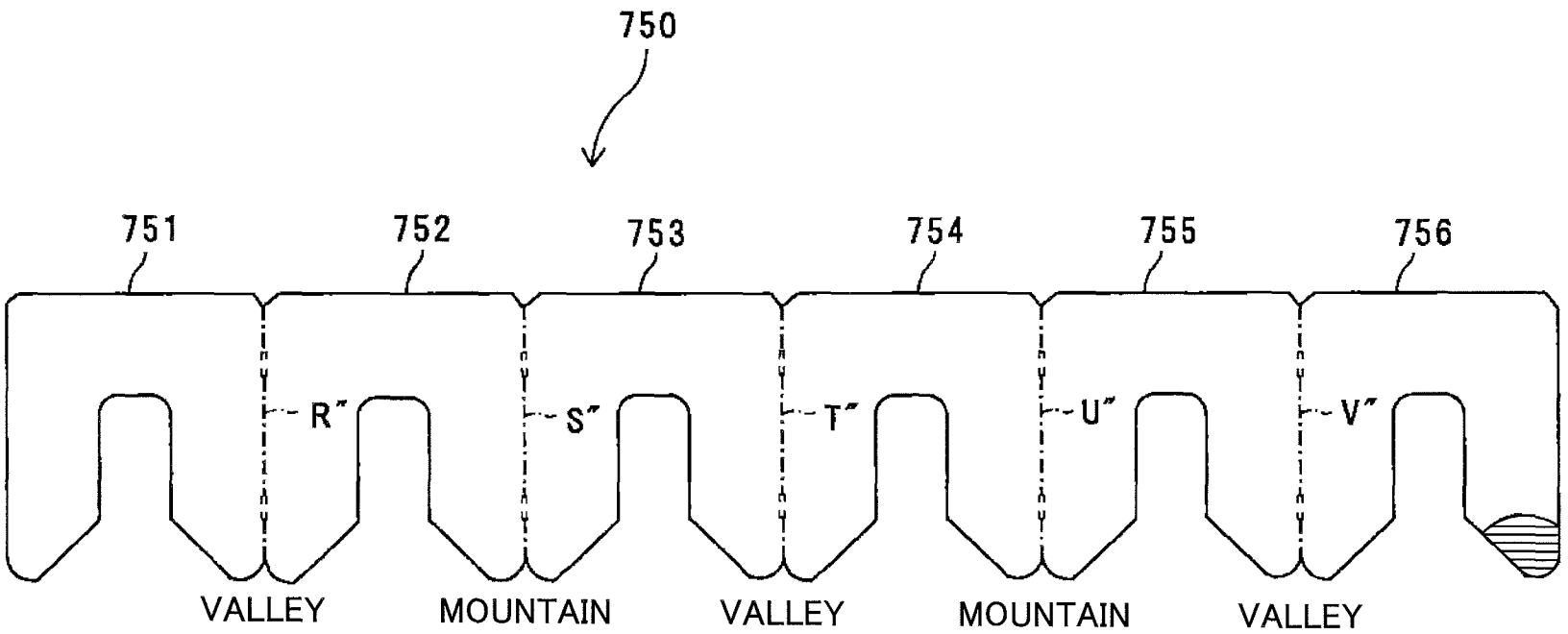
FIG. 53 shows a development of the U-shaped pad to be fitted to the gripping part provided at the rear end part of the container body.

FIG. 53 shows a development of the pad 750, and the alternate long and short dashed lines indicate crease parts for creases. The pad 750 is fabricated as a result of respective side wall parts are superposed together. That is, a crease R" is folded in a valley fold so that a side wall parts 751 and 752 are superposed together. Next, a crease S" is folded in a mountain fold so that the side wall parts 752 and 753 are superposed together. Next, a crease T" is folded in a valley fold so that the side wall parts 753 and 754 are superposed together. Next, a crease U" is folded in a mountain fold so that the side wall parts 754 and 755 are superposed together. Finally, a crease V" is folded so that the side wall parts 755 and 756 are superposed together. Thus, a valley fold and a mountain fold are repeated alternately and the folding operations are carried out so that the respective side wall parts are superposed together. Thus, the fabrication of the pad 750 is completed.

Figure 54:
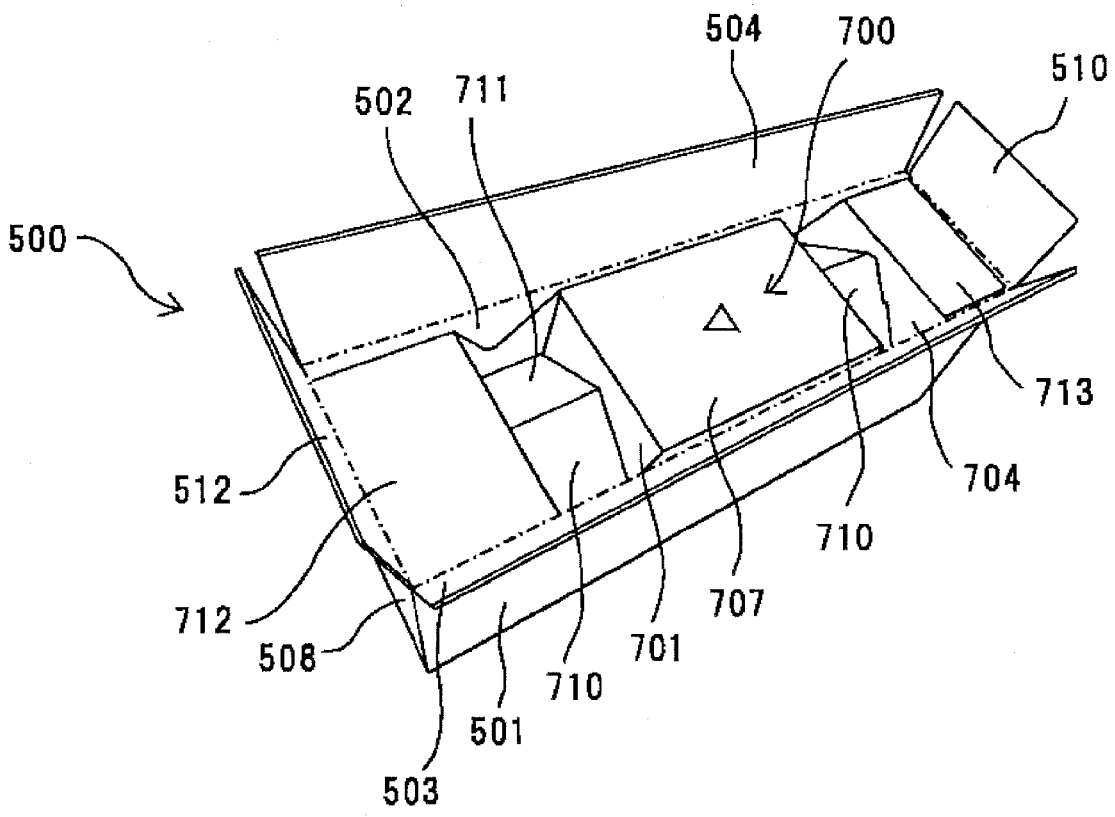
FIG. 54 shows a state where the toner container is sandwiched by two cushioning members from the top and bottom directions in the inside of the packaging box.

Then, on the toner container 32 having been thus set on the cushioning member 700 in the packaging box 500, another cushioning member 700 is placed. Then, as shown in FIG. 54, a state where the toner container 32 is sandwiched by the cushioning members 700 from the top and bottom directions in the packaging box 500 is created, the inner upper flaps 510, 512 and the outer upper flaps 503, 504 are closed, and thus, packaging is completed.

Figure 55:
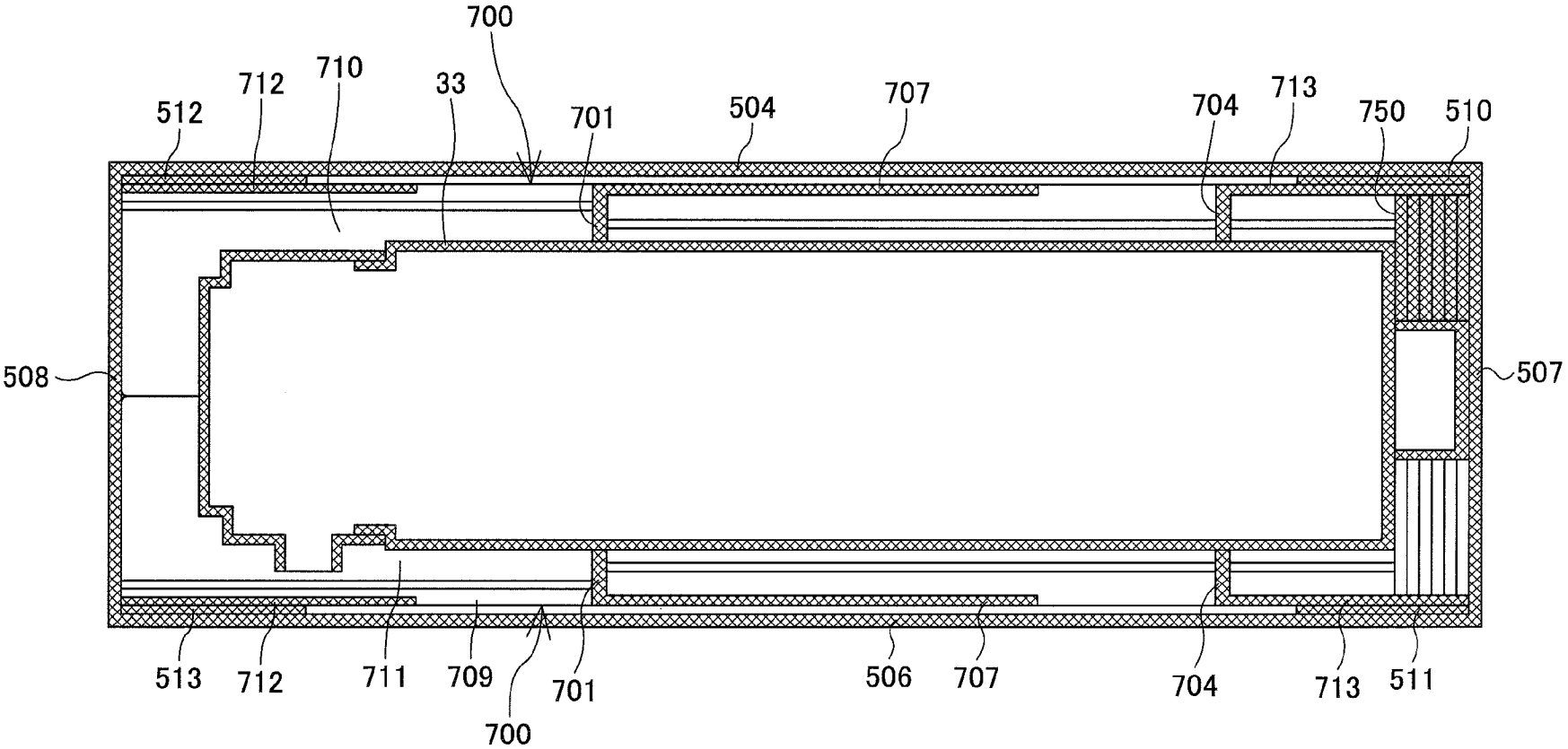
FIG. 55 shows a sectional view taken from cutting, by a G1-G2 line in FIG. 42(*c*), the packaging box in which the toner container is packaged via the cushioning members.
Figure 56:
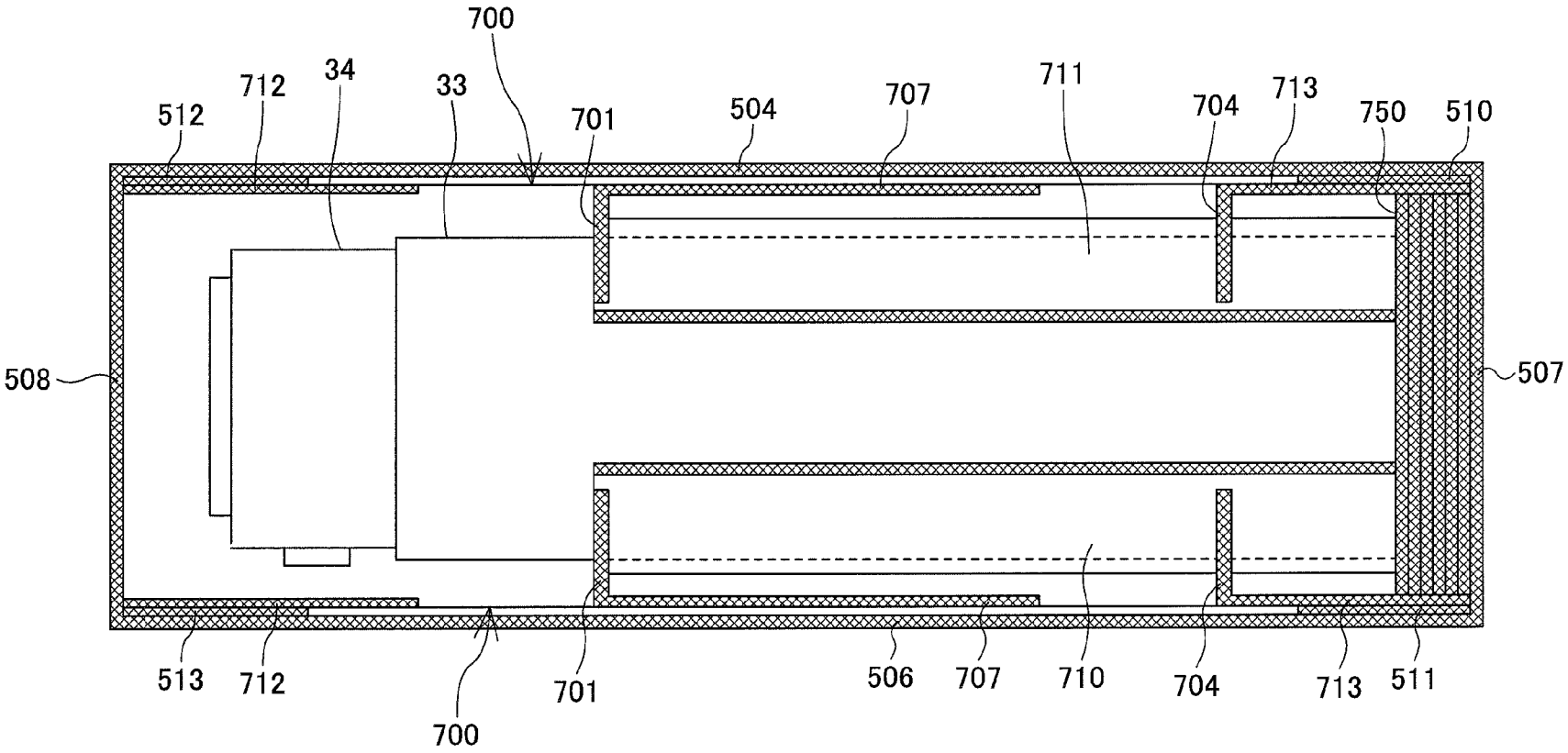
FIG. 56 shows a sectional view taken from cutting, by a G3-G4 line in FIG. 42(*c*), the packaging box in which the toner container is packaged via the cushioning members.
Figure 57A:
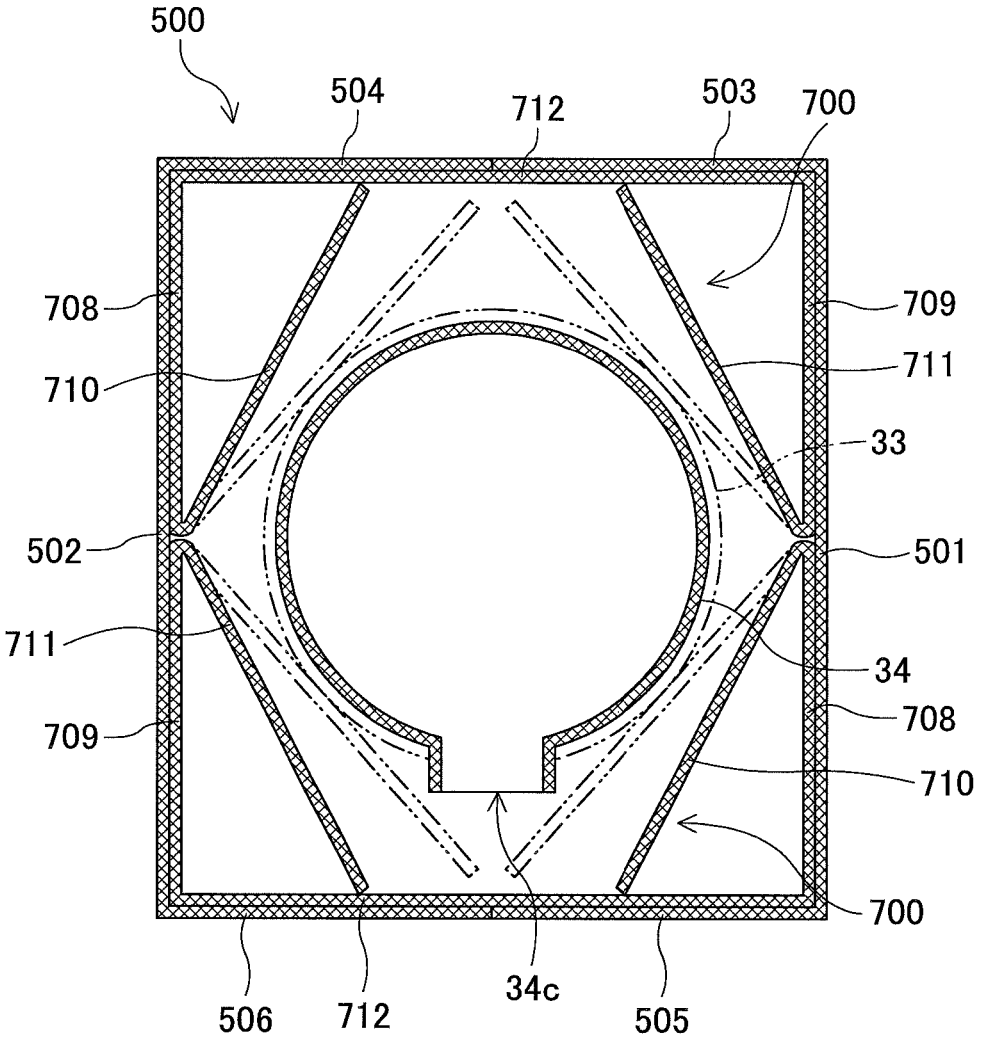
FIG. 57A shows a sectional view taken from cutting, by a cutting line H1-H2 of FIG. 42(*a*), the packaging box in which the toner container is packaged via the cushioning members.
Figure 57B:
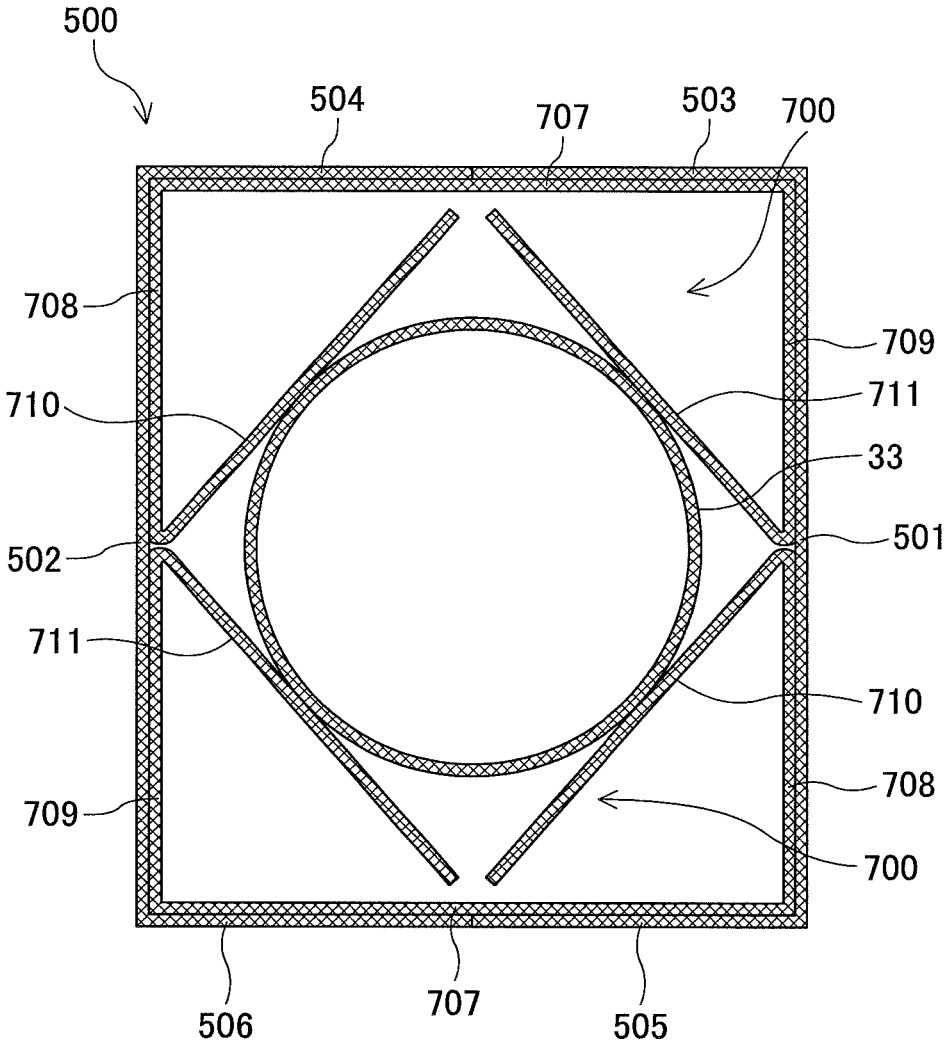
FIG. 57B shows a sectional view taken from cutting, by a cutting line I1-I2 of FIG. 42(*a*), the packaging box in which the toner container is packaged via the cushioning members.

FIG. 55 shows a sectional view taken from cutting, by a G1-G2 line in FIG. 42(*c*), the packaging box 500 in which the toner container 32 is packaged via the cushioning members 700. FIG. 56 shows a sectional view taken from cutting, by a G3-G4 line in FIG. 42(*c*), the packaging box 500 in which the toner container 32 is packaged via the cushioning members 700. FIG. 57A shows a sectional view taken from cutting, by a cutting line H1-H2 of FIG. 42(*a*), the packaging box 500 in which the toner container 32 is packaged via cushioning members 700. FIG. 57B shows a sectional view taken from cutting, by a cutting line I1-I2 of FIG. 42(*a*), the packaging box 500 in which the toner container 32 is packaged via the cushioning members 700. It is noted that the alternate long and two short dashed lines in FIG. 57A indicate imaginary lines.

As a result of the toner container 32 being packaged into the packaging box 500 via the cushioning members 700 as described above, the bottle cap 34 of the toner box 32 is in a state of suspended in the space without coming into contact with the cushioning members 700 as shown in FIG. 57A. That is, as shown in FIG. 57B, the toner container 32 is contained in the packaging box 500 in a state where only the container body 33 is held by the cushioning members 700. Further, between the holder 34*c* of the bottle cap 34 which is a projection part most projecting and the inner wall surface of the packaging box 500, a space is provided having a size such that even if a shock or such is given from the outside as a result of the packaging box 500 being dropped, the holder 34*c* of the bottle cap 34 is prevented from coming into contact with the inner wall surface of the packaging box 500 via the wall part 712 of the cushioning member 700.

Since the bottle cap 34 is suspended in the space without coming into contact with the cushioning members 700, even when a shock is given to the packaging box 500 from the outside, the shock does not directly transmit to the bottle cap 34 from the cushioning members 700 or the packaging box 500. Therefore, it is possible to prevent such a force that the axial line of the bottle cap 34 is inclined from the axial line of the container body 33 from being applied to the bottle cap 34. Therefore, it is possible to avoid a situation in which the packing 370 as the sealing member inserted between the container body 33 and the bottle cap 34 is shifted, a gap is created between the container body 33 and the bottle cap 34, and the toner leaks through the gap.

Variant Embodiment

Figure 58:
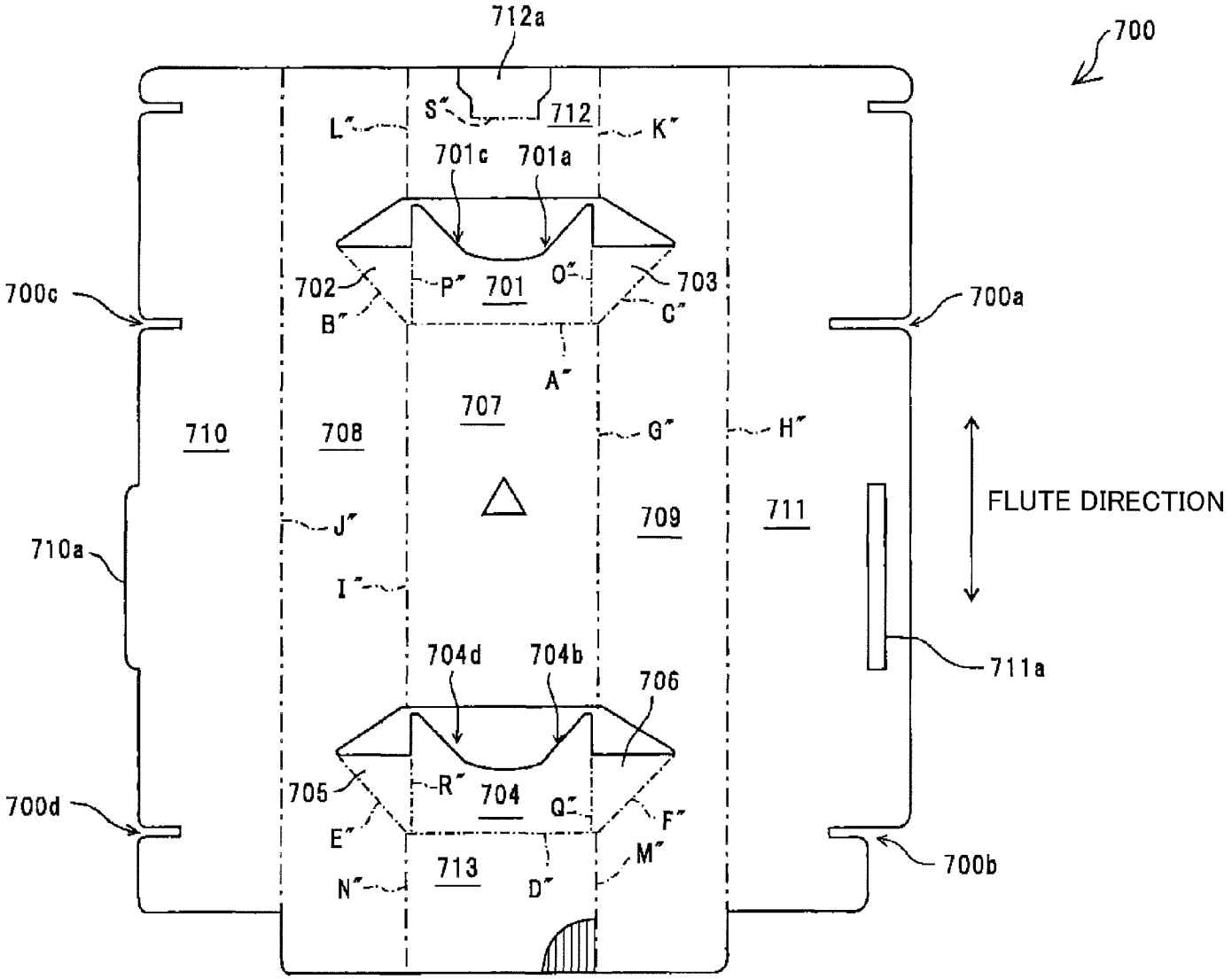
FIG. 58 shows a development of a cushioning member according to a variant embodiment of the present invention.
Figure 59A:
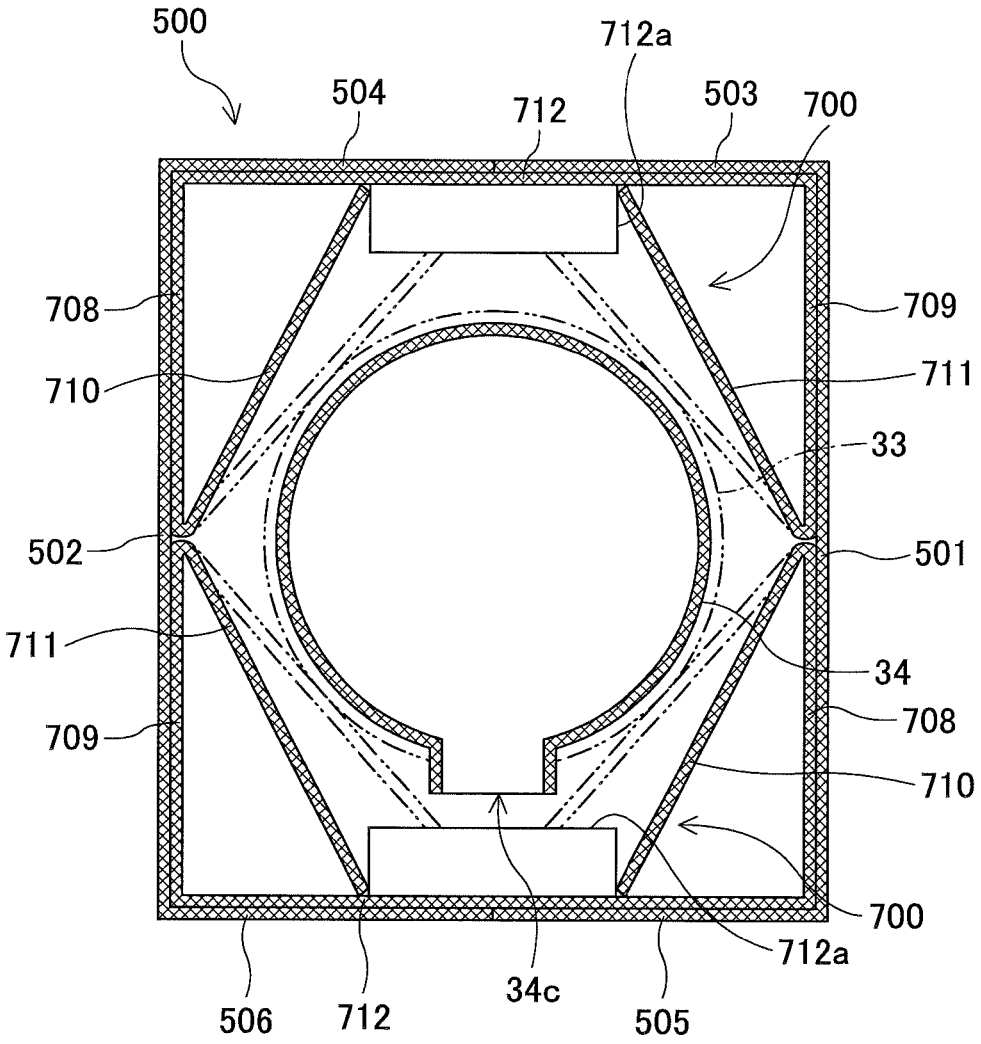
FIG. 59A shows a sectional view taken from cutting, by a cutting line H1-H2 of FIG. 42(*a*), the packaging box in which the toner container is packaged via the cushioning members according to the variant embodiment.
Figure 59B:
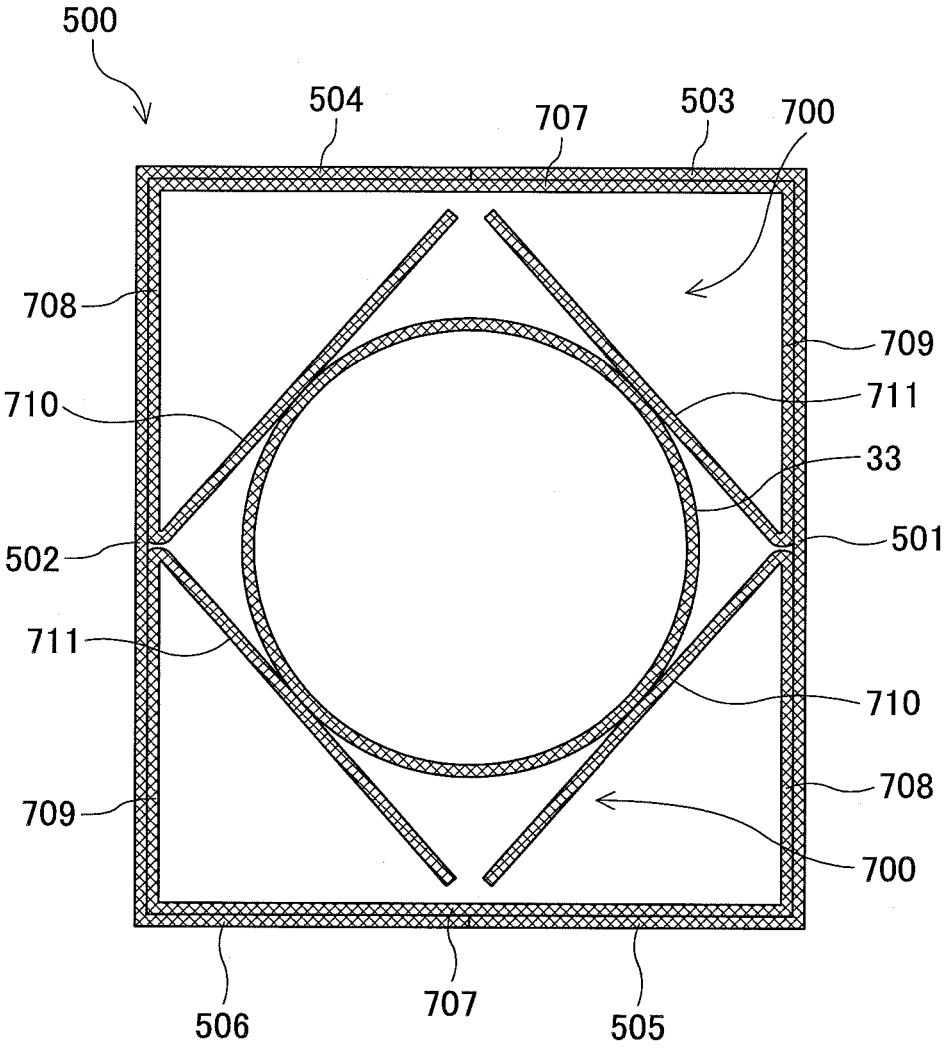
FIG. 59B shows a sectional view taken from cutting, by a cutting line I1-I2 of FIG. 42(*a*), the packaging box in which the toner container is packaged via the cushioning members according to the variant embodiment.

FIG. 58 shows a development of a cushioning member 700 according to a variant embodiment of the present invention. FIG. 59A shows a sectional view taken from cutting, by a cutting line H1-H2 of FIG. 42(*a*), the packaging box 500 in which the toner container 32 is packaged via the cushioning members 700 according to the variant embodiment. FIG. 59B shows a sectional view taken from cutting, by a cutting line I1-I2 of FIG. 42(*a*), the packaging box 500 in which the toner container 32 is packaged via the cushioning members 700 according to the variant embodiment. It is noted that the alternate long and two short dashed lines in FIG. 59A indicate imaginary lines.

As the cushioning members 700 according to the variant embodiment, as shown in FIG. 58, a standing up part 712*a* may be provided at the center on an end of the wall part 712 in a longitudinal direction of the cushioning member 700, the standing up part 712 standing up as a result of a crease S" being fold in a valley fold. By thus providing the standing up part 712*a* to the wall part 712, it is possible that the flaps 710 and 711 come into contact with both ends of the standing up part 712*a*, respectively, as shown in FIG. 59A, and movements of the flaps 710 and 711 to approach the bottle cap 34 are restricted. By thus restricting the movements of the flaps 710 and 711 by the standing up part 712*a*, it is more possible to positively prevent the bottle cap 34 and the cushioning members 700 from coming into contact with one another. Therefore, it is more possible to positively prevent a shock from directly transmitting to the bottle cap 34 from the cushioning members 700, and also, it is possible to avoid a situation in which the flaps 710, 711 of the cushioning members 700 and the bottle cap 34 rub against each other and the flaps 710, 711 of the cushioning members 700 and/or the bottle cap 34 are/is damaged.

<Experiment>

Based on JIS Z 0202 "Method of drop test for packaged freights", a RICOH Pro toner C900 as the toner container 32 was contained in the packaging box 500 via the cushioning members 700 according to the variant embodiment, and a drop test was carried out. The RICOH Pro toner C900 has a total weight of 3 kg, and the corrugated paper is made of BF 220/150. The drop test was carried out in a manner of 1-corner, 3-ridge, 6-face free fall from 90 cm, onto a concrete floor. As a result of the experiment, no damage was discovered in the parts such as the container body 33, the bottle cap 34 and so forth, and also no leakage of the toner from the toner container 32 was discovered.

Thus, according to the embodiments of the present invention described above, in the packaging box 400 or 500 as a packaging member (hereinafter, simply referred to as a packaging box), a cushioning member(s) (i.e., the above-mentioned upper cushioning wall parts 406A, 406B, lower cushioning wall parts 406C, 406D, cushioning member 600 or 700, or such) is provided which does not come into contact with the bottle cap 34, which is a predetermined part of the toner container 32, which is a to-be-packaged member, holds the container body 33, which is a holding part different from the predetermined part of the toner container 32, and cushions a shock transmitted to the toner container 32. Thus, the toner container 32 is packaged in the inside of the packaging box via the cushioning member(s), and thereby, a state is created where the bottle cap 34 does not come into contact with the cushioning member(s), and is suspended in the space in the packaging box. Thereby, even when a shock is given to the packaging box from the outside, it is possible to prevent the shock from directly transmitting to the bottle cap 34 from the cushioning member(s) or the packaging box.

Further, according to the embodiments of the present invention, the space is provided between the holder 34*c* and the wall surface of the packaging box, such that the holder 34*c* of the bottle cap 34, which is a projection part projecting the most, does not come into contact with the wall surface of the packaging box. Thereby, it is more possible to positively prevent such a force that the axial line of the bottle cap is inclined from the axial line of the container body from being given to the bottle cap.

Further, according to the embodiments of the present invention, the cushioning member(s) has a hollow, and as a result of the container body 33 is held in such a manner that the space is created between the container body 33 and the wall of the packaging box, a shock reaching the toner container 32 is reduced even when the shock is given to the packaging box from the outside, and thus it is possible to avoid a situation in which the toner container 32 is damaged or so.

Further, according to the embodiments of the present invention, the cushioning member(s) has a rectangular cavity formed to contain the container body 33 by the four plate-shaped members, and the ridge lines on which the adjacent ones of the four plate-shaped members intersect, respectively, are in contact with the four wall surfaces that are the top and bottom faces and both side faces of the packaging box, respectively. Thereby, the container body 33 is like suspended in the space via the spaces created between the ridge lines and the container body 33. Thereby, a shock reaching the toner container 32 is reduced even when the shock is given to the packaging box from the outside, and thus it is possible to avoid a situation in which the toner container 32 is damaged or so.

Further, according to the embodiments of the present invention, the ridge lines on which the adjacent ones of the above-mentioned four plate-shaped members intersect, respectively, are positioned preferably at approximately the centers of the four wall surfaces that are the top and bottom faces and both side faces of the packaging box, respectively.

Further, according to the embodiments of the present invention, in a method of containing and packaging the toner container 32, which is a powder receiving container including the cylindrical container body 33 and the bottle cap 34 as a cap member, via the cushioning member(s) in the inside of the packaging box, the cushioning member(s) holds the container body 33; and the toner container 32 is contained in the inside of the packaging box in a state where the bottle cap 34 different from the container body 33 is suspended in the space inside of the packaging box. Thereby, even when a shock is given to the packaging box from the outside, it is possible to prevent such a force that the axial line of the bottle cap is inclined from the axial line of the container body from being given to the bottle cap. Therefore, it is possible to avoid a situation in which the packing 370 inserted between the container body 33 and the bottle cap 34 is shifted, a gap is created between the container body 33 and the bottle cap 34, and the toner as powder leaks through the gap.

Further, according to the embodiments of the present invention, the to-be-packaged member is the toner container 32 acting as a receiving container including the container body 33 as the holding part having the toner receiving part contains the toner and the opening A as the content outlet; the bottle cap 34 as the cap member as the predetermined part fitted to the container body 34 to cover the opening A; and the packing 370 as the sealing member inserted between the container body 33 and the cap member 34. The cushioning member(s) holds the container body 33 in such a manner that the cap member 34 and the cushioning member(s) do not come into contact with one another. Thus, a state where only the container body 33 of the toner container 32 is held by the cushioning member(s) and the bottle cap 34 is suspended in the space without coming into contact with the cushioning member(s) is created. Thereby, even when a shock is given to the packaging box from the outside, it is possible to prevent such a force that the axial line of the bottle cap is inclined from the axial line of the container body from being given to the bottle cap. Therefore, it is possible to avoid a situation in which the packing 370 inserted between the container body 33 and the bottle cap 34 is shifted, a gap is created between the container body 33 and the bottle cap 34, and the toner as powder leaks through the gap.

Further, according to the embodiments of the present invention, in a method of containing and packaging the toner container 32, which is the to-be-packaged member, via the cushioning member(s) in the inside of the packaging box, the cushioning member(s) holds the container body 33 which is the holding member of the toner container 32; and the toner container 32 is contained in the inside of the packaging box in a state where the bottle cap 34 that is the predetermined part different from the container body 33 of the toner container 32 is suspended in the space inside of the packaging box. Thereby, even when a shock is given to the packaging box from the outside, it is possible to prevent the shock from directly transmitting to the bottle cap 34 from the cushioning member(s) or the packaging box, and it is possible to prevent such a force that the axial line of the bottle cap is inclined from the axial line of the container body from being given to the bottle cap. Therefore, it is possible to avoid a situation in which the packing 370 inserted between the container body 33 and the bottle cap 34 is shifted, a gap is created between the container body 33 and the bottle cap 34, and the toner as powder leaks through the gap.

It is noted that according to the embodiments of the present invention, as the to-be-packaged member, the toner container 32 is used. However, also in a case where the to-be-packaged member is other than the toner container 32, it is possible to avoid a situation in which the shape is changed and high accuracy of form can no longer be obtained or in which a precision member no longer operates properly. This is because a shock does not directly transmit to the predetermined part, as a result of only a holding part of the to-be-packaged member being held by a cushioning member(s), and the to-be-packaged member being contained in the packaging box via the cushioning member(s) in a state where a predetermined part of the to-be-packaged member such as a part required to have high accuracy of form or a part at which the precision member such as an electronic part is installed is suspended in the space in the packaging box without coming into contact with the cushioning member(s).

The present invention is not limited to the specifically disclosed embodiments, and variations and modifications may be made without departing from the scope of the present invention.

The present application is based on Japanese Priority Patent Application No. 2010-274396, filed Dec. 9, 2010, the entire contents of which are hereby incorporated herein by reference.

What is claimed is:

1. A packaging member comprising:

a cushioning member configured to hold a holding part of a to-be-packaged member different from a predetermined part of the to-be-packaged member without coming into contact with the predetermined part of the to-be-packaged member; and a wall member configured to stand in a standing direction from a bottom of the cushioning member, wherein the cushioning member is configured to cushion a shock transmitting to the to-be-packaged member, the packaging member packages the to-be-packaged member via the cushioning member, the cushioning member is a hollow member and includes four flat members collectively bounding a hollow space, the holding part of the to-be-packaged member is held by the cushioning member in such a manner that a space is provided between the holding part of the to-be-packaged member and a wall of the packaging member, the cushioning member has a rectangular shape containing the holding part of the to-be-packaged member by the four flat members, and the adjacent ones of the four flat members intersect to form ridge lines in contact with four wall faces of top, bottom and both side faces of the packaging member, respectively, and a flat member amongst the four flat members of the cushioning member includes a to-be-engaged part that engages with the wall member to secure the wall member to the flat member and thereby secure the bottom of the cushioning member, wherein the wall member is configured to stand from the bottom of the cushioning member at one end of the wall member in the standing direction, and the other end of the wall member which is another end of the wall member in the standing direction of the wall member is engaged with the to-be-engaged part, and wherein one of the wall member and the to-be-engaged part of the flat member is an insert part and the other of the wall member and the to-be-engaged part of the flat member includes a cut portion, and the insert part is inserted into the cut portion to secure the wall member to the flat member and thereby secure the bottom of the cushioning member.

2. The packaging member as claimed in claim 1, wherein a space is provided between a most projecting part of the predetermined part of the to-be-packaged member and a wall surface of the packaging member for preventing the most projecting part from coming into contact with the wall surface.

3. The packaging member as claimed in claim 1, wherein the ridge lines on which the adjacent ones of the four flat members intersect, respectively, are positioned approximately at the centers of the four wall faces of top, bottom and both side faces of the packaging member, respectively.

4. The packaging member as claimed in claim 1, wherein the to-be-packaged member comprises:

a receiving container including a container body as the holding part having a containing part that contains contents and a content outlet;

a cap member as the predetermined part that is fitted to the container body to cover the content outlet; and a sealing member inserted between the container body and the cap member, wherein the cushioning member is used to hold the container body in such a manner that the cap member and the cushioning member do not come into contact with one another.

5. The packaging member as claimed in claim 1, wherein the bottom of the cushioning member is configured to contact at least a portion of the bottom wall surface of the packaging member.

6. A packaging method of containing and packaging a to-be-packaged member in the inside of a packaging member via a cushioning member, the packaging method comprising:

providing the cushioning member to hold a holding part of the to-be-packaged member; and containing the to-be-packaged member in the inside of the packaging member in a state where a predetermined part of the to-be-packaged member different from the holding part of the to-be-packaged member is suspended in the space inside of the packaging member, wherein the packaging member comprises the cushioning member and a wall member configured to stand in a standing direction from a bottom of the cushioning member, the cushioning member is a hollow member and includes four flat members collectively hounding a hollow space, the holding part of the to-be-packaged member is held by the cushioning member in such a manner that a space is provided between the holding part of the to-be-packaged member and a wall of the packaging member, the cushioning member has a rectangular shape containing the holding part of the to-be-packaged member by the four flat members, and the adjacent ones of the four flat members intersect to form ridge lines in contact with four wall faces of top, bottom and both side faces of the packaging member, respectively, and a flat member amongst the four flat members of the cushioning member includes a to-be-engaged part that engages with the wall member to secure the wall member to the flat member and thereby secure the bottom of the cushioning member, wherein the wall member is configured to stand from the bottom of the cushioning member at one end of the wall member in the standing direction, and the other end of the wall member which is another end of the wall member in the standing direction of the wall member is engaged with the to-be-engaged part, and wherein one of the wall member and the to-be-engaged part of the flat member is an insert part and the other of the wall member and the to-be-engaged art of the flat member is a cut part, and the insert part is inserted in the cut part to secure the wall member to the flat member and thereby secure the bottom of the cushioning member.

* * * * *